US007189956B2

(12) United States Patent
Shimoi et al.

(10) Patent No.: US 7,189,956 B2
(45) Date of Patent: Mar. 13, 2007

(54) PHOTOMULTIPLIER AND RADIATION DETECTOR

(75) Inventors: Hideki Shimoi, Hamamatsu (JP); Hiroyuki Kyushima, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 11 days.

(21) Appl. No.: 11/189,006

(22) Filed: Jul. 26, 2005

(65) Prior Publication Data

US 2006/0091316 A1 May 4, 2006

(30) Foreign Application Priority Data

Oct. 29, 2004 (JP) ..... P2004-316502

(51) Int. Cl.
*H01J 21/20* (2006.01)
*H01J 43/04* (2006.01)

(52) U.S. Cl. ..... 250/214 VT; 250/207; 313/523; 313/532; 313/103 R; 313/104; 220/2.1 R; 220/2.2; 220/2.3 R

(58) Field of Classification Search ..... 250/207, 250/214 VT, 370.11, 370.08; 313/523, 103 R, 313/103 CM, 104, 105 R, 105 CM, 532; 315/11, 12.1; 220/2.1 R, 2.2, 2.3 R
See application file for complete search history.

(56) References Cited

U.S. PATENT DOCUMENTS

| | | | | |
|---|---|---|---|---|
| 4,376,246 A | | 3/1983 | Butterwick | 250/207 |
| 5,504,386 A | | 4/1996 | Kyushima et al. | |
| 5,594,301 A | | 1/1997 | Sawai et al. | 313/523 |
| 5,654,536 A | * | 8/1997 | Suyama et al. | 250/207 |
| 5,744,908 A | * | 4/1998 | Kyushima | 313/533 |
| 5,864,207 A | * | 1/1999 | Kume et al. | 313/533 |
| 6,020,684 A | * | 2/2000 | Negi et al. | 313/544 |
| 6,297,489 B1 | * | 10/2001 | Suyama et al. | 250/207 |
| 6,538,399 B1 | * | 3/2003 | Shimoi et al. | 315/500 |
| 6,583,558 B1 | * | 6/2003 | Suyama et al. | 313/542 |
| 6,586,877 B1 | * | 7/2003 | Suyama et al. | 313/523 |
| RE38,234 E | | 8/2003 | Warashina et al. | 250/372 |
| 2002/0017843 A1 | | 2/2002 | Iosue | 313/103 |

FOREIGN PATENT DOCUMENTS

| | | |
|---|---|---|
| EP | 0 565 247 A1 | 10/1993 |
| EP | 1 085 556 A1 | 3/2001 |
| JP | 05-290793 A | 11/1993 |
| JP | 2002-203508 | 7/2002 |

OTHER PUBLICATIONS

U.S. Appl. No. 11/189,023, filed Jul. 26, 2005, Photomultiplier and Radiation Detector, Hideki Shimoi et al.
U.S. Appl. No. 11/189,108, filed Jul. 26, 2005, Photomultiplier and Radiation Detector, Hideki Shimoi et al.
U.S. Appl. No. 11/189,135, filed Jul. 26, 2005, Photomultiplier and Radiation Detector, Hideki Shimoi et al.

* cited by examiner

*Primary Examiner*—Stephone B. Allen
*Assistant Examiner*—Davienne Monbleau
(74) *Attorney, Agent, or Firm*—Drinker Biddle & Reath LLP

(57) ABSTRACT

In a photomultiplier, a ring-like side tube is not interposed between a side tube and a stem in the radial direction, and the side tube is joined to the ring-like side tube in a state of being directly capped onto a portion of the stem that protrudes out from an open end face at the upper side of the ring-like side tube. The enlargement of the photomultiplier in the radial direction due to overlapping of the side tube and the ring-like side tube can thereby be restricted and a high density, a high degree of integration, etc., can be realized in mounting the photomultiplier.

6 Claims, 45 Drawing Sheets

(a)

(b)

(a)

(b)

(a)

(b)

(a)

(b)

(a)

(b)

(a)

(b)

(a)

(b)

(a)

(b)

PHOTOMULTIPLIER AND RADIATION DETECTOR

BACKGROUND OF THE INVENTION

1. Field of the Invention

This invention concerns a photomultiplier that makes use of the photoelectric effect and a radiation detector that uses this photomultiplier.

2. Related Background of the Invention

As one type of photomultiplier, a so-called head-on photomultiplier is known. With this head-on photomultiplier, a sealed vacuum container is arranged by providing a light receiving plate at an end portion at one side of a cylindrical side tube and providing a stem at an end portion at the other side of the side tube, and a photoelectric surface is disposed on the inner surface of the light receiving plate. An arrangement is provided wherein an electron multiplier unit, with a plurality of stages of dynodes, and an anode are layered and positioned opposite the photoelectric surface, and a plurality of stem pins, respectively connected to the respective dynodes and the anode, are insertedly mounted in the stem so as to lead to the exterior from inside the sealed container. Incident light that is made incident through the light receiving plate is converted into electrons at the photoelectric surface, the electrons that are emitted from the photoelectric surface are successively multiplied at the electron multiplier unit, wherein predetermined voltages are applied via the respective stem pins to the respective diodes, and the electrons that reach the anode upon being multiplied are taken out as an electrical signal via an anode pin, which is one of the stem pins.

Among such photomultipliers, a photomultiplier has been disclosed wherein the side tube is arranged from two members, that is, a main side tube body, to which the light receiving plate is fixed, and a ring-like side tube, which is fixed to the side surface of the stem (see for example, FIG. 7 of Japanese Published Unexamined Patent Application No. Hei. 5-290793).

SUMMARY OF THE INVENTION

However, with the above-mentioned conventional photomultiplier, since the main side tube body is capped onto the ring-like side tube, the outer diameter of the side tube is made large by an amount corresponding to the thickness of the ring-like side tube. As a result of such enlargement of the outer diameter of the side tube, the realization of high-density, highly-integrated mounting is impeded.

This invention was made to resolve the above issue and an object thereof is to provide a photomultiplier, with which the enlargement of the diameter of a side tube can be restrained, and a radiation detector equipped with such a photomultiplier.

This invention's photomultiplier comprises: a conductive first side tube; a conductive second side tube; a photoelectric surface, disposed inside a sealed container, formed of the first side tube and the second side tube and put in a vacuum state, and converting incident light made incident through a light receiving plate into electrons, which forms an end portion at one side of the sealed container; an electron multiplier unit, disposed inside the sealed container and multiplying electrons emitted from the photoelectric surface; an anode, disposed inside the sealed container and used for taking out the electrons multiplied by the electron multiplier unit as an output signal; a stem, forming an end portion at the other side of the sealed container; and a plurality of stem pins, insertedly mounted in the stem and leading to the exterior from inside the sealed container and electrically connected to the anode and the electron multiplier unit; with the first side tube surrounding the anode and the electron multiplier unit from the side, the second side tube being positioned at the stem side of the first side tube and being joined to one end portion of the first side tube and the side surface of the stem, the stem being joined to the second side tube so as to protrude out towards the first side tube from the second side tube, and the first side tube being joined to the second side tube in a state of being directly capped onto the portion of the stem that protrudes out from the second side tube.

With this photomultiplier, since the second side tube is not interposed between the first side tube and the stem in the radial direction of the side tubes, and the first side tube is joined to the second side tube in the state of being directly capped onto the portion of the stem that protrudes out from the open end face of the second side tube, the enlargement of the side tube diameter due to overlapping of the first side tube and the second side tube can be avoided. Also, in joining the first side tube and the second side tube, the first side tube can be positioned readily with respect to the second side tube by making the first side tube contact the stem that protrudes from the open end face of the second side tube.

Also preferably, the stem has an insulating base member through and to which the stem pins, including an anode pin electrically connected to the anode, are passed and joined, and a peripheral portion, near the anode pin, of the inner side (that is, the side facing the interior of the sealed container) of the base member is arranged as a chamfered shape. In this case, since the stem that is surrounded by the conductive side tubes is arranged as the insulating base member and the peripheral portion, near the anode pin, of the inner side of the base member is arranged as the chamfered shape, the creeping distance along the base member (insulator) between the triple junction, at which the conductive anode pin, the insulating base member joined to the anode pin, and vacuum intersect, and the conductive side tubes is made adequately long in comparison to the case where there is no chamfered shape. The mixing of noise into the electrical signal taken out from the anode pin is thus adequately prevented.

Here, as a specific arrangement for the case where the stem is to be arranged as a two-layer structure while exhibiting the above actions, an arrangement can be cited wherein the stem is arranged as a two-layer structure having the base member and a holding member, which is joined to one of an inner surface and an outer surface of the base member and through which the stem pins joined to the base member are passed, and in the case where the holding member is joined to the inner surface of the base member, the holding member has an insulating property and the chamfered shape is disposed at a peripheral portion, near the anode pin, of the inner side (that is, the side facing the interior of the sealed container) of the holding member.

Also, as a specific arrangement for the case where the stem is arranged as a structure of thee or more layers while exhibiting the above actions, an arrangement can be cited wherein the stem is arranged as a structure of thee or more layers having at least the base member and holding members, which are joined respectively to an inner surface and an outer surface of the base member and through which the stem pins joined to the base member are passed, the member, which is positioned at the inner side of the base member and through which the anode pin is passed, has an insulating property, and the chamfered shape is disposed at a peripheral portion, near the anode pin, of the inner side (that is, the side facing the interior of the sealed container) of the member, which is positioned at the inner side of the base member and through which the anode pin is passed.

Here, by installing a scintillator, which converts radiation into light and emits the light, at the outer side of the light receiving plate of the above-described photomultiplier, a favorable radiation detector that exhibits the above-mentioned actions is provided.

DESCRIPTION OF THE PREFERRED EMBODIMENTS

Figure 1:
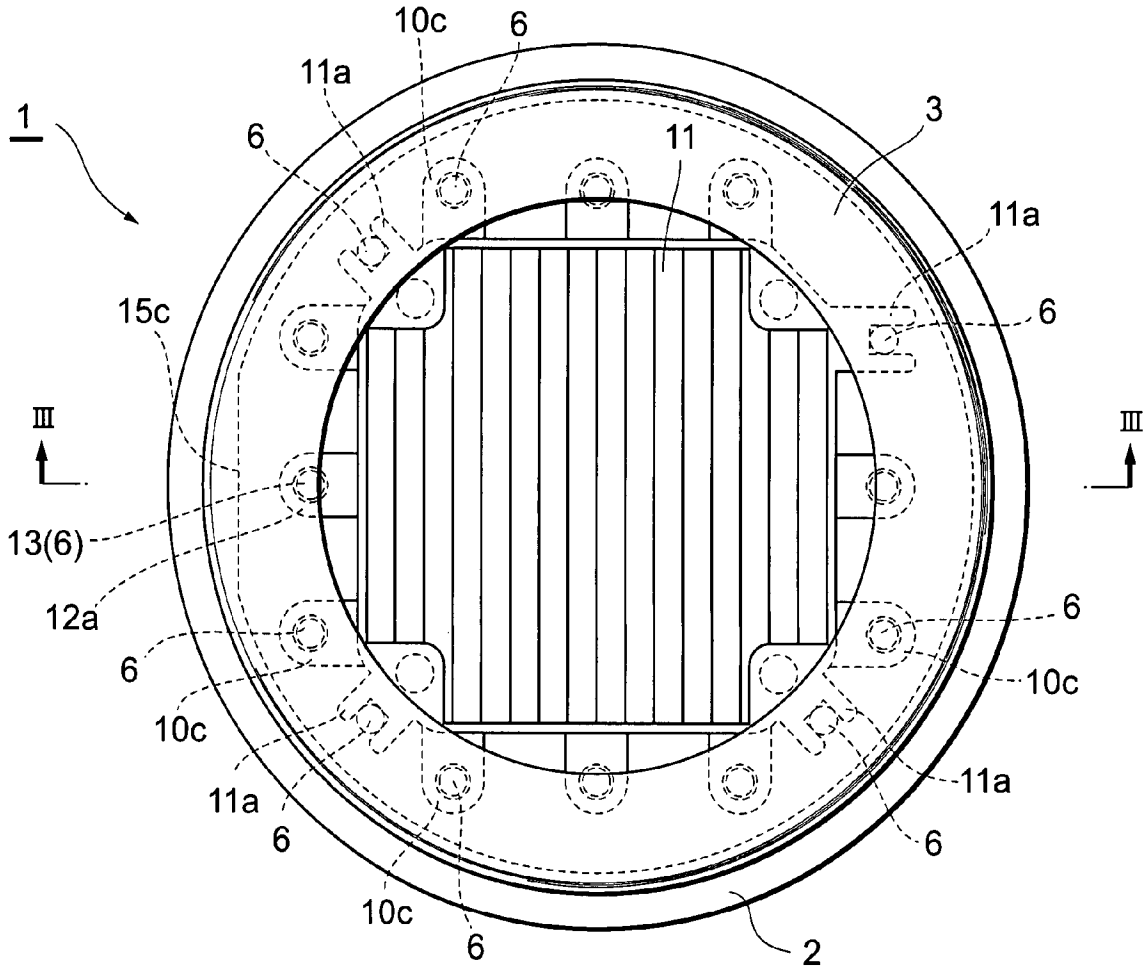
FIG. 1 is a plan view of a photomultiplier of a first embodiment of this invention.

Preferred embodiments of this invention's photomultiplier and radiation detector shall now be described with reference to the drawings. The terms, "upper," "lower," etc., in the following description are descriptive terms based on the states illustrated in the drawings. In the drawings, portions that are the same or correspond to each other are provided with the same symbol and overlapping description shall be omitted.

[First Embodiment]

Figure 2:
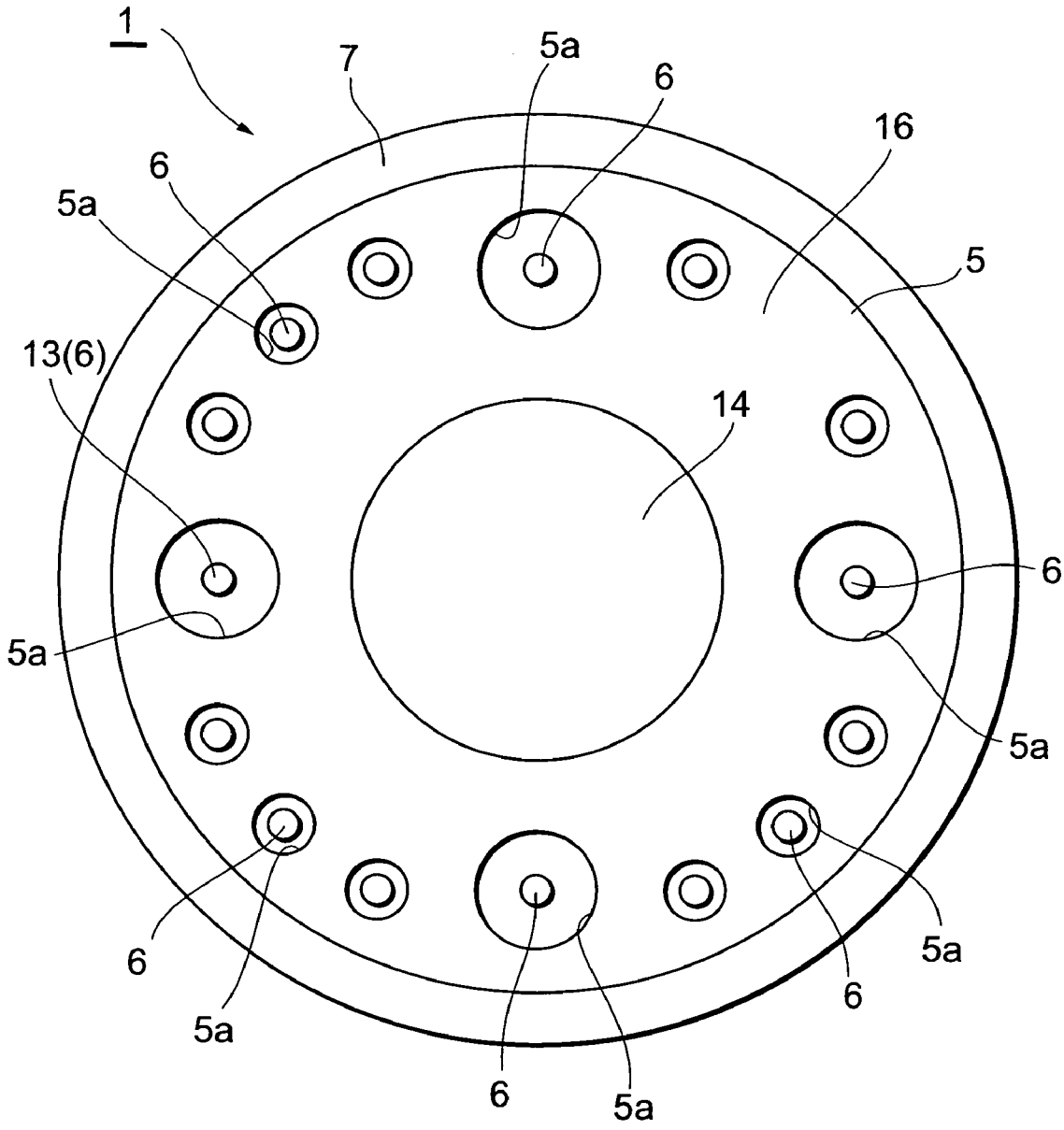
FIG. 2 is a bottom view of the photomultiplier shown in FIG. 1.
Figure 3:
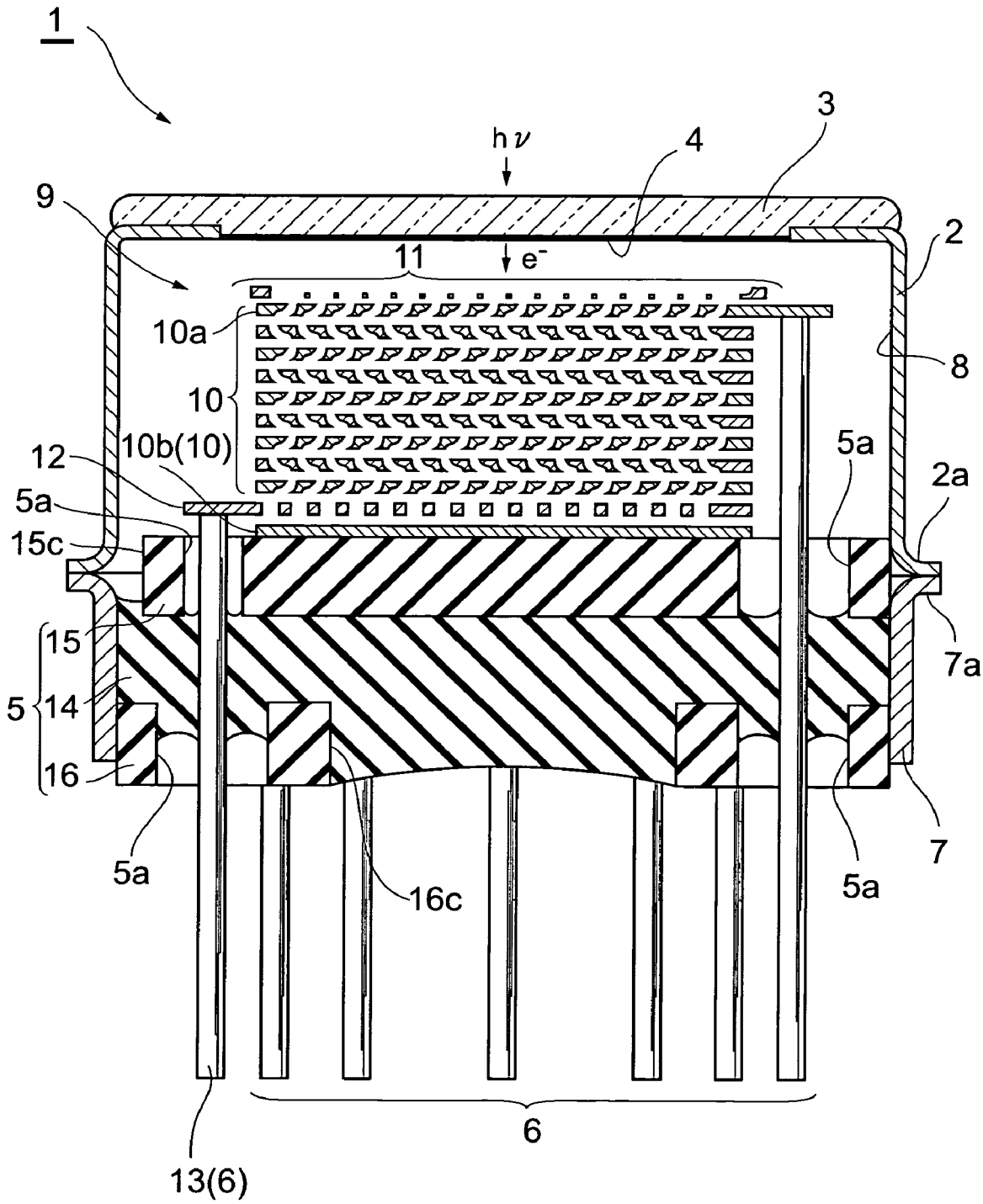
FIG. 3 is a sectional view taken along line III—III of the photomultiplier shown in FIG. 1.

FIG. 1 and FIG. 2 are a plan view and a bottom view, respectively, of an embodiment of a photomultiplier by this invention, and FIG. 3 is a sectional view taken along line III—III in FIG. 1. In FIG. 1 to FIG. 3, a photomultiplier 1 is arranged as a device that emits electrons upon incidence of light from the exterior and multiplies and outputs the electrons as a signal.

As shown in FIG. 1 to FIG. 3, the photomultiplier 1 has a metal side tube (first side tube) 2 with a substantially cylindrical shape. As shown in FIG. 3, a glass light receiving plate 3 is fixed in an airtight manner to an open end at the upper side (one side) of the side tube 2, and a photoelectric surface 4, for converting the light made incident through the light receiving plate 3 into electrons, is formed on the inner surface of the light receiving plate 3. Also, a disk-like stem 5 is positioned at an open end at the lower side (other side) of the side tube 2 as shown in FIG. 2 and FIG. 3. A plurality (15) of conductive stem pins 6, which are positioned apart from each other in the circumferential direction at positions substantially along a circle, are insertedly mounted in an airtight manner in the stem 5, and a metal, ring-like side tube (second side tube) 7 is fixed in an airtight manner so as to surround the stem 5 from the side. As shown in FIG. 3, a flange portion 2*a*, formed at a lower end portion of the upper side tube 2, and a flange portion 7*a* of the same diameter, formed at the lower ring-like side tube 7, are welded together, and by the side tube 2 and the ring-like side tube 7 being thereby fixed in an airtight manner, a sealed container 8, the interior of which is kept in a vacuum state, is formed.

Inside the sealed container 8, which is formed thus, is housed an electron multiplier unit 9 for multiplying the electrons emitted from the photoelectric surface 4. With this electron multiplying portion 9, a plurality of stages (ten in the present embodiment) of thin, plate-like dynodes 10, each having a plurality of electron multiplying holes, are laminated and formed as a block and installed on the upper surface of the stem 5. As shown in FIG. 1 and FIG. 3, at a predetermined peripheral portion of each dynode 10 is formed a dynode connecting tab 10*c*, which protrudes to the exterior, and a tip portion of a predetermined stem pin 6, insertedly mounted in the stem 5, is fixed by welding to the lower surface side of each dynode connecting tab 10*c*. The respective dynodes 10 are thus electrically connected respectively to the stem pins 6.

Furthermore, inside the sealed container 8, a plate-like focusing electrode 11, for converging and guiding the electrons emitted from the photoelectric surface 4 to the electron multiplier unit 9, is formed between the electron multiplier unit 9 and the photoelectric surface 4, and a plate-like anode 12, for taking out the electrons, multiplied by the electron multiplier unit 9 and emitted from the dynode 10*b* of the final stage, as an output signal, is layered at the stage one stage above the dynode 10*b* of the final stage as shown in FIG. 3. As shown in FIG. 1, protruding tabs 11*a*, which protrude outward, are formed respectively at the four corners of the focusing electrode 11, and by the predetermined stem pins 6 being fixed by welding to the respective protruding tabs 11*a*, the stem pins 6 are electrically connected to the focusing electrode 11. Also, an anode connecting tab 12*a*, which protrudes outward, is formed at a predetermined peripheral portion of the anode 12, and by an anode pin 13, which is one of the stem pins 6, being fixed by welding to the anode connecting tab 12*a*, the anode pin 13 is electrically connected to the anode 12. And when predetermined voltages are applied to the electron multiplier unit 9 and the anode 12 by means of the stem pins 6 connected to an unillustrated power supply circuit, the photoelectric surface 4 and the focusing electrode 11 are set to the same potential and the potentials of the respective dynodes 10 are set so as to increase in the order of layering from the upper stage to the lower stage. The anode 12 is set to a higher potential than the dynode 10*b* of the final stage. Though in the present embodiment, the final dynode 10*b* is directly set and fixed on the upper surface of the stem 5, an arrangement, wherein the final dynode 10*b* is supported, for example, by a supporting member installed on the upper surface of the stem 5 and a space is interposed between final dynode 10*b* and the upper surface of the stem 5, is also possible.

With the photomultiplier 1, arranged as described above, when light (hv) is made incident on the photoelectric surface 4 from the light receiving plate 3 side, the light at the photoelectric surface 4 is photoelectrically converted and electrons (e-) are emitted into the sealed container 8. The emitted electrons are focused by the focusing electrode 11 onto the first dynode 10*a* of the electron multiplier unit 9. The electrons are then multiplied successively inside the electron multiplier unit 9 and a set of secondary electrons are emitted from final dynode 10*b*. This group of secondary electrons is guided to the anode 12 and output to the exterior via the anode pin 13, which is connected to the anode 12.

The arrangement of the above-mentioned stem 5 shall now be described in further detail. Here, with the stem 5, the side, which is to be put in a vacuum state upon forming of the sealed container 8 of photomultiplier, shall be referred to as the "inner side" (upper side).

As shown in FIG. 3, the stem 5 has a three-layer structure formed of a base member 14, an upper holding member 15, which is joined to the upper side (inner side) of the base member 14, and a lower holding member 16, which is joined to the lower side (outer side) of the base member 14, and the above-mentioned ring-like side tube 7 is fixed to the side surface of this structure. In the present embodiment, the stem 5 is fixed to the ring-like side tube 7 by joining the side surface of the base member 14, which makes up the stem 5, to the inner wall surface of the ring-like side tube 7. Here, although the lower (outer) surface of the lower holding member 16 protrudes below the lower end of the ring-like side tube 7, the position of fixing of the stem 5 with respect to the ring-like side tube 7 is not restricted to that described above.

Figure 4:
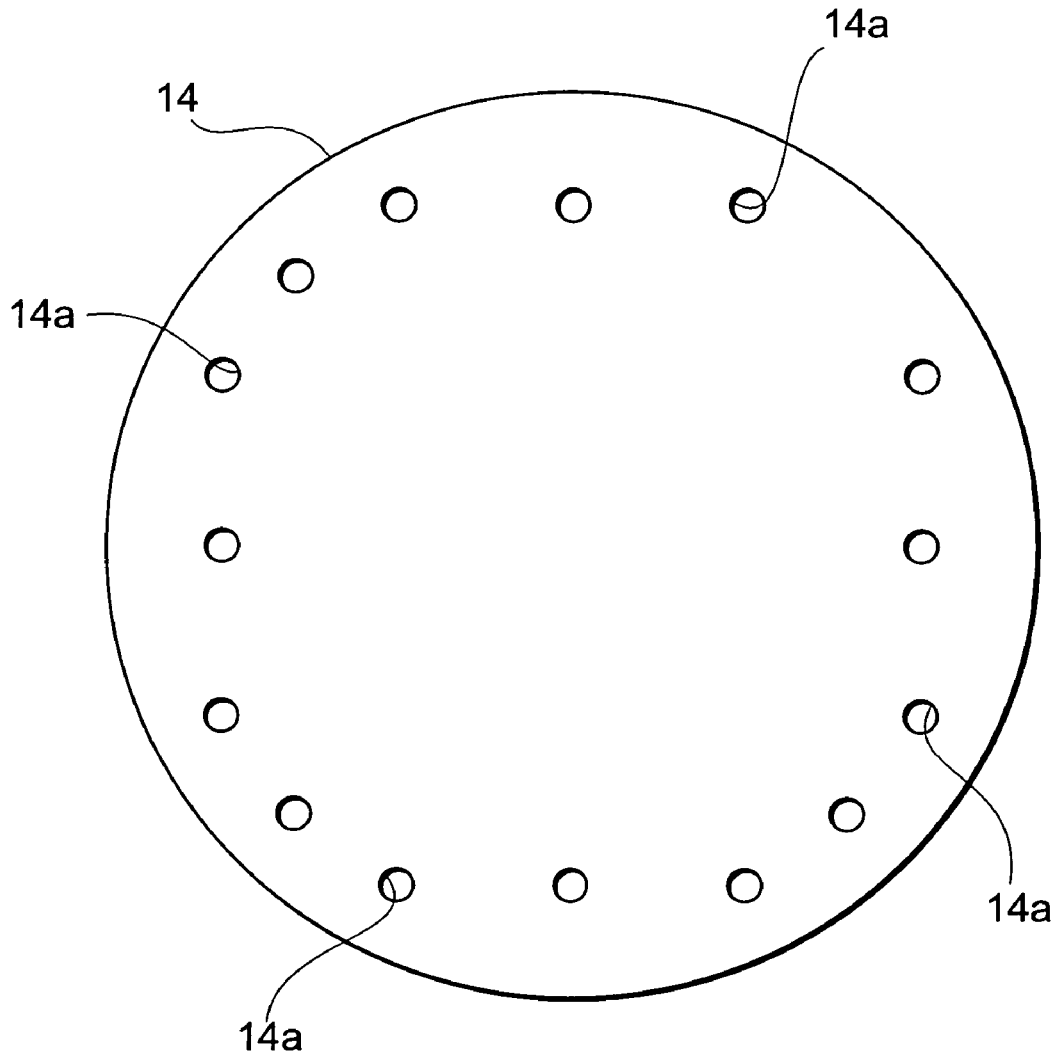
FIG. 4 is a plan view of a base member making up a stem of the first embodiment.

The base member 14 is a disk-like member formed of an insulating glass having, for example, covar as the main component and having a melting point of approximately 780 degrees, and is made black in color to a degree to which light will not be transmitted into the sealed container 8 from the lower surface. Also as shown in FIG. 4, a plurality (15) of openings 14*a*, of substantially the same diameter as the outer diameter of the stem pins 6, are formed in the base member 14 so as to be aligned along the outer circumferential portion of the base member 14.

Figure 5:
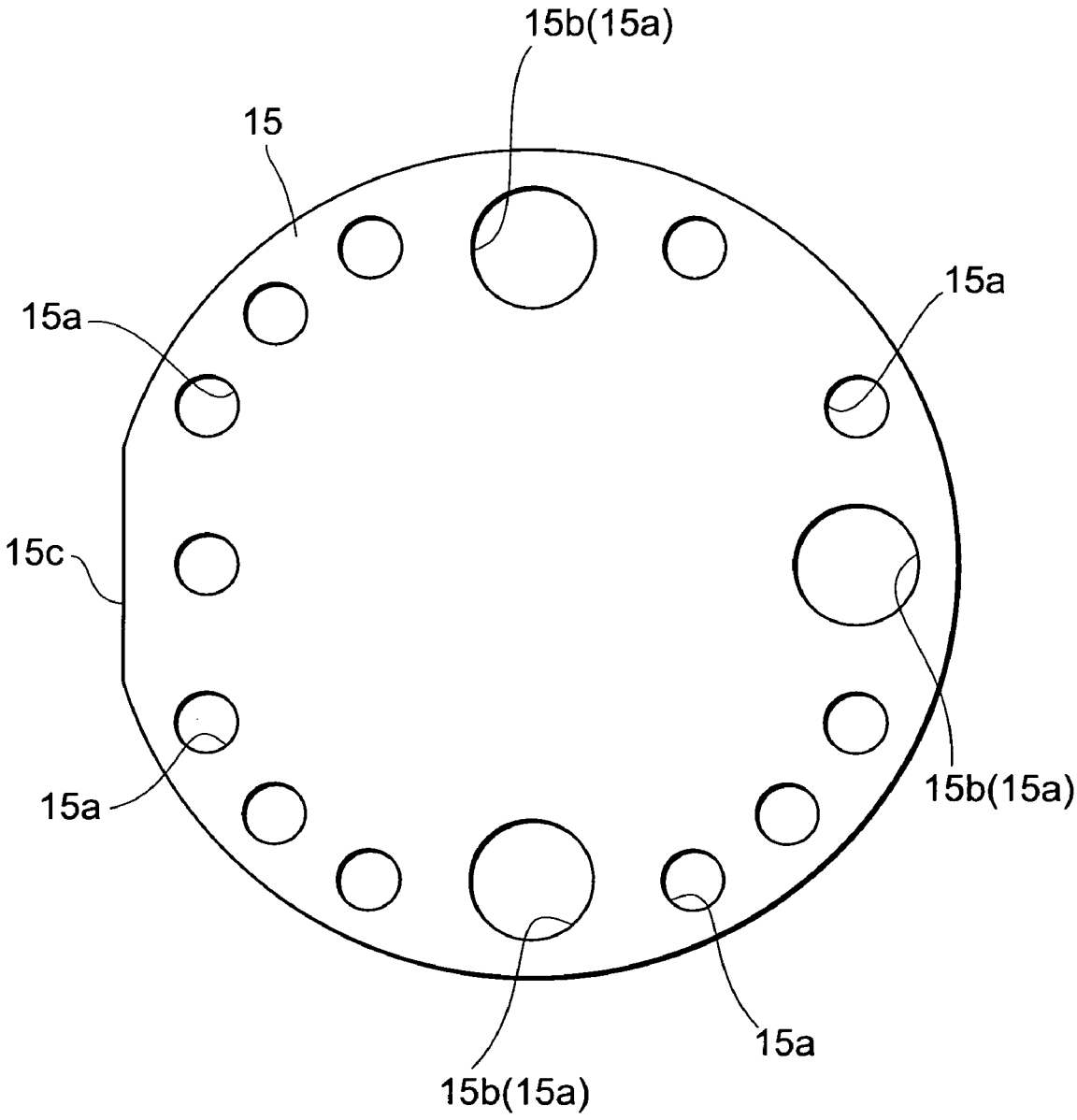
FIG. 5 is a plan view of an upper holding member making up the stem of the first embodiment.

The upper holding member 15 is a disk-like member, formed of insulating glass that has been made to have a higher melting point than the base member 14, that is for example, a melting point of approximately 1100 degrees by, for example, the addition of an alumina-based powder to covar, and is made black in color in order to effectively absorb light emitted inside the sealed container 8. Also as shown in FIG. 5, the upper holding member 15 has a plurality (15) of the openings 15*a*, positioned in the same manner as those of the base member 14. Each opening 15*a* is made larger in diameter than the openings 14*a* formed in the base member 14, and furthermore, among the openings 15*a*, the openings of at least two predetermined locations are arranged as large-diameter openings 15*b*, which are made even larger in diameter than the other openings 15*a* in order to enable the entry of a positioning jig 18 (to be described later) into the base member 14. In the upper holding member 15, the large-diameter openings 15*b* are positioned at three locations, other than the location of the opening 15*a* into which the anode pin 13 is inserted, which are separated by a phase angle of 90 degrees. Also with the upper holding member 15, a peripheral portion near the opening 15*a*, through which the anode pin 13 is inserted, is made as a chamfered shape 15*c*. By this arrangement, the peripheral portion, near the anode pin 13, of the upper holding member 15 that faces the interior of the sealed container 8 is arranged as the chamfered shape 15*c*.

Figure 6:
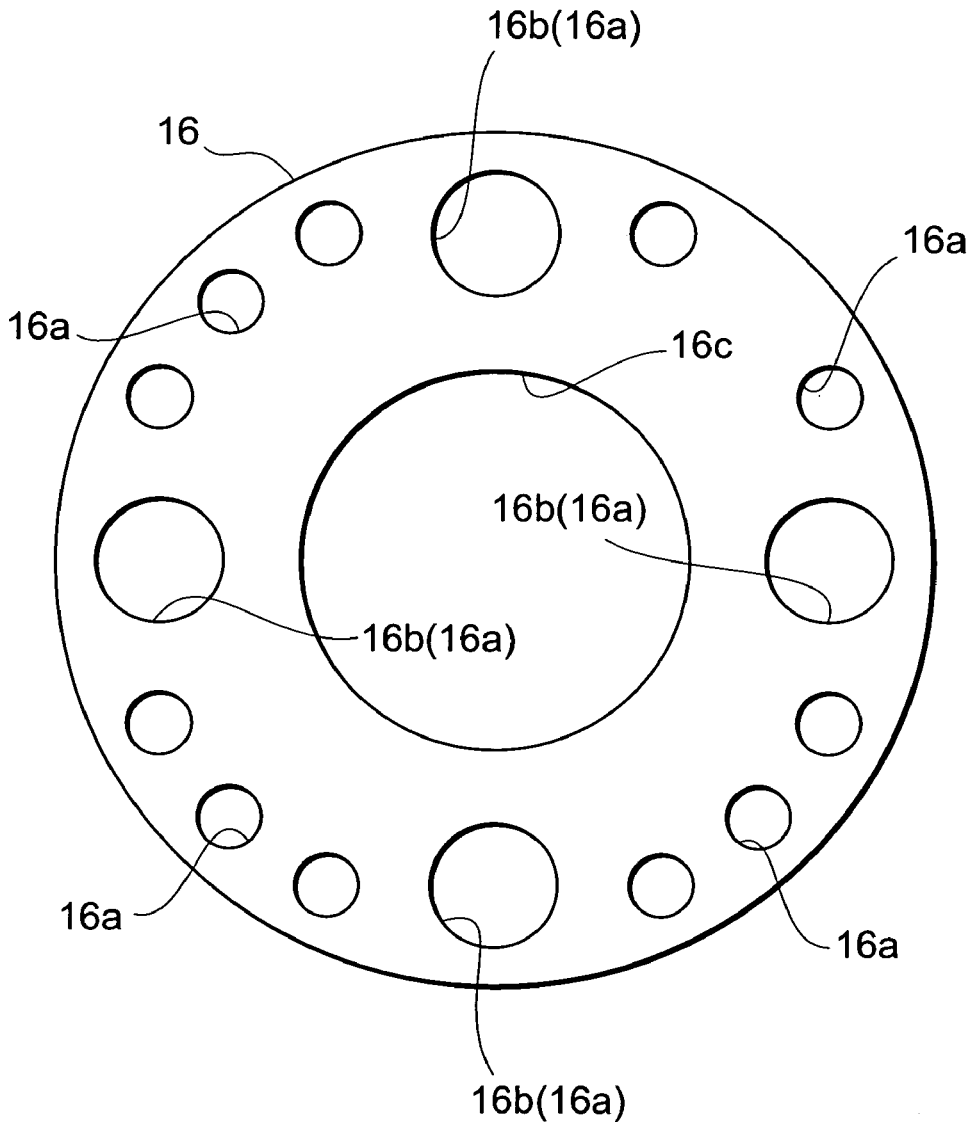
FIG. 6 is a plan view of a lower holding member making up the stem of the first embodiment.

As with the upper holding member 15, the lower holding member 16 is a disk-like member, formed of insulating glass that has been made to have a higher melting point than the base member 14, that is for example, a melting point of approximately 1100 degrees by, for example, the addition of an alumina-based powder to covar and, by the difference in the composition of the alumina-based powder added, is made to exhibit a white color and have a higher physical strength than the base member 14 and the upper holding member 15. Also as shown in FIG. 6, the lower holding member 16 has a plurality of openings 16*a* formed in the same manner as the upper holding member 15, and among the openings 16*a*, the openings of at least two predetermined locations are arranged as the large-diameter openings 16*b* to enable the entry of a positioning jig 18. In the lower holding member 16, the large-diameter openings 16*b* are positioned at four locations separated by a phase angle of 90 degrees and including that of the opening 16*a* into which the anode pin 13 is inserted, and the large-diameter openings 16*b* at the three locations besides the large-diameter opening 16*b*, through which the anode pin 13 is inserted, are positioned coaxial to the large-diameter openings 15*b* of the upper holding member 15. Furthermore, a circular base member seep opening 16*c* is formed at a central portion of the lower holding member 16.

As shown in FIG. 3, the base member 14, the upper holding member 15, and the lower holding member 16 are overlapped in a state, in which the axial center positions of the respective openings 14*a*, 15*a*, and 16*a* and large-diameter openings 15*b* and 16*b* are matched, and are joined by fusing by the melting of the base member 14 in the state in which the stem pins 6 are inserted through the respective openings 14*a*, 15*a*, 16*a*, 15*b*, and 16*b*. More specifically, the upper holding member 15 and the lower holding member 16 are joined in close contact with the respective surfaces of the base member 14, the respective stem pins 6 are inserted through the respective openings 15*a*, 16*a*, 15*b*, and 16*b* of the upper holding member 15 and the lower holding member 16 so that recesses 5*a*, having the base member 14 as the bottom surfaces, are formed along the full circumferences of the portions of both the upper (inner) surface and lower (outer) surface of the stem 5 through which the respective stem pin 6 pass, and the respective stem pins 6 are joined in close contact with the base member 14 at the bottom surfaces of these recesses 5*a*.

Also, the stem 5 is joined to the ring-like side tube 7 upon being made to protrude out to the side tube 2 side from the upper open end face of the ring-like side tube 7, and the side tube 2 is joined to the ring-like side tube 7 by fixing by welding of the mutual flange portions 2*a* and 7*a* in the state of being directly capped onto the portion of the stem 5 that protrudes out from the open end face of the ring-like side tube 7.

An example of manufacturing the stem 5, arranged in the above-described manner shall now be described with reference to FIG. 7 and FIG. 8.

Figure 7:
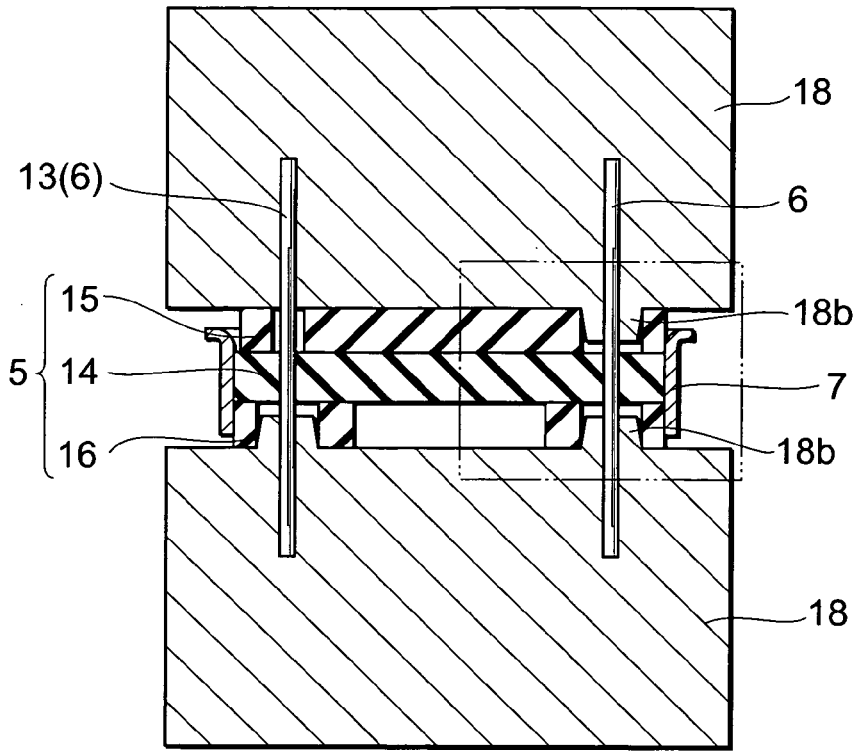
FIG. 7 shows an example of manufacturing the stem of the first embodiment, with (a) being a sectional side view and (b) being an enlarged view of the principal portions of the stem in a state prior to sintering.
Figure 7:
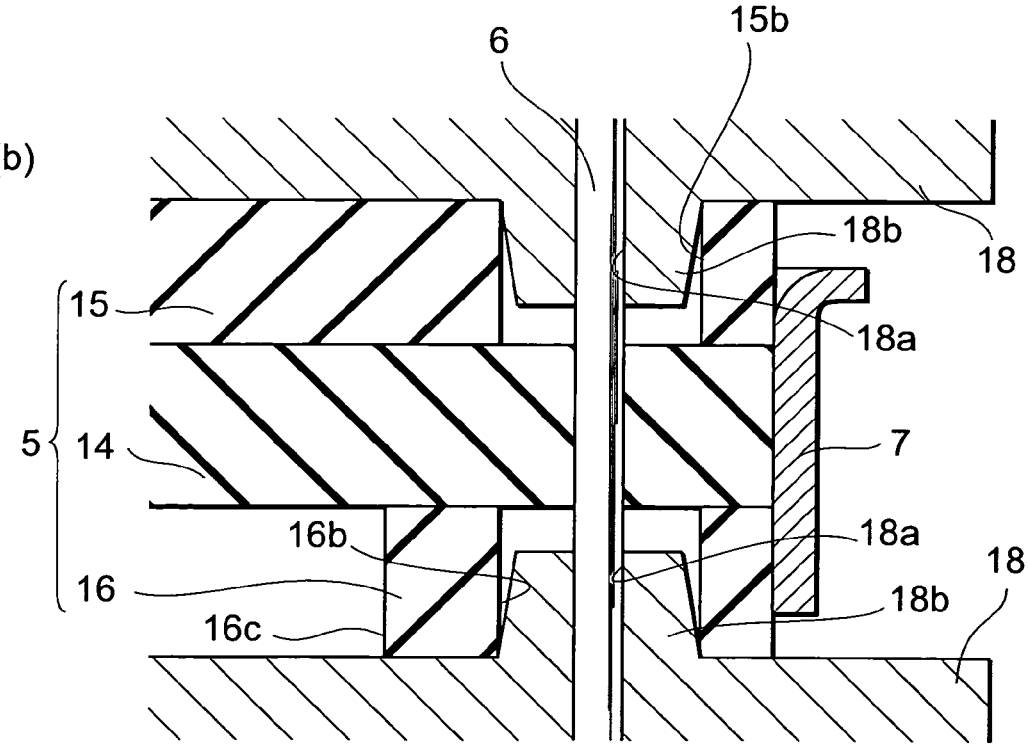
Figure 8:
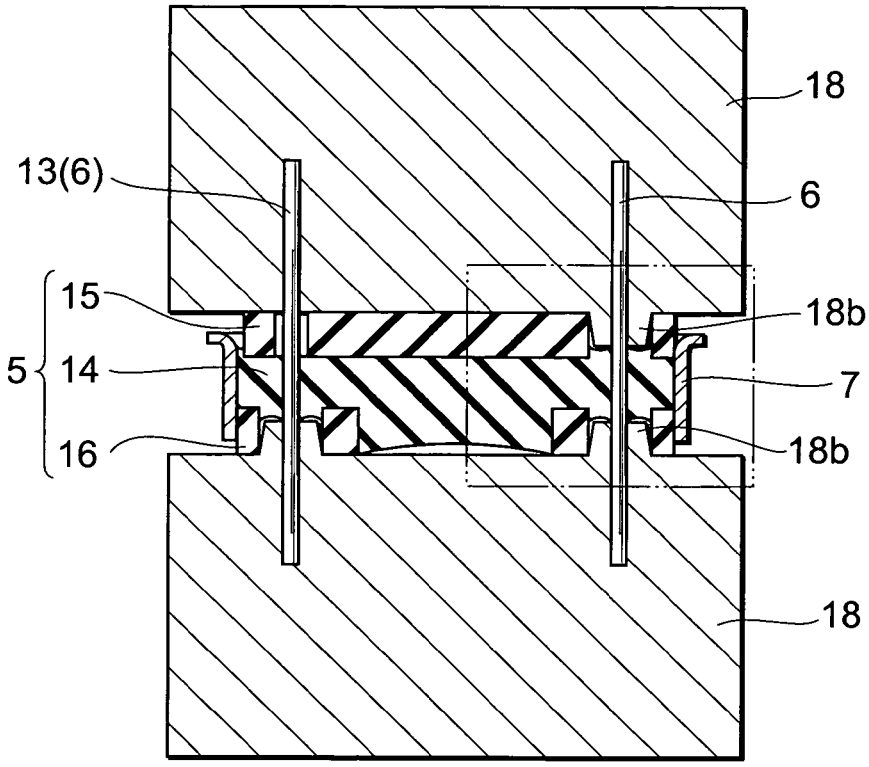
FIG. 8 shows the example of manufacturing the stem of the first embodiment, with (a) being a sectional side view and (b) being an enlarged view of the principal portions of the stem in a state after sintering.
Figure 8:
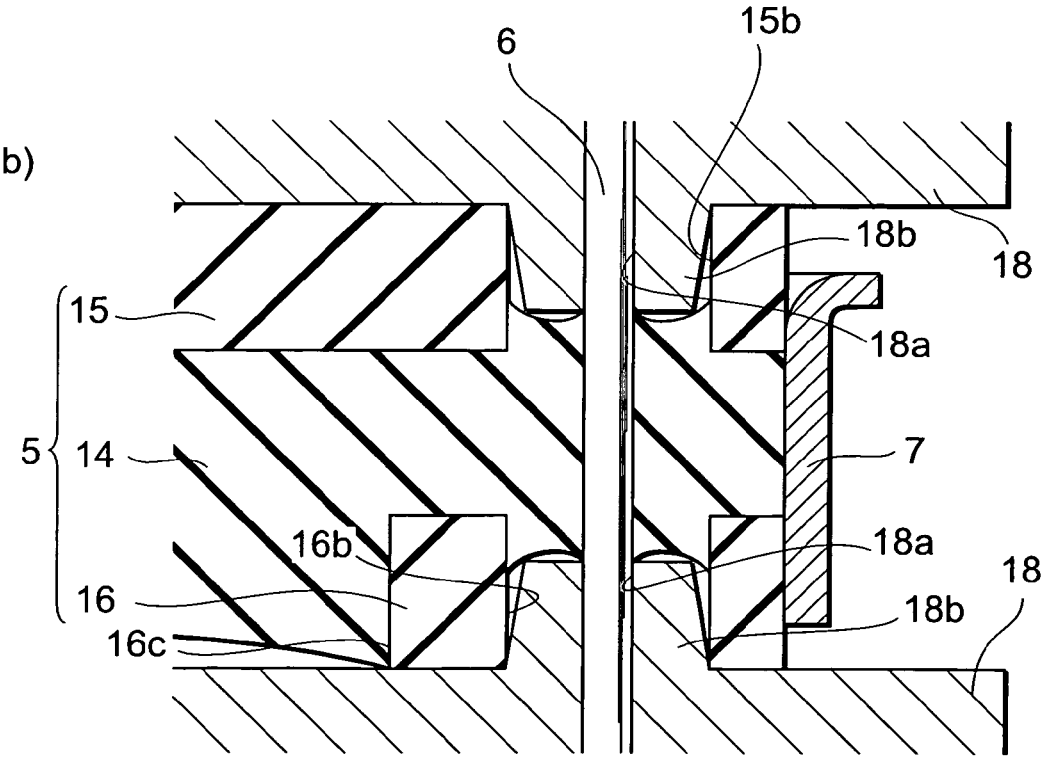

In manufacturing the stem 5, a pair of positioning jigs 18, which sandwich and hold the base member 14, the upper holding member 15, the lower holding member 16, and the respective stem pins 6 in a positioned state, are used as shown in FIG. 7(*a*) and FIG. 7(*b*).

The positioning jigs 18 are block-like members formed, for example, of highly heat resistant carbon with a melting point of no less than 1100 degrees, and at one side of each, insertion holes 18*a*, into and by which the stem pins 6 are inserted and supported, are formed in correspondence with the positions of the respective stem pins 6. At the peripheries of the openings of the insertion holes 18*a*, which, among the insertion holes 18*a*, correspond to the large-diameter opening 15*b* of the upper holding member 15 and the large-diameter opening 16*b* of the lower holding member 16, are formed substantially cylindrical protrusions 18*b*, which position the upper holding member 15 and the lower holding member 16 with respect to the base member 14 by entering inside the large-diameter openings 15*b* and 16*b* and thereby secure the concentricities of the respective stem pins 6 that pass through the base member 14 with respect to the respective openings 15*a* and 16*a*.

In setting the stem 5 using the positioning jigs 18, firstly, one positioning jig 18 (the jig at the lower side of the figure) is set, with the protrusions 18*b* facing upward, on a working surface (not shown) and the stem pins 6 are respectively inserted and fixed in the insertion holes 18*a* of this positioning jig 18. The lower holding member 16 is then set on the positioning jig 18 by making the protrusions 18*b* of the positioning jig 18 enter the large-diameter openings 16*b* while passing the respective stem pins 6, fixed to the positioning jig 18, through the openings 16*a*. Furthermore, while roughly matching the axial center positions of the respective openings 14*a* and 15*a* and the respective large-diameter openings 15*b* to the respective openings 16*a* and the large-diameter openings 16*b* of the lower holding member 16, the stem pins 6 are passed through the respective openings 14*a* and 15*a* and the respective large-diameter openings 15*b* to overlap the base member 14 and the upper holding member 15, in this order, onto the lower holding member 16, and thereafter, the ring-like side tube 7 is fitted onto the base member 14. Here, a substantially upper half portion of the upper holding member 15 is made to protrude out from the upper open end face of the ring-like side tube 7. Lastly, the other positioning jig 18 (the jig at the upper side of the figure) is set on the upper holding member 15 by making the protrusions 18*b* enter into the large-diameter openings 15*b* of the upper holding member 15 while inserting the respective stem pins 6, protruding from the upper holding member 15, into the insertion holes 18*a*. The setting of the stem 5 is thereby completed. The ring-like side tube 7 and the respective stem pins 6 that are set are subject to a surface oxidizing process in advance in order to heighten the property of fusion with the base member 14.

The stem 5, which is set thus, is then loaded inside an electric oven (not shown) along with the positioning jigs 18 and sintered at a temperature of approximately 850 to 900 degrees (a temperature that is higher than the melting point of the base member 14 but lower than the melting points of the upper holding member 15 and the lower holding member 16) while pressurizing the stem 5 sandwichingly by the positioning jigs 18. In this sintering process, just the base member 14, which has a melting point of approximately 780 degrees, melts and the base member 14 and the respective holding members 15 and 16, the base member 14 and the respective stem pins 6, and the base member 14 and the ring-like side tube 7 become fused as shown in FIG. 8(*a*) and FIG. 8(*b*). Here, although in order to achieve improved close adhesion with the other components, the volume of the base member 14 is adjusted to be somewhat high, the positioning of the base member 14 in the height direction within the large-diameter openings 15*b* and 16*b* is achieved by means of the end faces of the protrusions 18*b* of the positioning jigs 18 and the excess volume of the molten base member 14 is made to escape into the base member seep opening 16*c* of the lower holding member 16 as shown in FIG. 8(*b*). When the sintering process ends, the stem 5 is taken out from the electric oven and the upper and lower positioning jigs 18 are removed, thereby completing the manufacture of the stem 5.

With such a method of manufacturing the stem 5, since the base member 14 can be readily positioned with respect to the upper holding member 15 and the lower holding member 16 by making the protrusions 18*b* of the positioning jigs 18 enter into the large-diameter openings 15*b* of the upper holding member 15 and the large-diameter openings 16*b* of the lower holding member 16, the manufacturing process is simplified and the manufacturing cost can be reduced. Furthermore, the concentricities of the respective stem pins 6 and the respective openings 15*a* and 16*a* are secured by the positioning jigs 18.

Next, the dynodes 10, focusing electrode 11, and the anode 12, which are layered on the inner (upper) surface of the stem 5 of the stem assembly thus obtained, are fixed by welding the dynode connecting tabs 10*a*, the anode connecting tabs 12*a*, and protruding tabs 11*a*, provided on focusing electrode 11, respectively to the corresponding stem pins 6. Then in a vacuum state, upon bringing the side tube 2, to which the light receiving plate 3 is fixed, into contact with the side surface of the portion of the stem 5 that protrudes from the open end face of the ring-like side tube 7, the side tube 2 is capped onto this protruding portion of the stem 5, and the flange portion 2*a* of the side tube 2 and the flange portion 7*a* of the ring-like side tube 7 are fixed by welding and thereby assembled together. The head-on type photomultiplier 1, shown in FIG. 1 to FIG. 3, is thereby obtained.

With this photomultiplier 1, the ring-like side tube 7 is not interposed between the side tube 2 and the stem 5 in the radial direction, and the side tube 2 is joined to the ring-like side tube 7 in the state of being directly capped onto the portion of the stem 5 that protrudes out from the open end face of the ring-like side tube 7. Enlargement of the diameter of the photomultiplier 1 in the radial direction due to the overlapping of the side tube 2 and the ring-like side tube 7 can thus be avoided, and a high-density, a high degree of integration, etc., can be realized in mounting this photomultiplier 1. Furthermore, in joining the side tube 2 and the ring-like side tube 7, the side tube 2 and the ring-like side tube 7 can be positioned readily by setting the side tube 2 along the side surface of the stem 5 portion that protrudes out from the upper open end face of the ring-like side tube 7, and then capping the side tube 2 onto this protruding portion of the stem 5. As a result, the manufacturing process of the photomultiplier 1 is simplified and the manufacturing cost can be reduced.

Also with the photomultiplier 1, in the stem 5, the upper holding member 15, which is the member at the upper (inner) side of the base member 14, has an insulating property, and the peripheral portion near the anode pin 13 is arranged as the chamfered shape 15*c* (see FIG. 5). The actions of this arrangement shall now be described in detail using FIG. 9 and FIG. 10.

Figure 9:
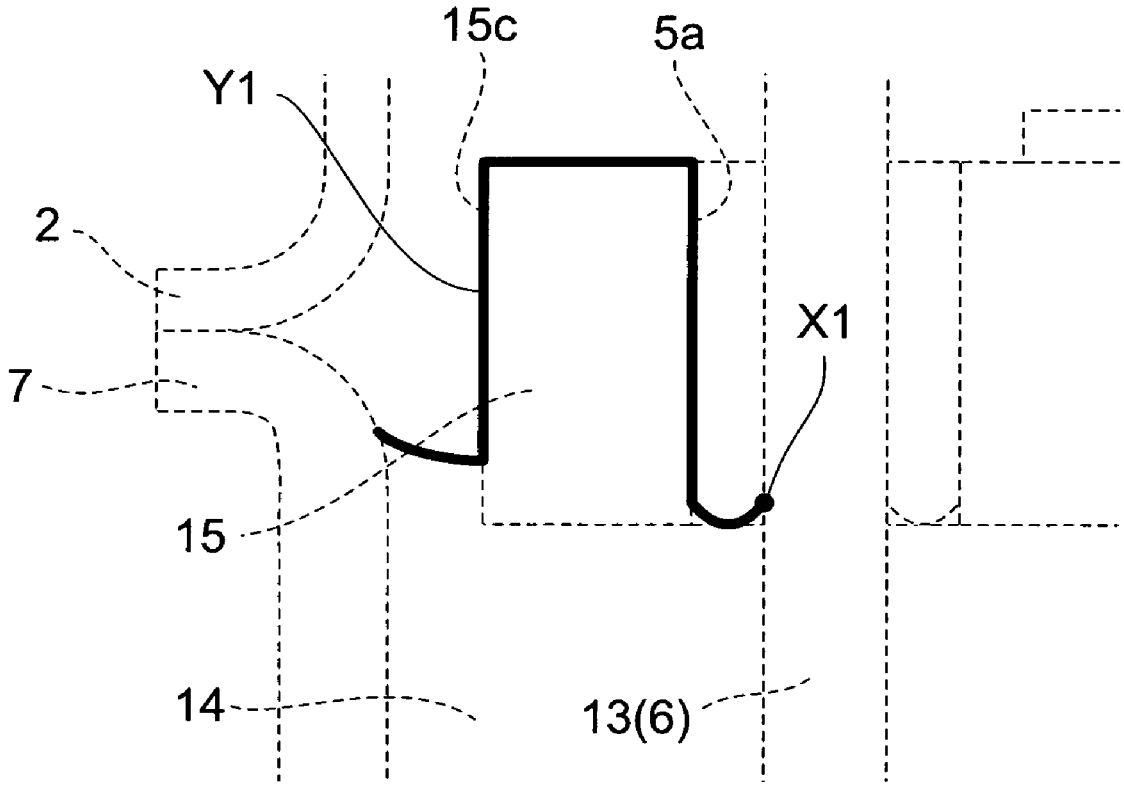
FIG. 9 is an enlarged view of the principal portions near an anode pin and shows a triple junction and the creeping distance of the photomultiplier shown in FIG. 3.
Figure 10:
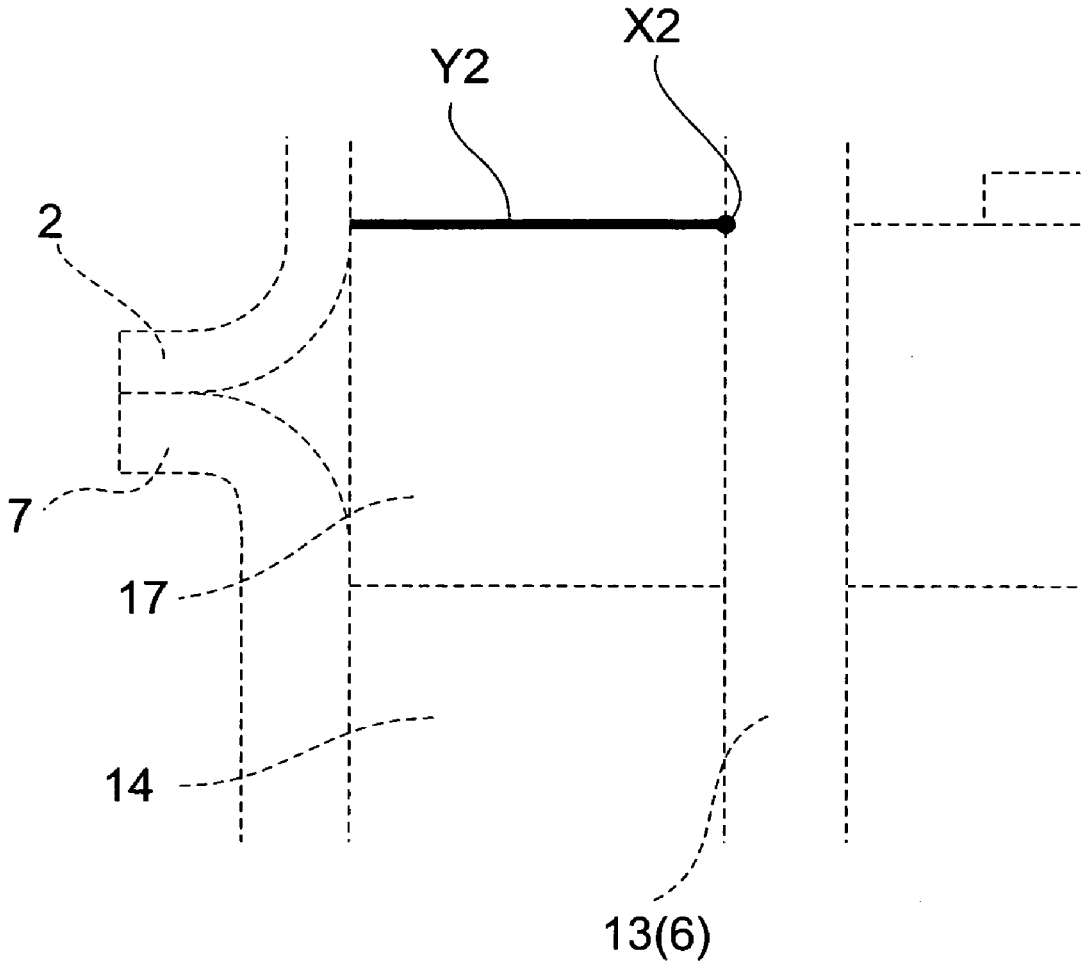
FIG. 10 is an enlarged view of the principal portions near an anode pin and shows a triple junction and the creeping distance of a comparative example.

FIG. 9 is an enlarged sectional view of the principal portions near the anode pin 13 of the present embodiment and FIG. 10 is an enlarged sectional view of the principal portions near the anode pin 13 of a comparative example. In the comparative example, the recesses 5*a* are not formed at portions of the stem 5 through which the stem pins 6, including the anode pin 13, are passed, and an upper holding member 17, in which the chamfered shape 15*c* is not formed near the anode pin 13, is used. For the sake of description, the respective members are indicated by broken lines.

As shown in FIG. 9, with the present embodiment, in regard to the vicinity of the anode pin 13, the creeping distance Y1 along insulators from the ring-like side tube 7 to a triple junction X1, at which the conductive anode pin 13, the insulating base member 14, joined to the stem pins 6 including the anode pin 13, and vacuum intersect, is elongated by an amount corresponding to the distance along the chamfered shape 15*c* of the upper holding member 15 in comparison to the case of the comparative example shown in FIG. 10, wherein an upper holding member 17, without the chamfered shape 15*c* being formed near the anode pin 13, is used. By the creeping distance Y1 being thus elongated, dielectric breakdown and current leakage caused by creeping discharge in the vicinity of the anode pin 13 are prevented adequately and the mixing of noise into the electrical signal taken out from the anode pin 13 is prevented.

Also with the present embodiment, since the full circumferences of the portions of the upper (inner) surface of the stem 5, through which the stem pins 6, including the anode pin 13, pass, are formed as recesses 5*a* having the base member 14 as the bottom surfaces, the creeping distance Y1 regarding the vicinity of the anode pin 13 is elongated by an amount corresponding to the height of recess 5*a* in comparison to the creeping distance Y2 along insulators from a triple junction X2 to the side tube 2 in the comparative example shown in FIG. 10. The occurrence of creeping discharge near the anode pin 13 is thereby restrained further and the mixing of noise into the electrical signal taken out from the anode pin 13 is prevented more effectively. Since the creeping distance is likewise elongated by the amount corresponding to the height of recess 5*a* for each of the other stem pins 6 besides the anode pin 13, the occurrence of creeping discharge is restrained and the voltage endurance of the photomultiplier 1 is improved. Since by the forming of recesses 5*a*, the creeping distances along insulators between the stem pins 6 are also elongated at the same time, the voltage endurance of the photomultiplier 1 is improved further.

Furthermore with the present embodiment, by the forming of above-described recesses 5*a*, triple junctions X1 are positioned at peripheral portions of the portions at which the bottom surfaces of recesses 5*a* are joined to the stem pins 6 including the anode pin 13 and are put in a concealed-like state inside recesses 5*a*. By thus concealing triple junctions X1 inside recesses 5*a*, the occurrence of creeping discharge is restrained and the voltage endurance of the photomultiplier 1 is improved in comparison to the case where triple junctions X2 are put in bare states on the upper surface of the upper holding member 17 as in the comparative example shown in FIG. 10.

Since the concentricities of the respective stem pins 6 and the respective openings 15*a* of the upper holding member 15 and the respective openings 16*a* of the lower holding member 16 are secured by the positioning jigs 18, the stem pins 6 can be prevented from approaching the inner wall surfaces of the openings 15*a* and 16*a*. Triple junctions X1 can thus be concealed definitely inside the recesses 5*a* and the voltage endurance of the photomultiplier 1 is thus secured further.

Also with the photomultiplier 1, since the stem 5 is arranged as a three-layer structure formed of the base member 14, the upper holding member 15, joined to the upper side (inner side) of the base member 14, and the lower holding member 16, joined to the lower side (outer side) of the base member 14, the positional precision, flatness, and levelness of both surfaces of the stem 5 are improved. Consequently with the photomultiplier 1, the positional precision of the interval between the photoelectric surface 4 and the electron multiplier unit 9, which is installed on the upper surface (inner surface) of the stem 5, and the seating property of the electron multiplier unit 9 are improved, thus enabling photoelectric conversion efficiency and other characteristics to be obtained satisfactorily, and the dimensional precision of the total length of the photomultiplier 1 and the mounting property regarding surface mounting of the photomultiplier 1 are also improved.

Also, since the base member seep opening 16*c* (see FIG. 6) is formed in the lower holding member 16, the excess volume of the molten base member 14 can be made to escape satisfactorily into the base member seep opening 16*c*. Thus in the process of melting the base member 14, the base member 14 will hardly overflow onto the surface of the stem 5 via the openings 15*a* of the upper holding member 15 and the openings 16*a* of the lower holding member 16 and the positional precision, flatness, and levelness of both surfaces of the stem 5 are thus secured.

Also with the photomultiplier 1, the full circumferences of the stem pin 6 passing portions of both surfaces of the stem 5 are arranged as recesses 5*a* having the base member 14 as the bottom surfaces. The peripheral portions of the portions at which the base member 14 is joined to the stem pins 6 thus become the bottom surfaces of recesses 5*a* formed in the stem 5 so that the base member 14 is joined to the stem pins 6 at gradual angles (substantially right angles), and since even when a bending force acts on the stem pins 6, the stem pins 6 will contact the peripheral portions at the open sides of recesses 5*a* and this prevents further bending of the stem pins 6, cracks are prevented from being formed at both sides of the portions at which the stem pins 6 are joined to the base member 14, and airtightness and good appearance of the sealed container 8 are thus secured.

Figure 11:
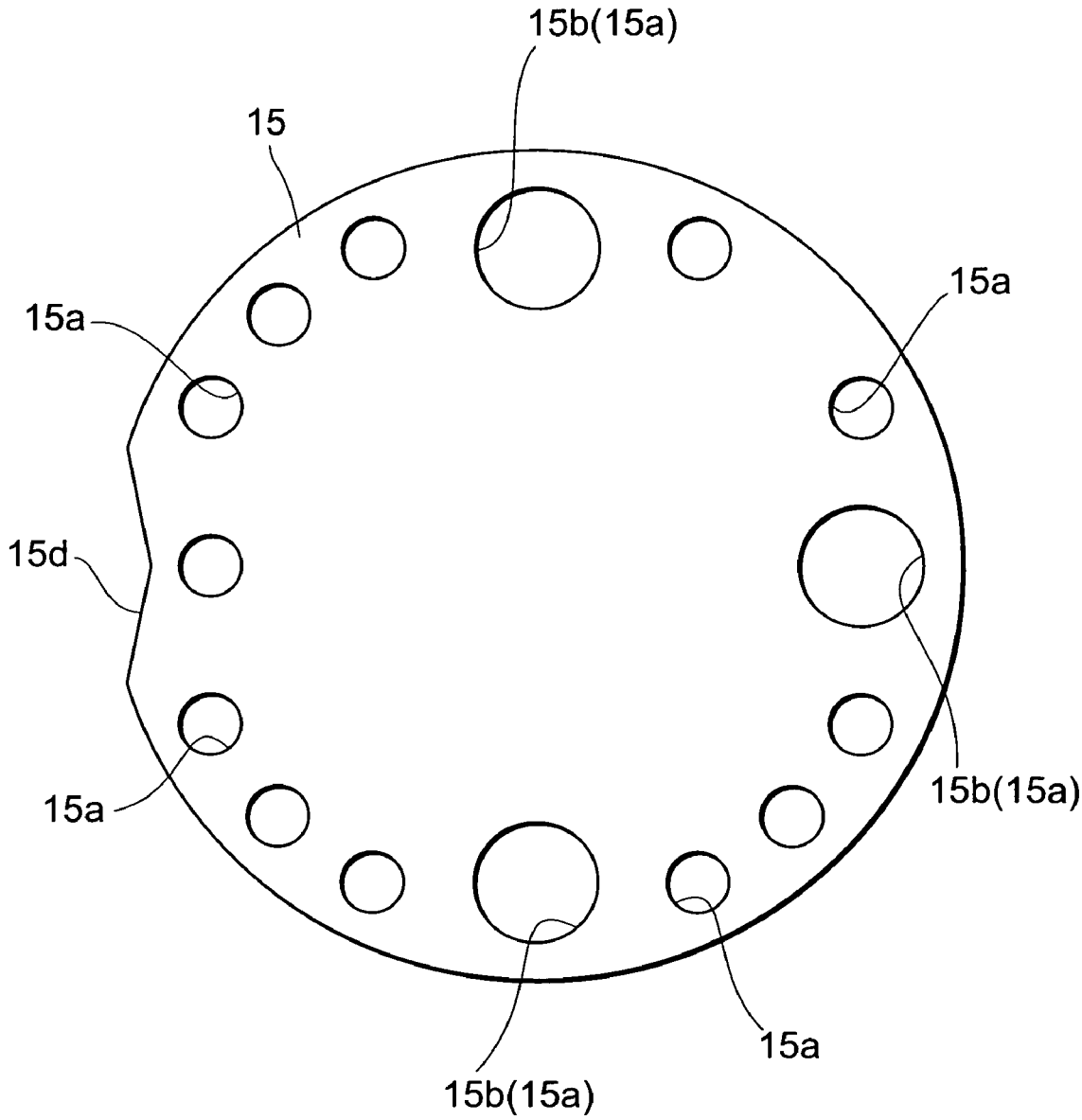
FIG. 11 is a diagram of a modification example of a chamfered shape.
Figure 12:
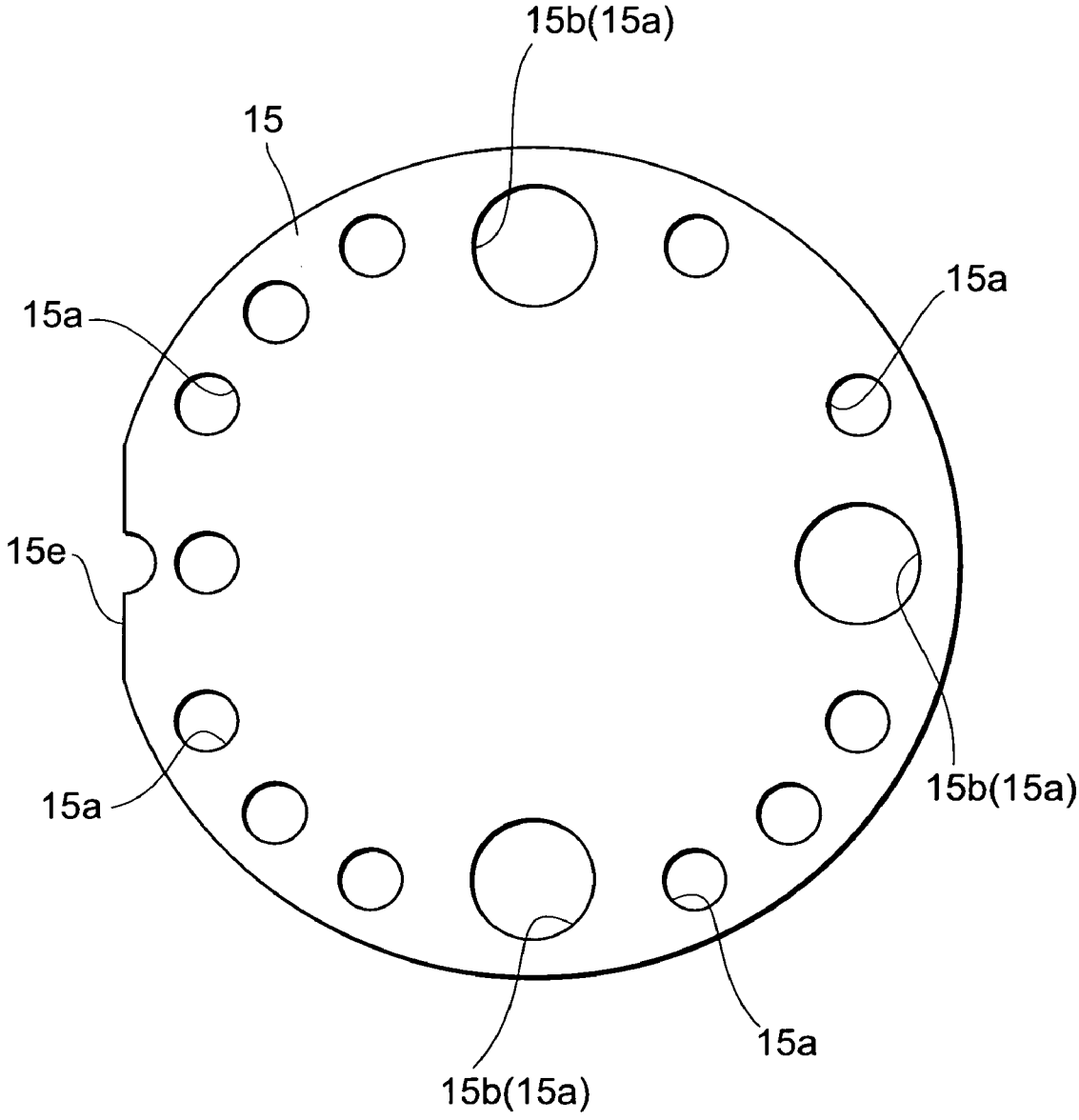
FIG. 12 is a diagram of another modification example of a chamfered shape.
Figure 13:
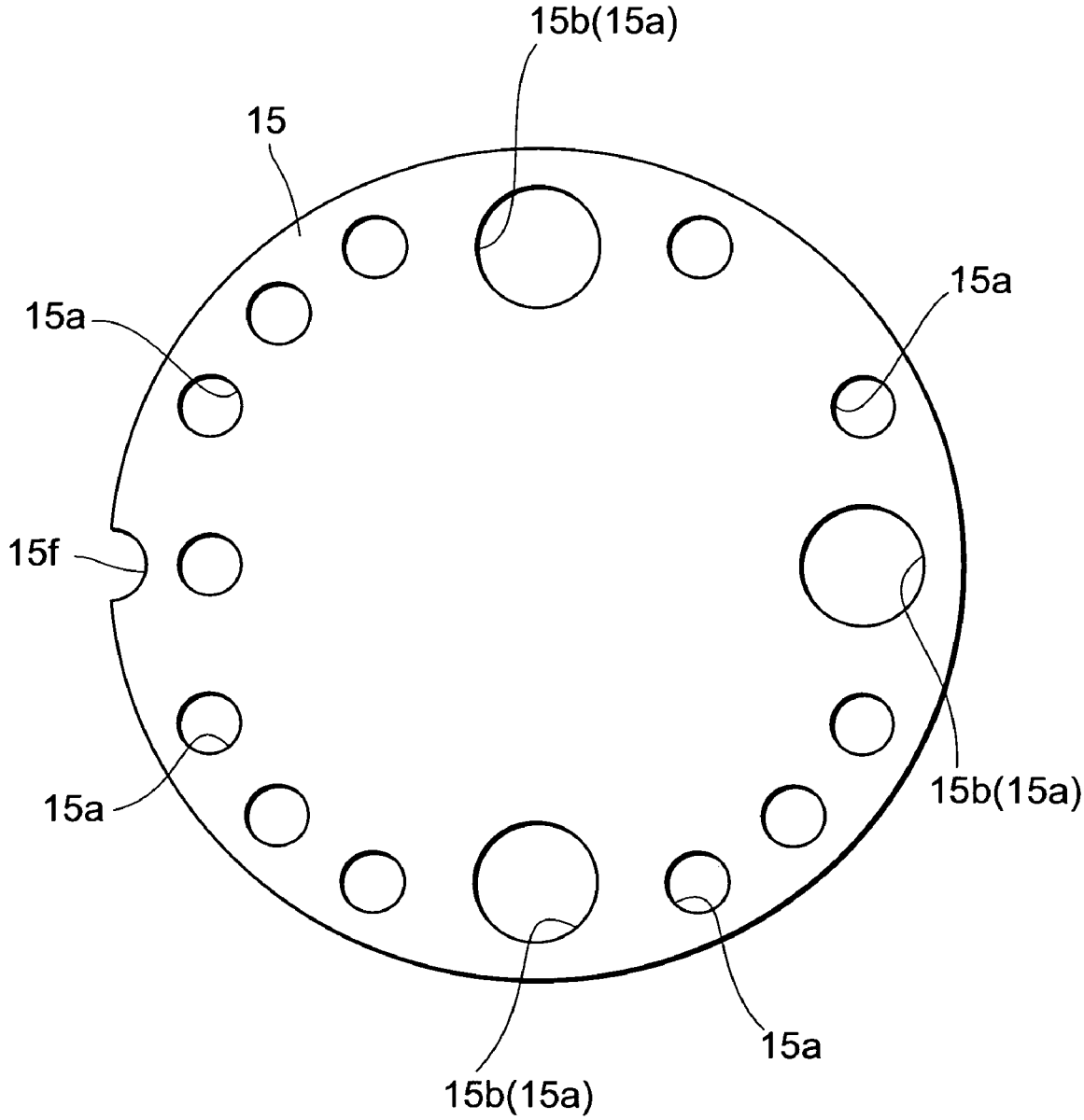
FIG. 13 is a diagram of yet another modification example of a chamfered shape.
Figure 14:
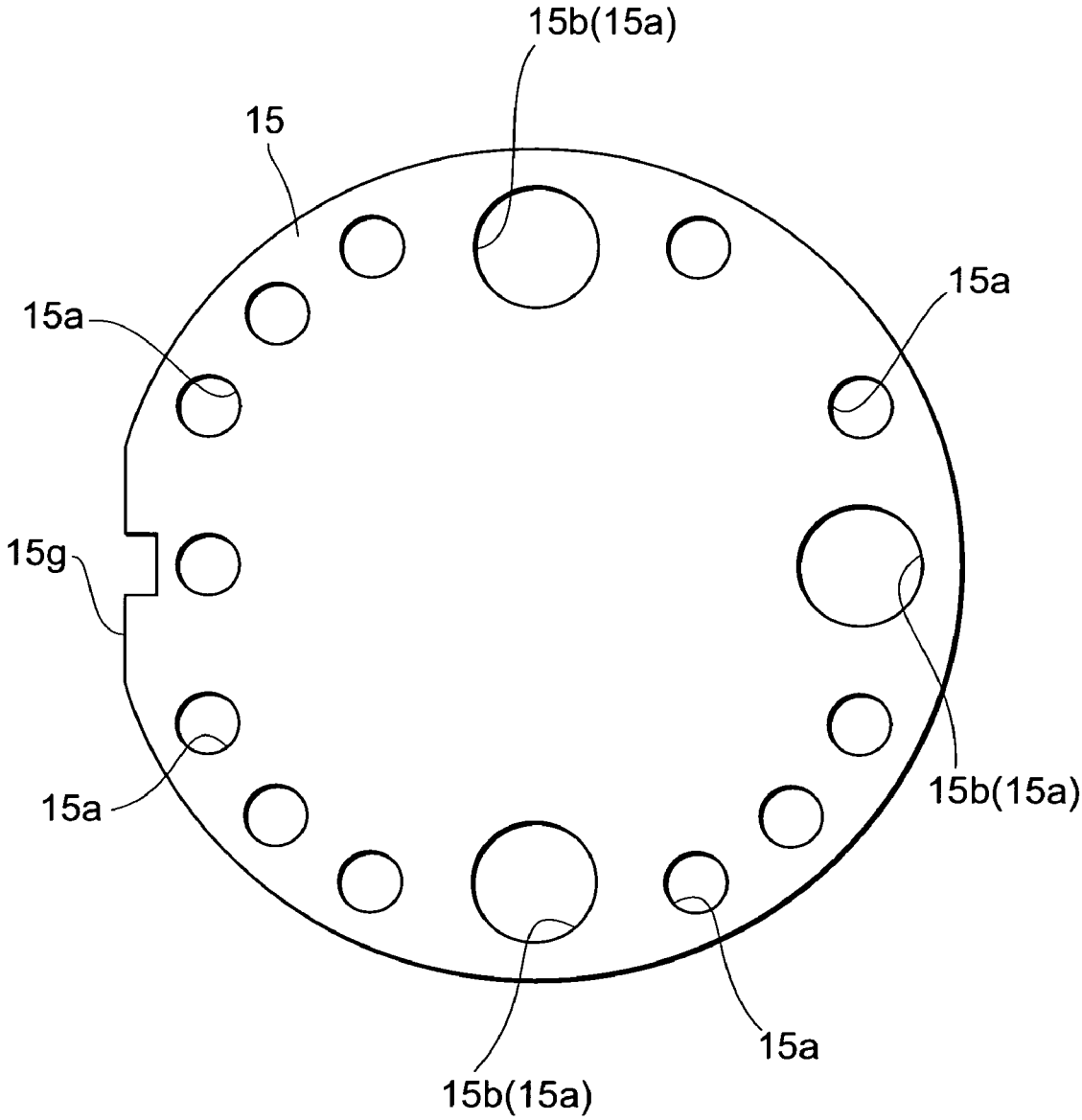
FIG. 14 is a diagram of yet another modification example of a chamfered shape.
Figure 15:
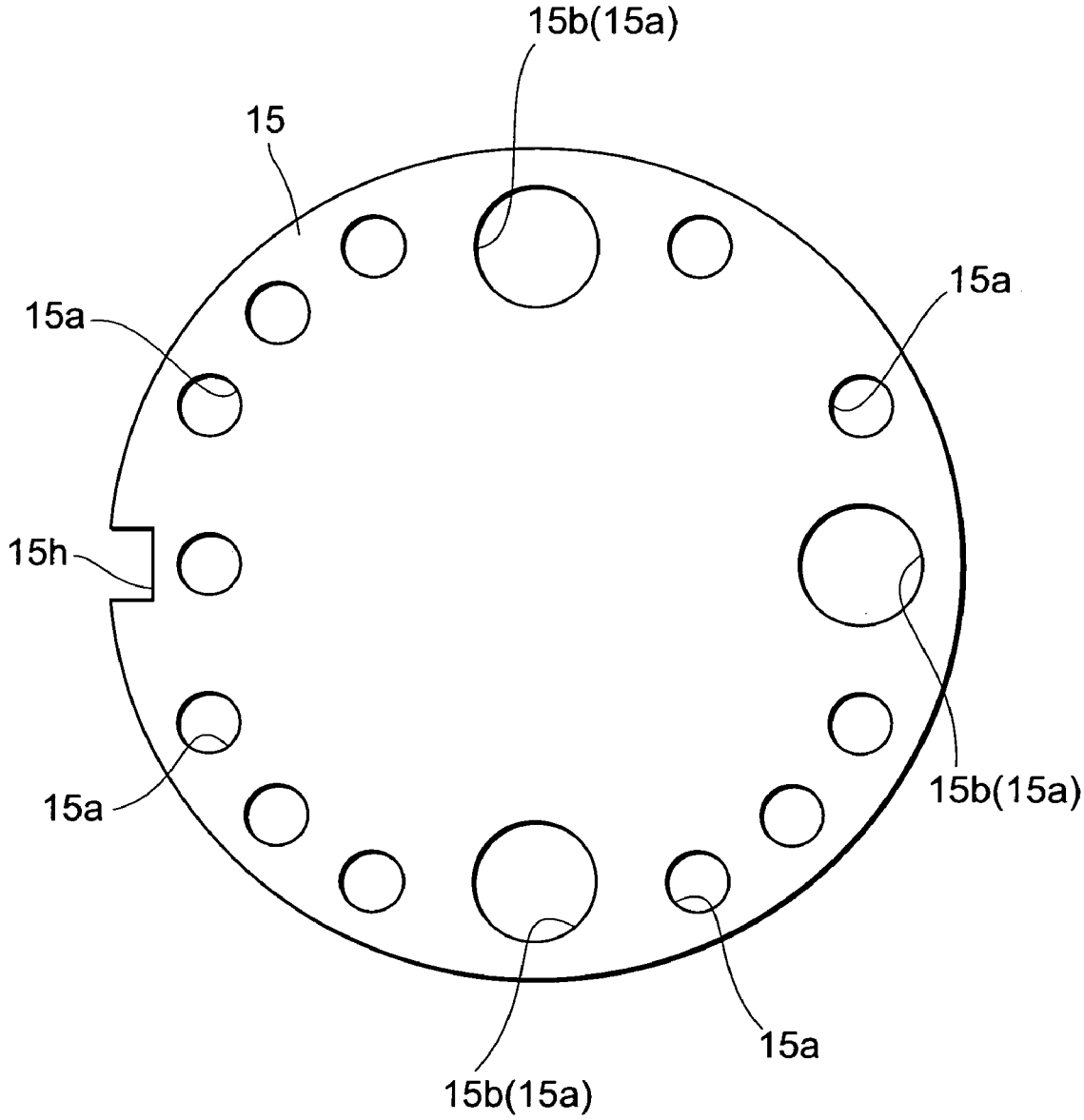
FIG. 15 is a diagram of yet another modification example of a chamfered shape.
Figure 16:
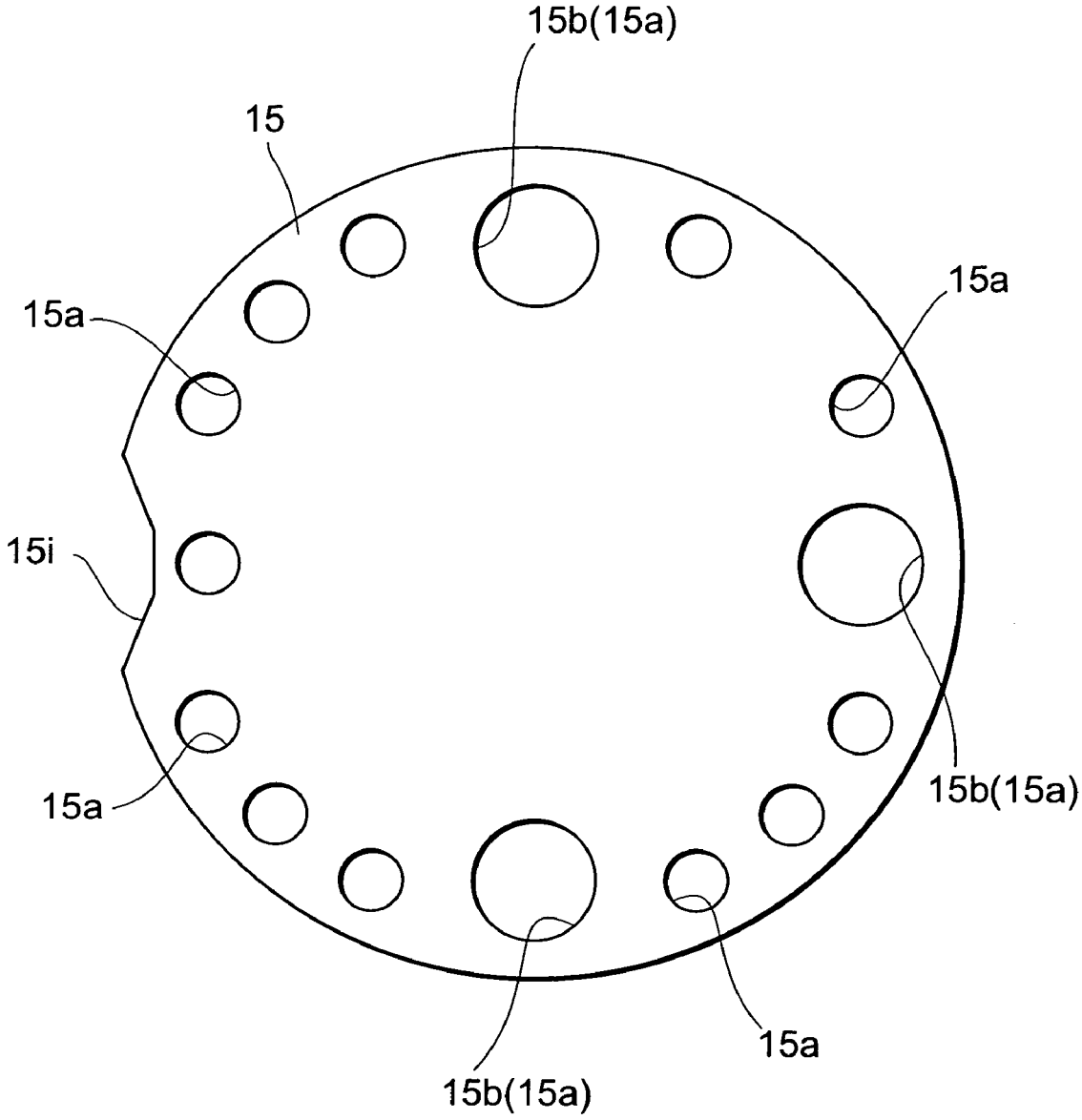
FIG. 16 is a diagram of yet another modification example of a chamfered shape.

This invention is not restricted to the above-described embodiment and, for example, the chamfered shape formed on the upper holding member 15 may be formed along the full circumference of the peripheral portion of the upper holding member 15, including the vicinity of the anode pin 13. Also, the upper holding member 15 may be arranged to have a stepped, disk-like shape, having a chamfered shape along the full circumference of the peripheral portion of its upper side, and various modifications may be applied. For example, in a case where a chamfered shape, which, like the chamfered shape 15*c* shown in FIG. 15, is a perpendicular surface with respect to the end faces (upper and lower surfaces) of the upper holding member 15, is to be formed, a chamfered shape 15*d* of substantially V-like shape in plan view may be formed as shown in FIG. 11, or a chamfered shape 15*e*, with which, in addition to providing a rectilinear chamfered shape, the vicinity of the anode pin 13 is gouged further in the vertical direction to a semicircular shape, may be formed as shown in FIG. 12. Also, a chamfered shape 15*f*, with which just the vicinity of the anode pin 13 is gouged in the vertical direction to a semicircular shape, may be formed as shown in FIG. 13. Furthermore, a chamfered shape 15*g*, with which, in addition to providing a rectilinear chamfered shape, the vicinity of the anode pin 13 is gouged further in the vertical direction to a rectangular shape, may be formed as shown in FIG. 14, or a chamfered shape 15*h*, with which just the vicinity of the anode pin 13 is gouged in the vertical direction to a rectangular shape, may be formed as shown in FIG. 15. Also, a chamfered shape 15*i*, with which, in addition to providing a V-like chamfered shape, the vicinity of the anode pin 13 is made rectilinear, may be formed as shown in FIG. 16.

Figure 17:
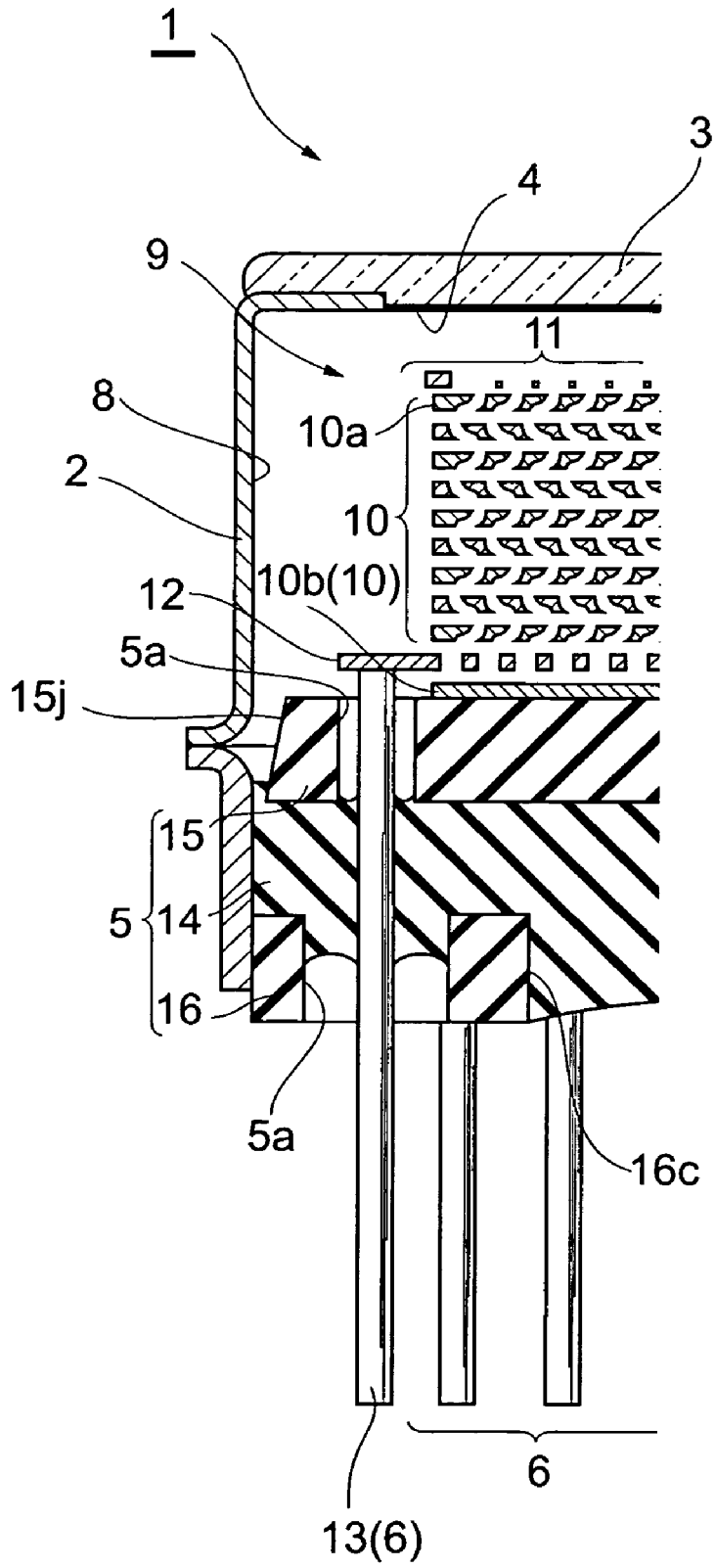
FIG. 17 is a diagram of yet another modification example of a chamfered shape.
Figure 18:
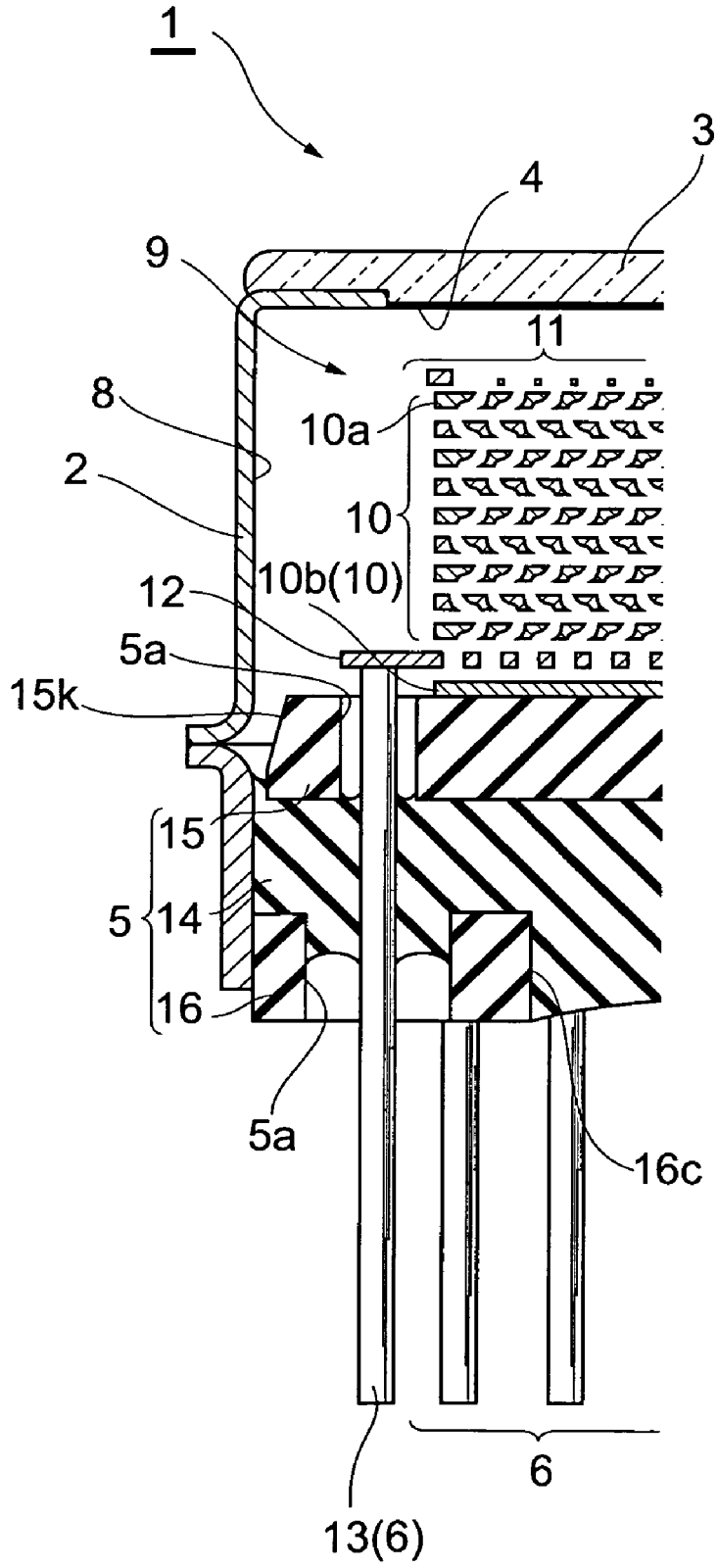
FIG. 18 is a diagram of yet another modification example of a chamfered shape.
Figure 19:
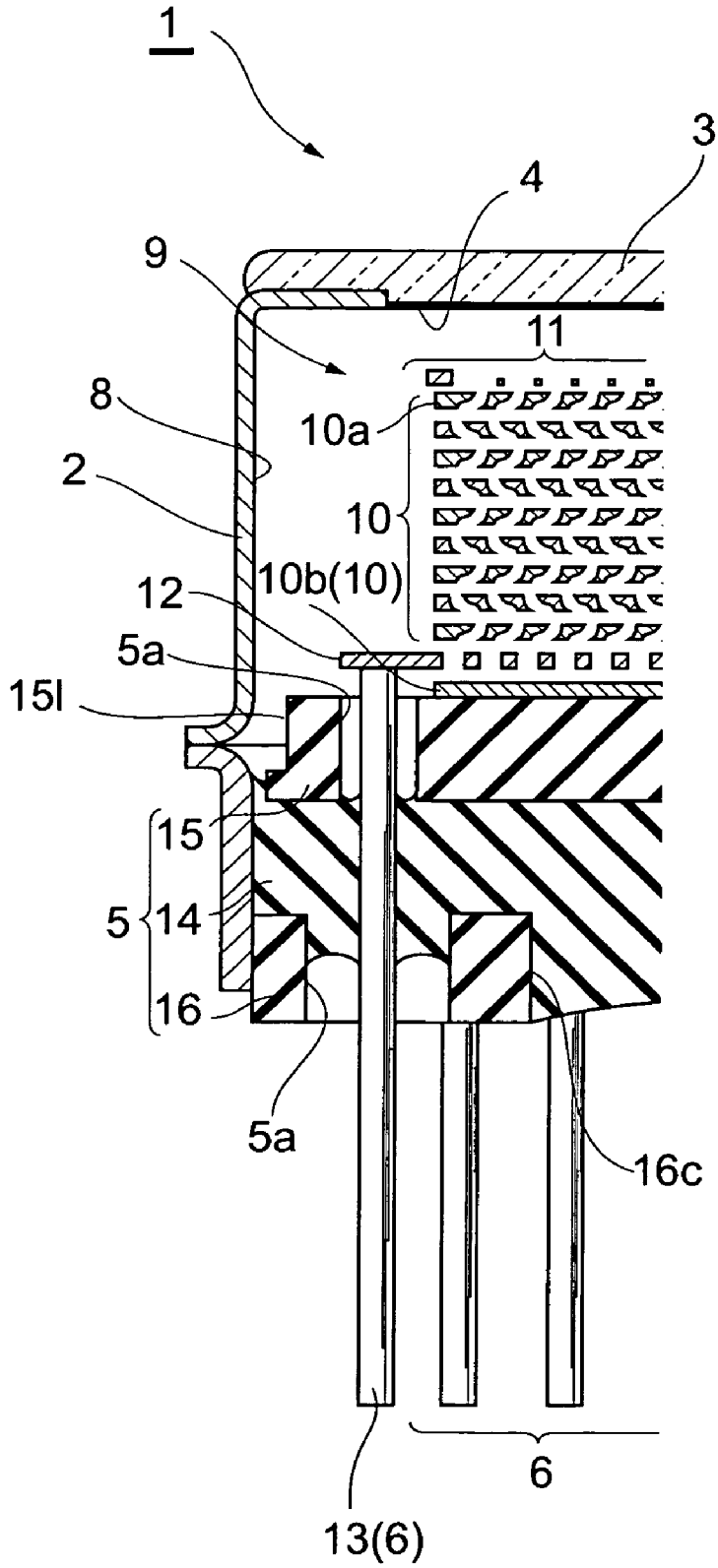
FIG. 19 is a diagram of yet another modification example of a chamfered shape.
Figure 20:
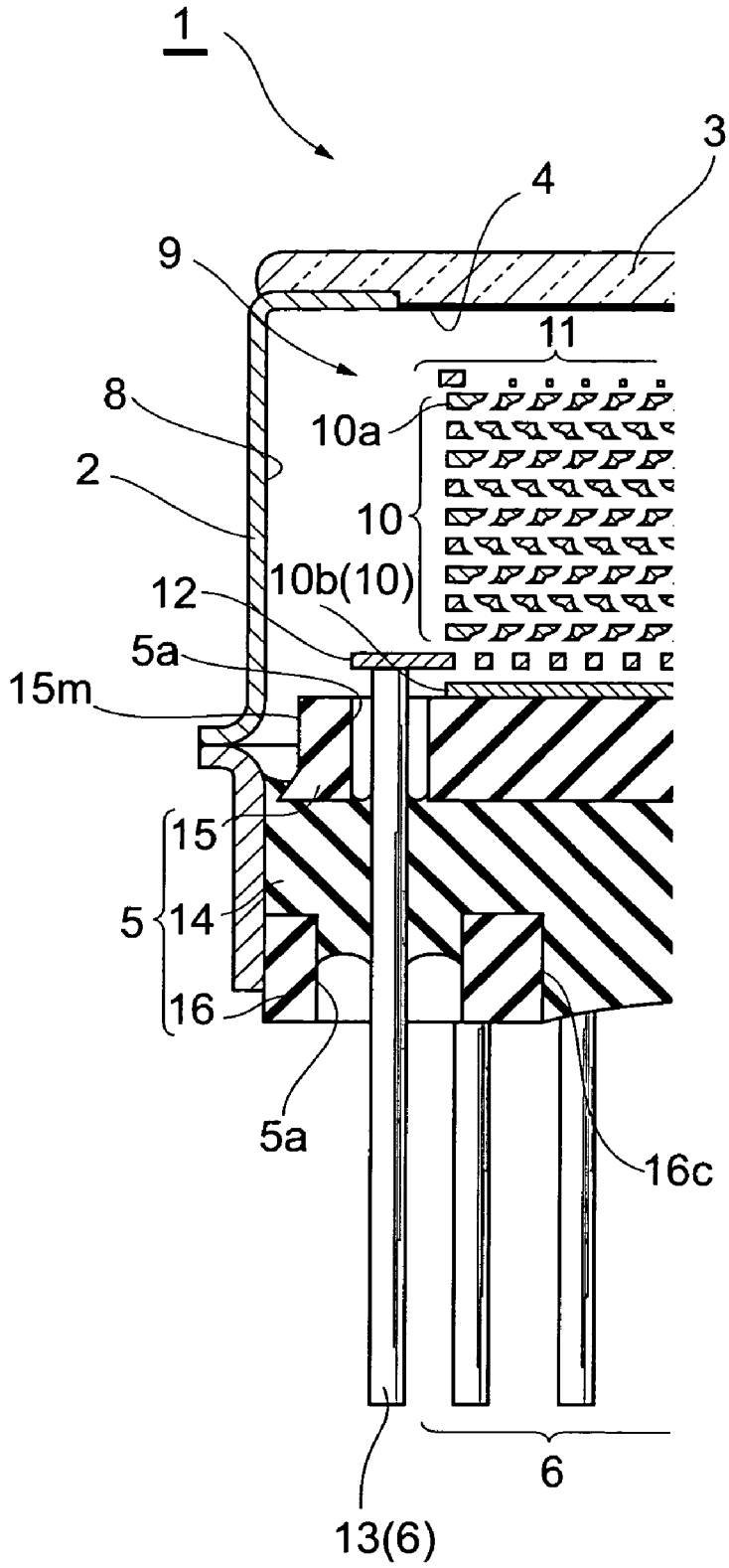
FIG. 20 is a diagram of yet another modification example of a chamfered shape.
Figure 21:
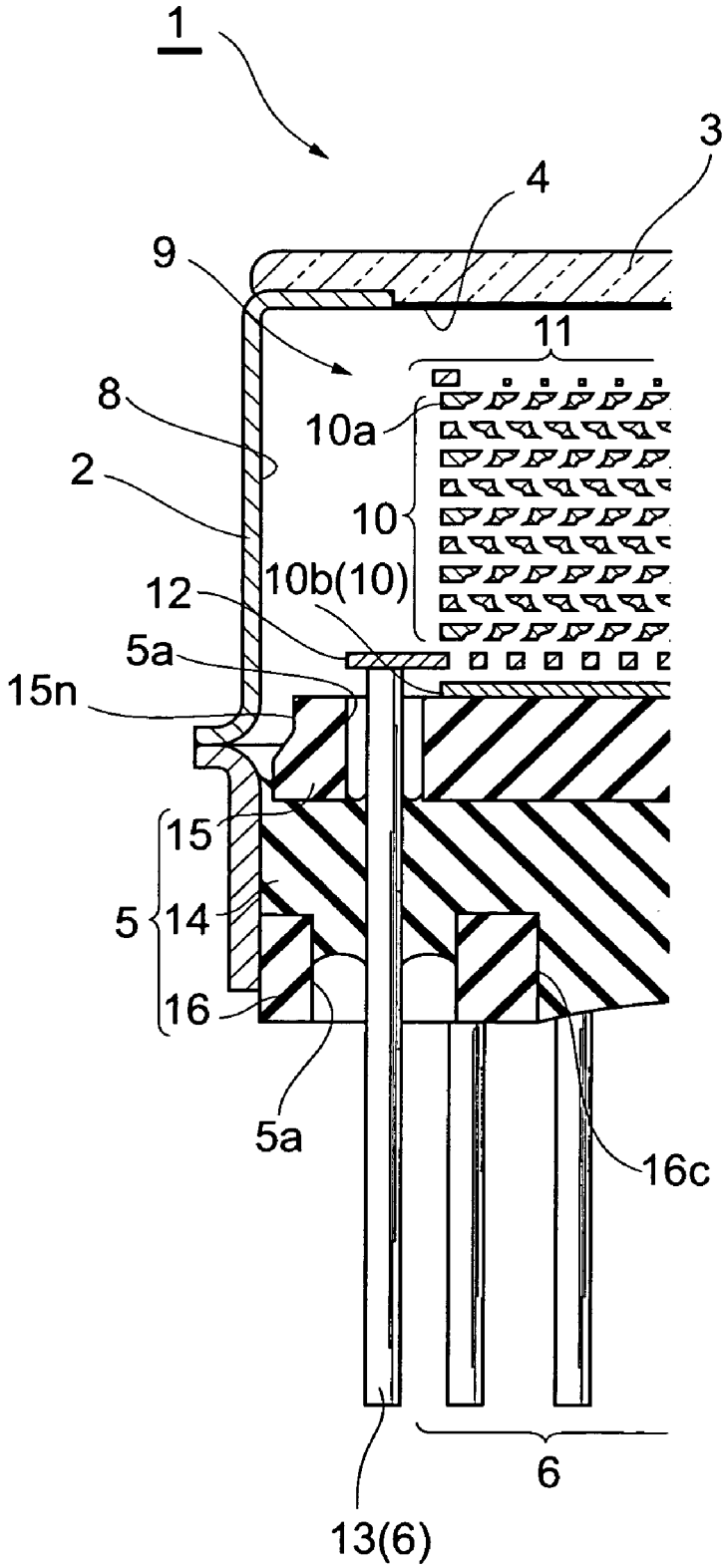
FIG. 21 is a diagram of yet another modification example of a chamfered shape.
Figure 22:
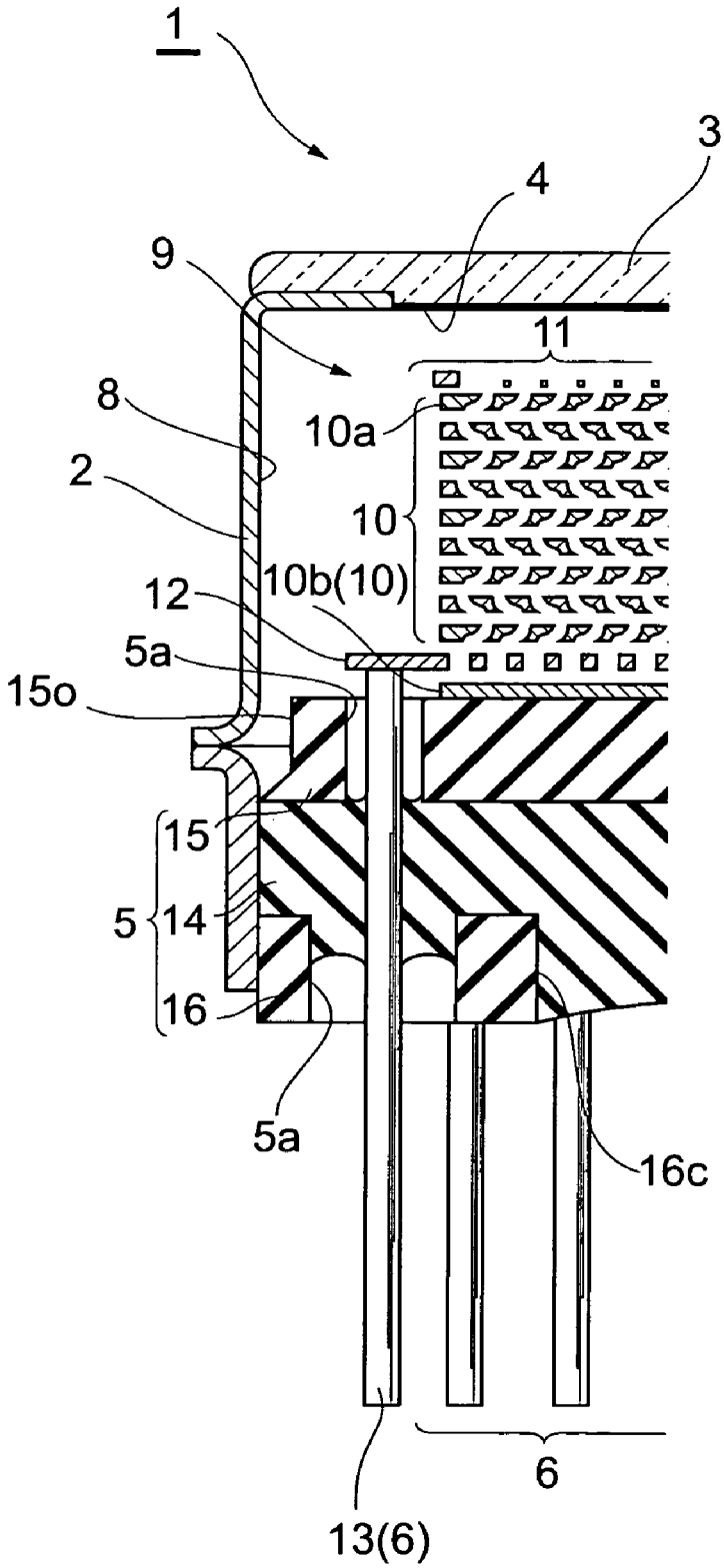
FIG. 22 is a diagram of yet another modification example of a chamfered shape.
Figure 23:
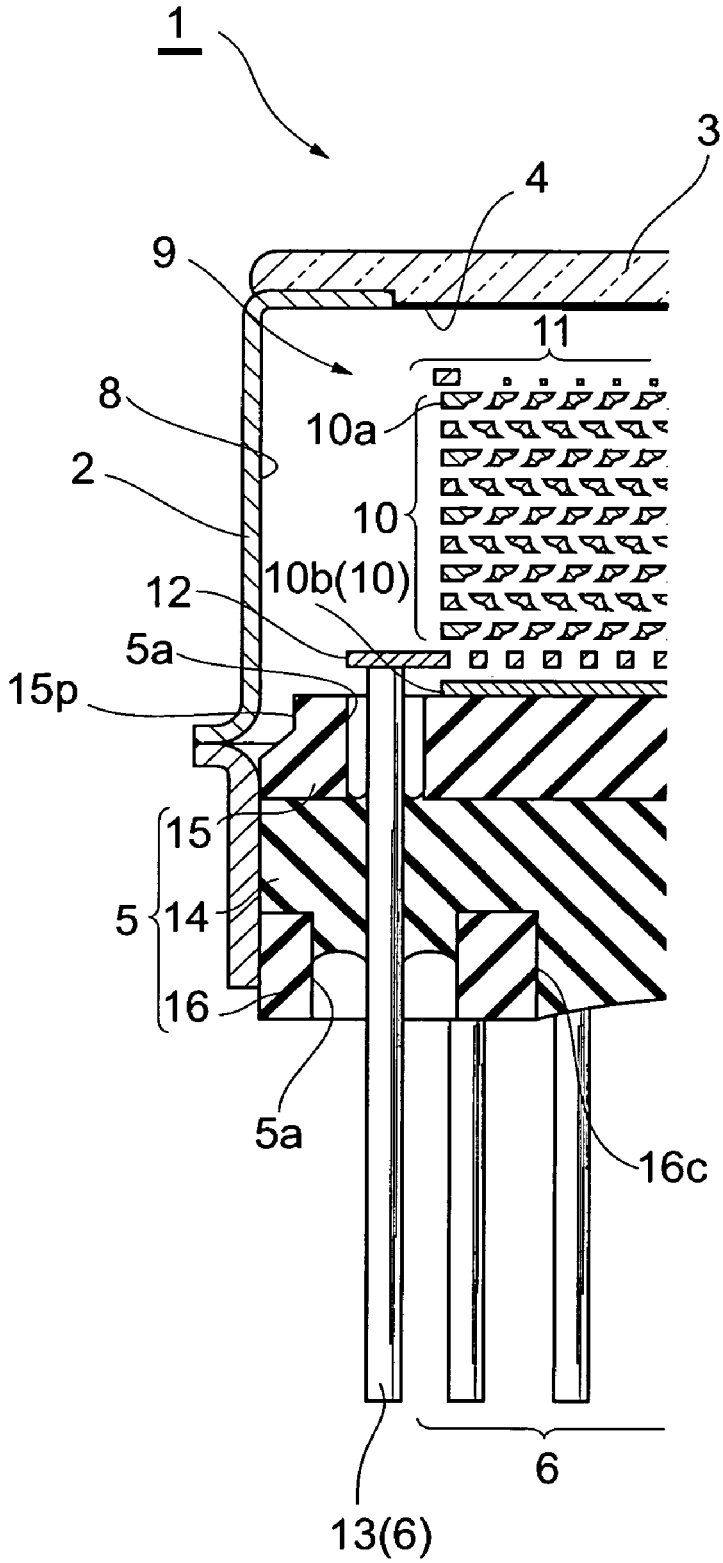
FIG. 23 is a diagram of yet another modification example of a chamfered shape.

Also, the chamfered shape does not necessarily have to be a surface that is perpendicular to the end faces of the upper holding member 15, and a chamfered shape 15*j*, which is an inclined surface with respect to the end faces of the upper holding member 15, may be formed as shown in FIG. 17, a chamfered shape 15*k*, with which just an upper portion is an inclined surface, may be formed as shown in FIG. 18, or a chamfered shape 15*l*, with which just the lower side has a large step-like form, may be formed as shown in FIG. 19. Furthermore, a chamfered shape 15*m*, with which just a lower portion is an inclined surface, may be formed as shown in FIG. 20 or a chamfered shape 15*n*, with which just an intermediate portion is an inclined surface, may be formed as shown in FIG. 21. Furthermore as respective modification examples of the chamfered shapes 15*m* and 15*n*, a chamfered shape 15*o* and a chamfered shape 15*p*, with each of which the lower surface side of the upper holding member 15 is made to contact the ring-like side tube 7, may be formed as shown in FIG. 22 and FIG. 23. With any of the modification examples shown in FIG. 11 to FIG. 23, the creeping distance at the vicinity of the anode pin 13 can be elongated and the mixing of noise into the electrical signal taken out from the anode pin 13 can be prevented.

Also for example, other layers may be provided further on the upper surface of the upper holding member 15 to make the entirety of the stem 5 four layers or more and the electron multiplier unit 9 may be installed on the upper surface of such another layer, and in the case where each of these other layers is provided with openings through which the stem pins 6, joined to the base member 14, are inserted, a chamfered shape, such as that described above, is formed at least at the vicinity of the anode pin 13 of each of these other layers. A peripheral portion near the anode pin 13 of each layer that faces the interior of the sealed container is thus made to have a chamfered shape. Also in such a case where each of the other layers are provided with a plurality of openings for insertion of the stem pins 6, at least two of these openings are preferably made larger in diameter than the other openings in order to enable the entry of positioning jigs 18 into the base member 14.

Also, although with the above-described embodiment, the base member seep opening 16*c* is provided only in the lower holding member 16, it is sufficient that such a base member seep opening be provided in at least one of the holding members, and for example, a base member seep opening may be provided in just the upper holding member 15 or base member seep openings may be provided in both the upper holding member 15 and the lower holding member 16.

Figure 24:
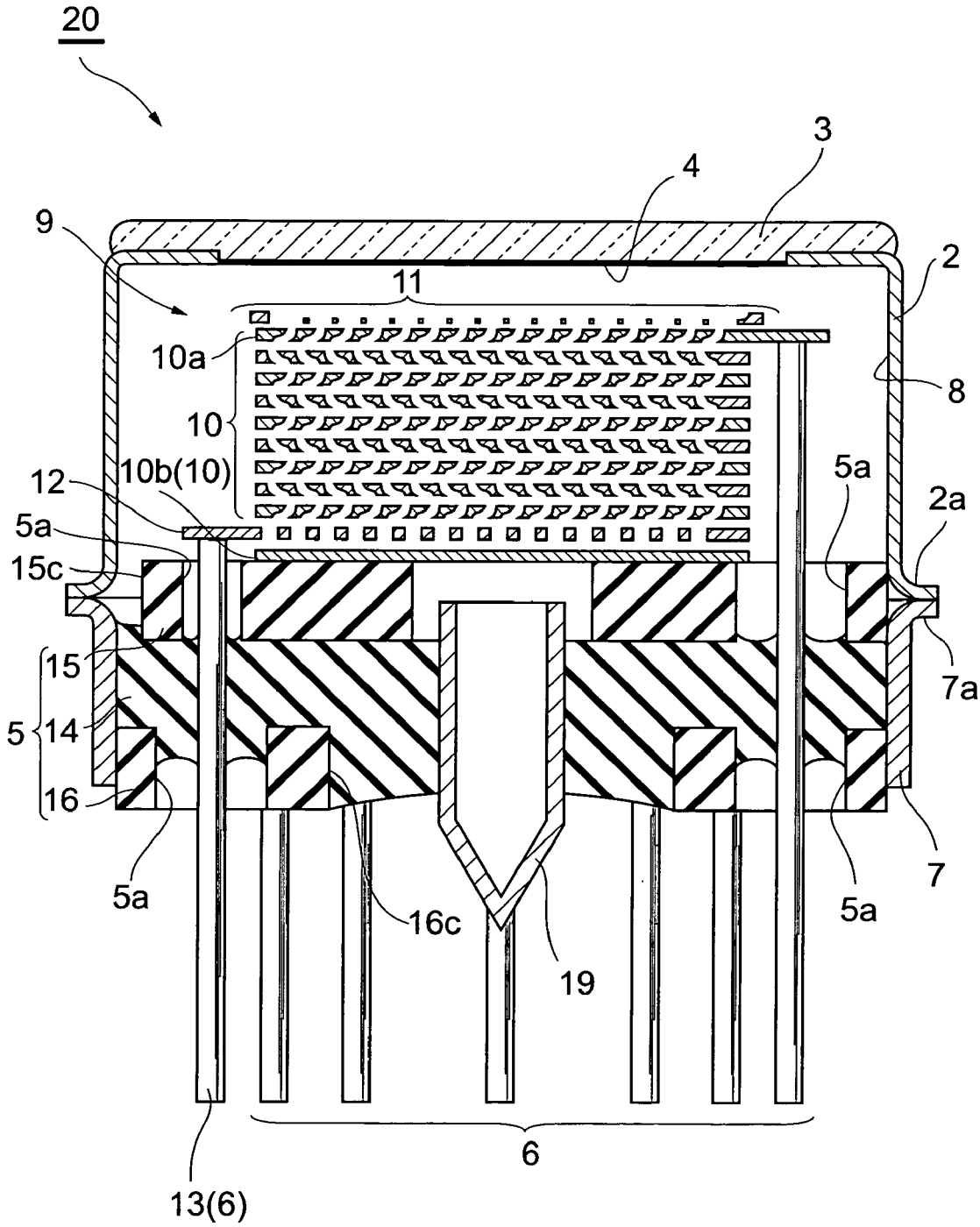
FIG. 24 is a sectional side view of a photomultiplier of a modification example.

As yet another modification example of the present embodiment, a photomultiplier tube 20, having a metal exhaust tube 19 disposed at a central portion of the stem 5 as shown in FIG. 24, may be employed. This exhaust tube 19 can be used to exhaust air by a vacuum pump (not shown), etc., and put the interior of the sealed container 8 into a vacuum state after completion of assembly of the photomultiplier 20.

Figure 25:
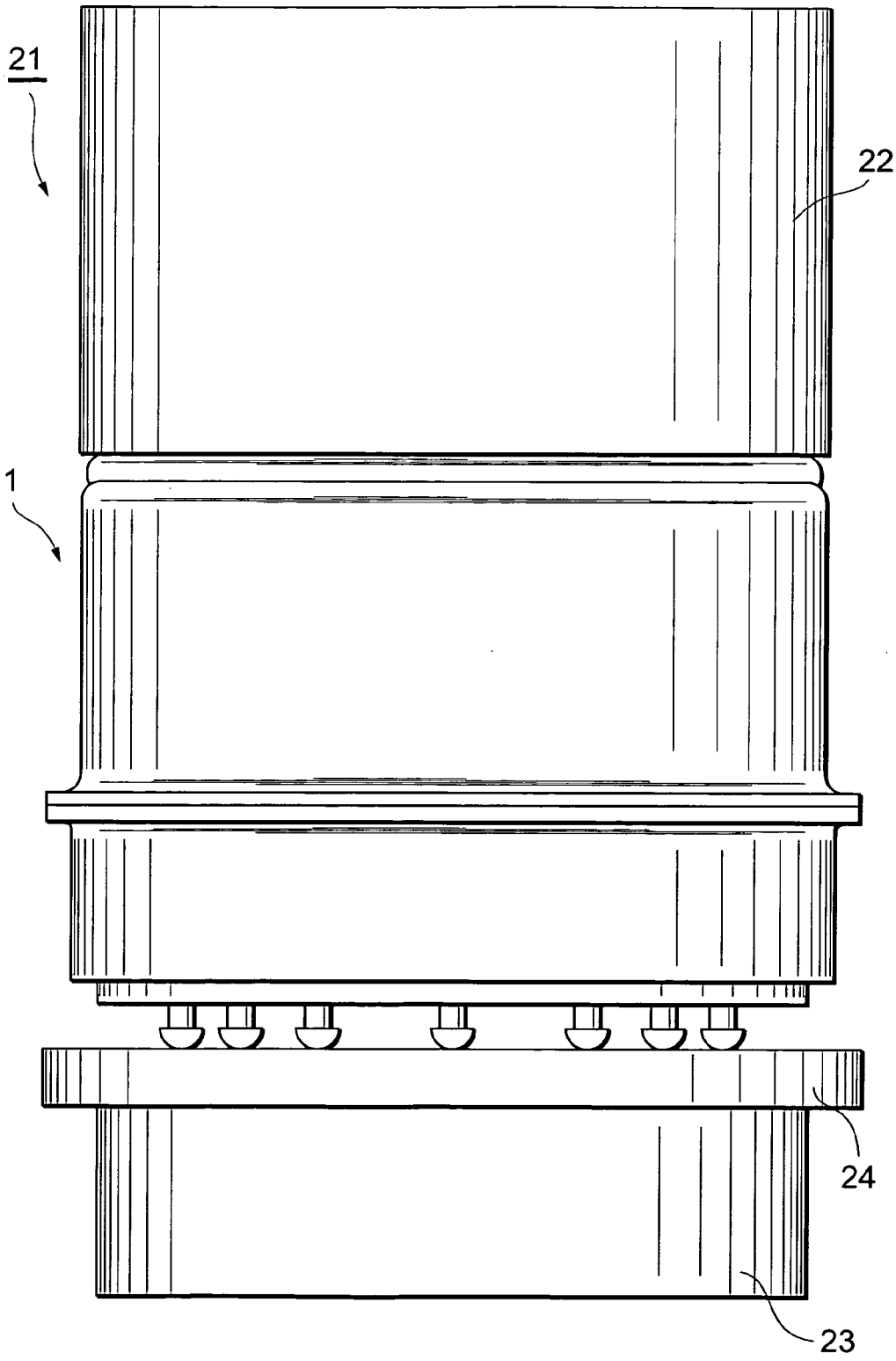
FIG. 25 is a side view of an example of a radiation detector.
Figure 26:
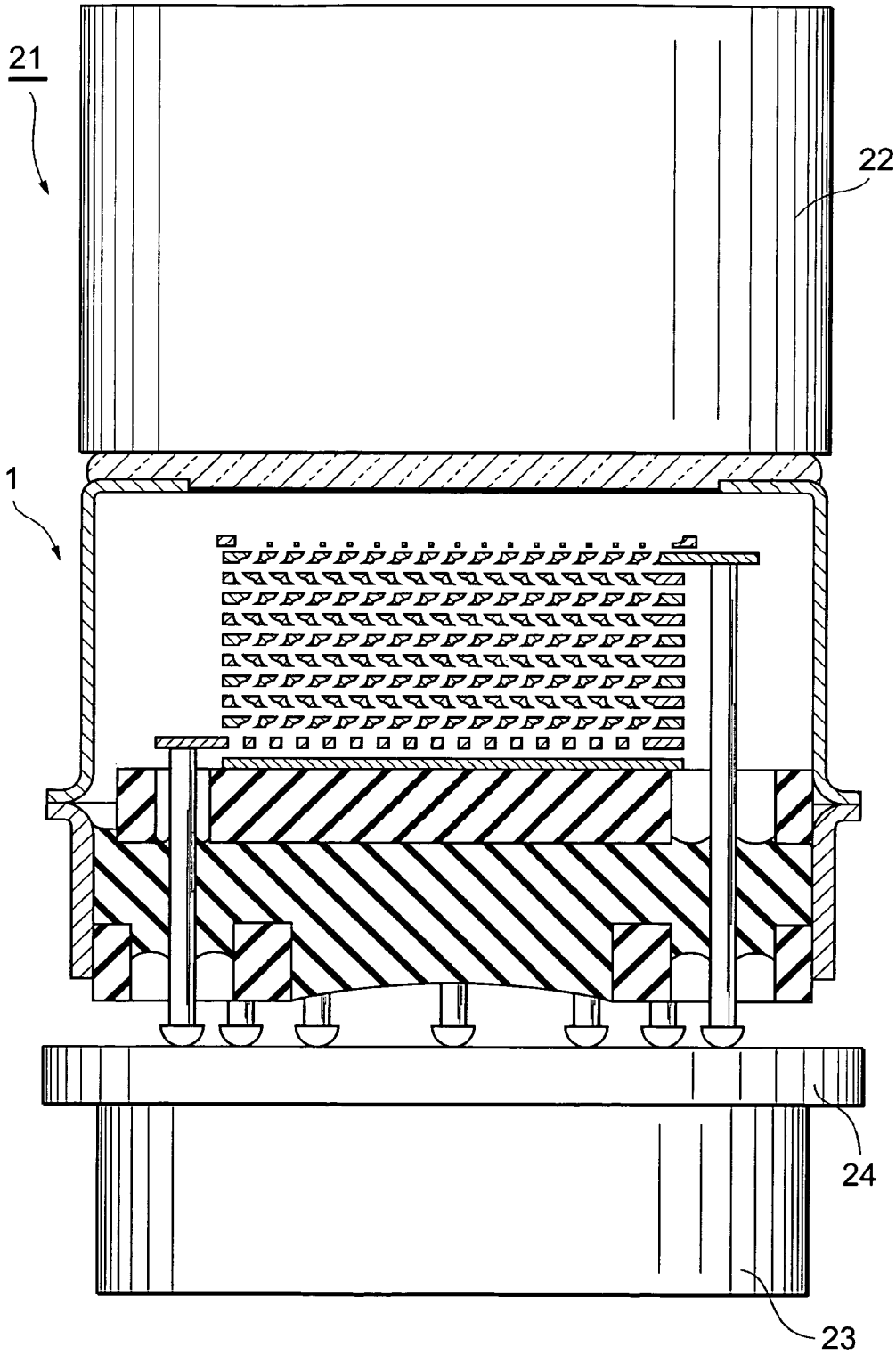
FIG. 26 is a sectional view of the principal portions of the radiation detector shown in FIG. 25.
Figure 27:
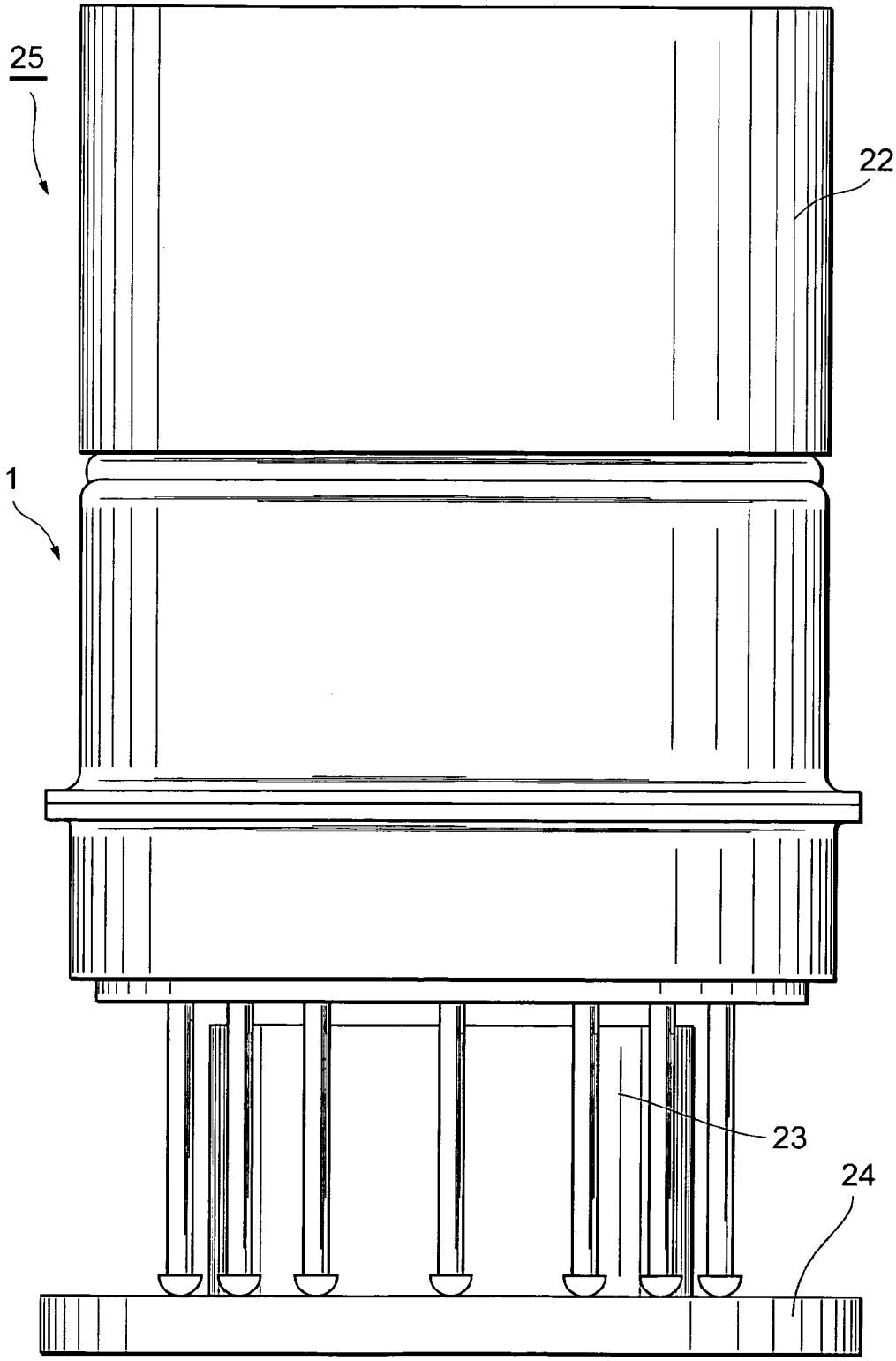
FIG. 27 is a side view of another example of a radiation detector.
Figure 28:
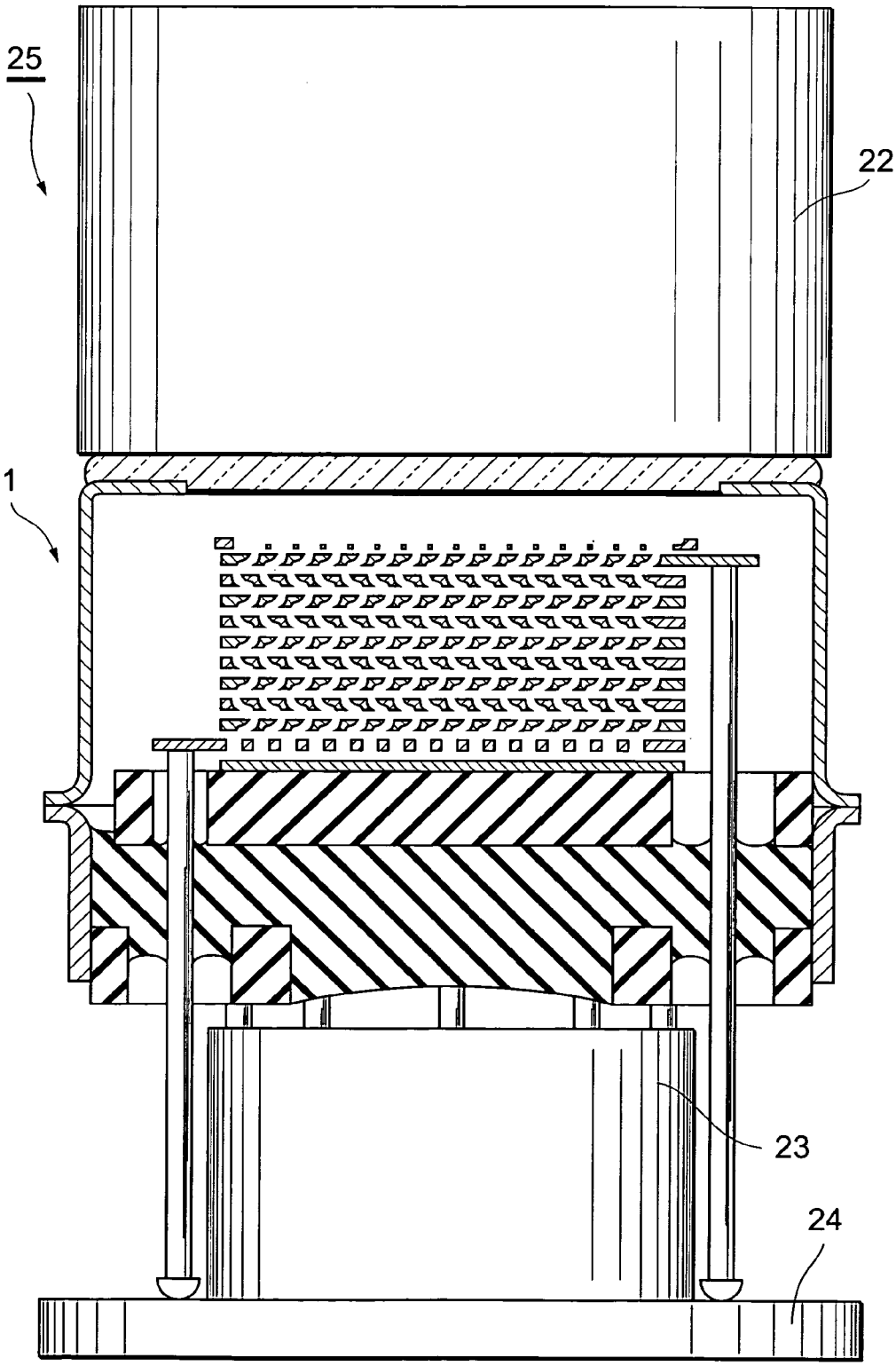
FIG. 28 is a sectional view of the principal portions of the radiation detector shown in FIG. 27.

Examples of radiation detectors equipped with the photomultiplier 1 shown in FIG. 1 to FIG. 3 shall now be described. With a radiation detector 21 of the example shown in FIG. 25 and FIG. 26, a scintillator 22, which converts radiation into light and emits the light, is installed at the outer side of the light receiving plate 3 of the photomultiplier 1 and the photomultiplier 1 is mounted onto a circuit board 24, having a processing circuit at the lower surface side. With a radiation detector 25 of another example shown in FIG. 27 and FIG. 28, processing circuit 23 is installed above circuit board 24 and the photomultiplier 1 is mounted onto circuit board 24 in a manner such that the stem pins 6 surround processing circuit 23. By these arrangements, the radiation detectors 21 and 25, which exhibit the above-described actions and effects and are especially suitable for surface mounting, can be provided.

[Second Embodiment]

Figure 29:
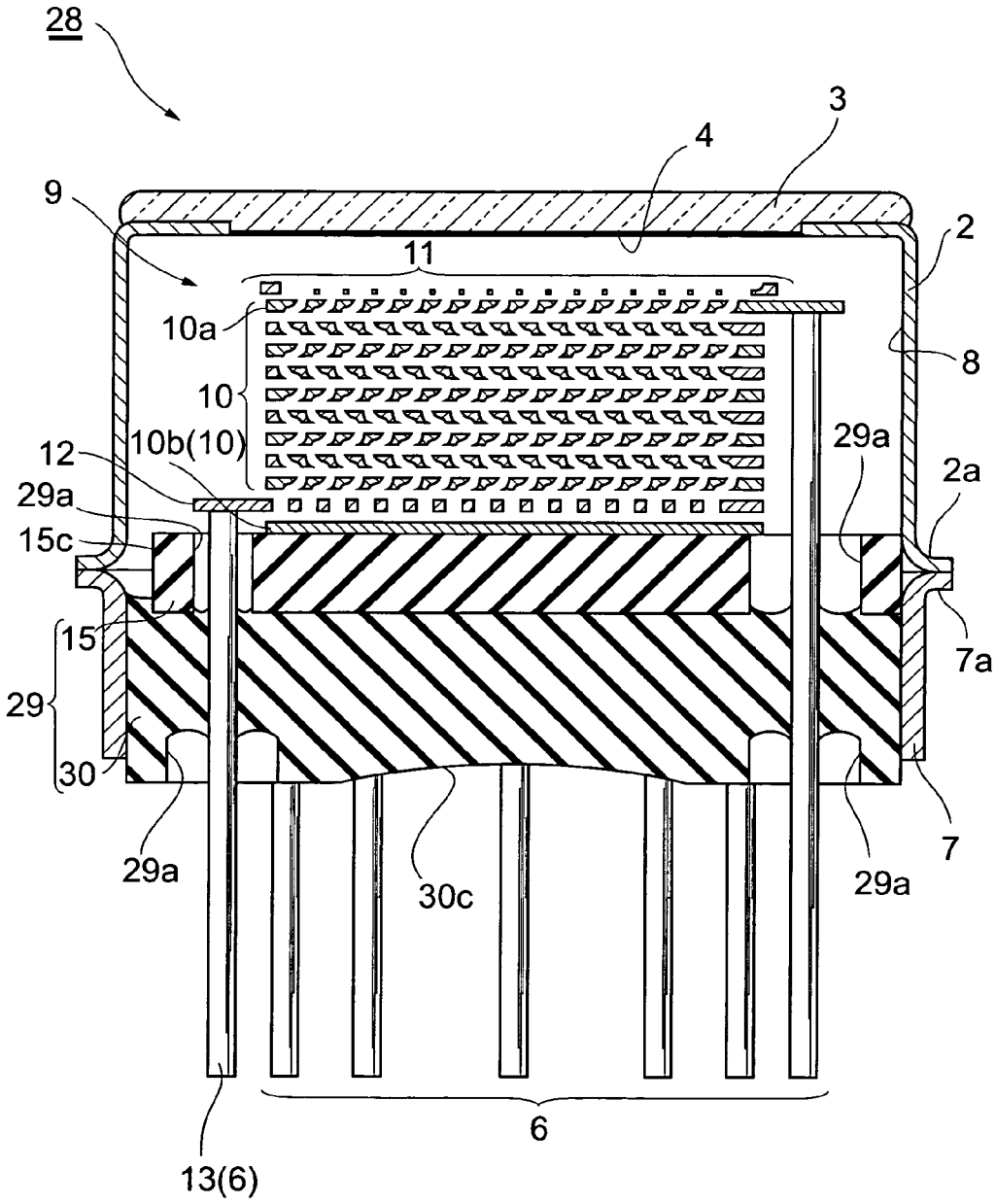
FIG. 29 is a sectional side view of a photomultiplier of a second embodiment of this invention.

As shown in FIG. 29, the photomultiplier 28 of a second embodiment has a stem 29 arranged as a two-layer structure of a disk-like base member 30, of the same quality as the base member 14, and the upper holding member 15, joined to the upper side (inner side) of the base member 30, and thus differs from the photomultiplier 1 of the first embodiment, wherein the stem 5 is arranged as a three-layer structure of the base member 14, the upper holding member 15, and the lower holding member 16.

Figure 30:
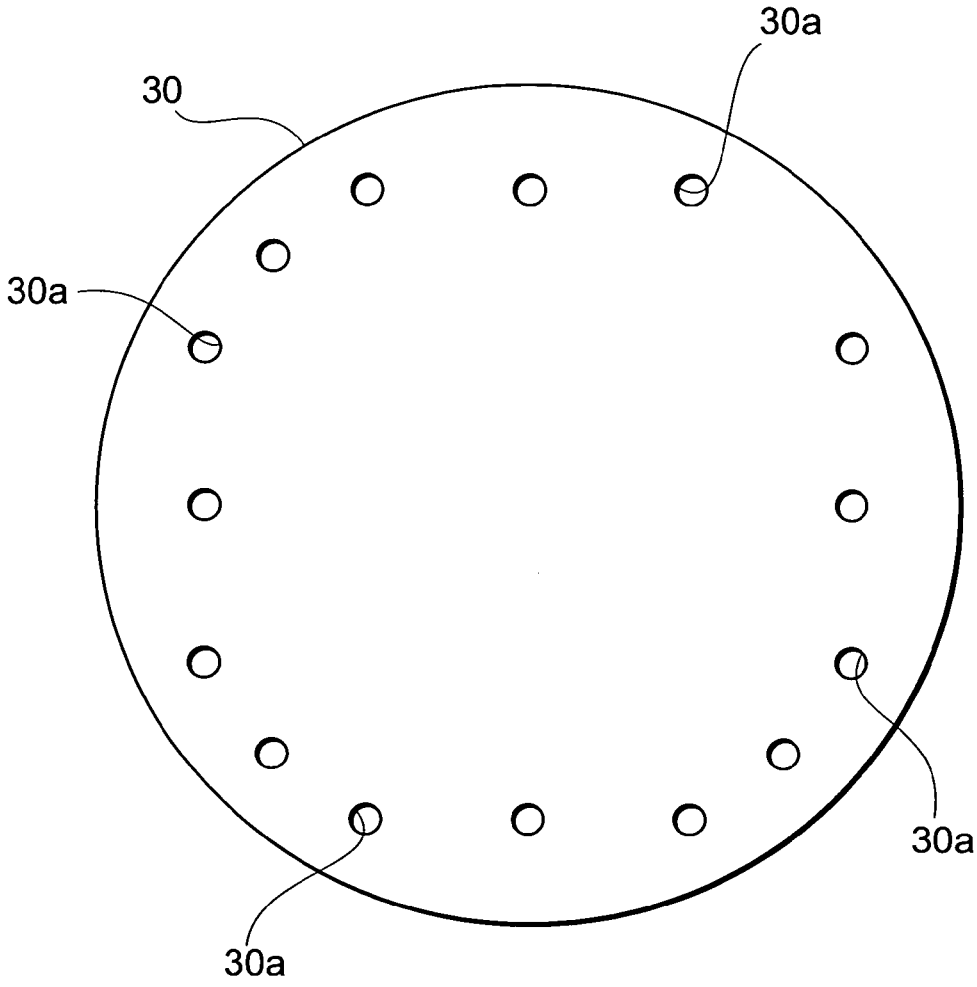
FIG. 30 is a plan view of a base member making up a stem of the second embodiment.
Figure 31:
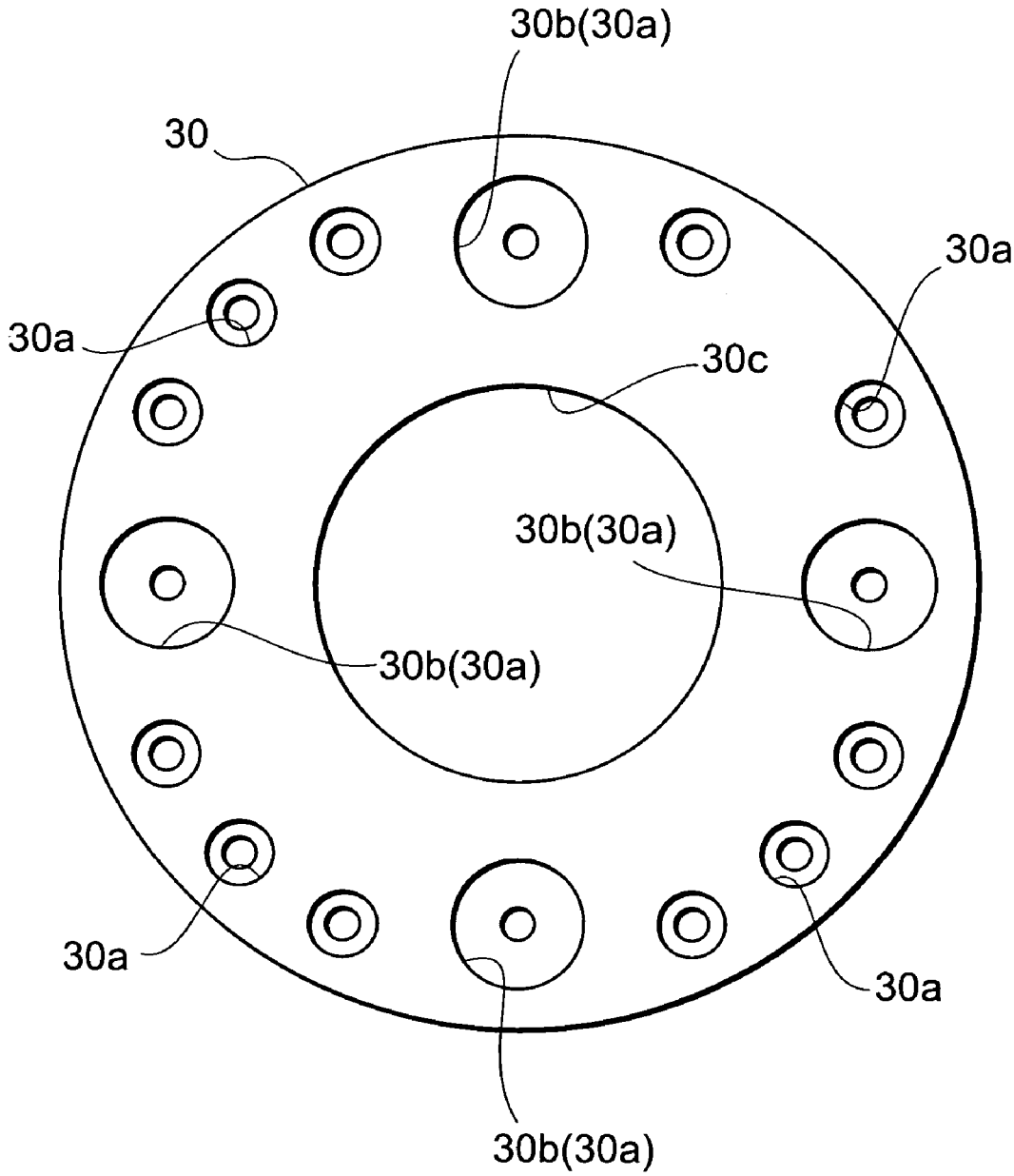
FIG. 31 is a bottom view of the base member making up the stem of the second embodiment.

That is, the stem 29 of the photomultiplier 28 is not provided with the lower holding member 16, and the base member 30 has, along outer peripheral portions of the base member 30, a plurality (15) of openings 30*a*, with each of which the diameter of the upper half is made substantially equal to the outer diameter of each stem pin 6 as shown in FIG. 30 and the diameter of the lower half is made larger than the outer diameter of each stem pin 6 as shown in FIG. 31. Of the openings 30*a* of the base member 30, those of four predetermined locations, including the opening 30*a* through which the anode pin 13 passes, are arranged as the large-diameter openings 30*b*, with each of which the outer diameter of the lower half is made larger than the outer diameter of the lower half of each of the other openings 30*a* in order to enable the entry of positioning jig 18. Furthermore, a circular base member seep recess 30*c* (see FIG. 32), serving as a base member seep portion into which the base member 30 seeps upon melting, is formed at a central portion of the lower portion of the base member 30.

As shown in FIG. 29, the base member 30 and the upper holding member 15 are overlapped in a state, in which the axial center positions of the respective openings 30*a* and 15*a* and the large-diameter openings 30*b* and 15*b* are matched, and are joined by fusing by the melting of the base member 30 in the state in which the stem pins 6 are inserted through the respective openings 30*a* and 15*a* and the large-diameter openings 30*b* and 15*b*. More specifically, the upper holding member 15 is joined in close contact with the upper surface of the base member 30, the respective stem pins 6 are inserted through the lower halves of the respective openings 30*a* of the base member 30 and the respective openings 15*a* of the upper holding member 15 so that recesses 29*a*, having the base member 30 as the bottom surfaces, are formed along the full circumferences of the portions of both the upper (inner) surface and the lower (outer) surface of the stem 29 through which the respective stem pins 6 pass, and the respective stem pins 6 are joined in close contact with the base member 30 at the bottom surfaces of the recesses 29*a*.

Also, the stem 29 is joined to the ring-like side tube 7 upon being made to protrude out towards the side tube 2 from the upper open end face of the ring-like side tube 7, and the side tube 2 is joined to the ring-like side tube 7 by the fixing by welding of the respective flange portions 2*a* and 7*a* in the state of being directly capped onto the portion of the stem 29 that protrudes from the open end face of the ring-like side tube 7.

Figure 32:
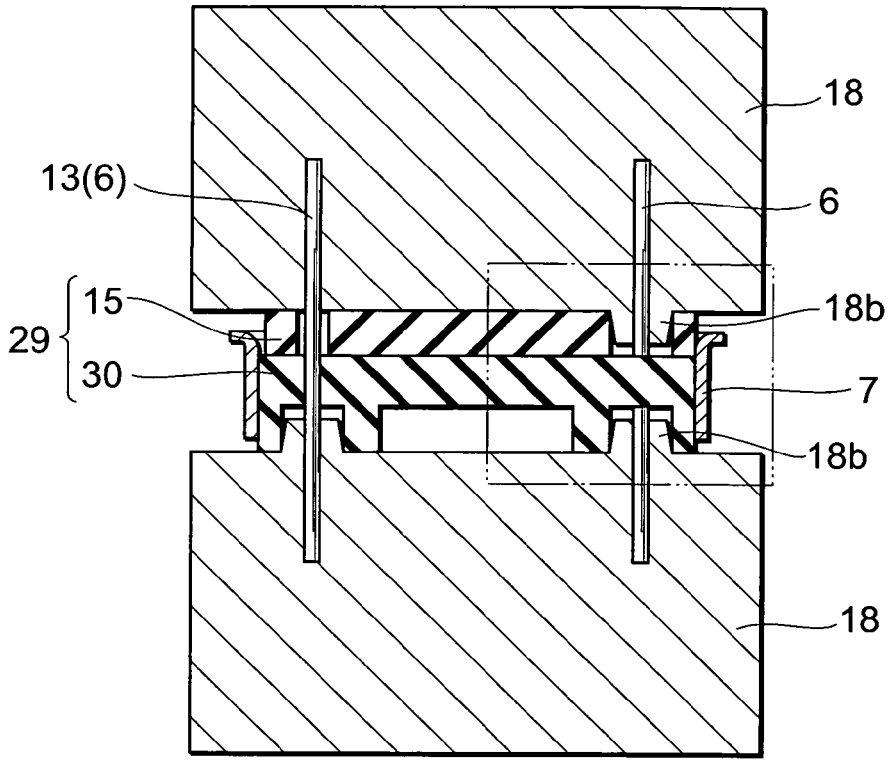
FIG. 32 shows an example of manufacturing the stem of the second embodiment, with (a) being a sectional side view and (b) being an enlarged view of the principal portions of the stem in a state prior to sintering.
Figure 32:
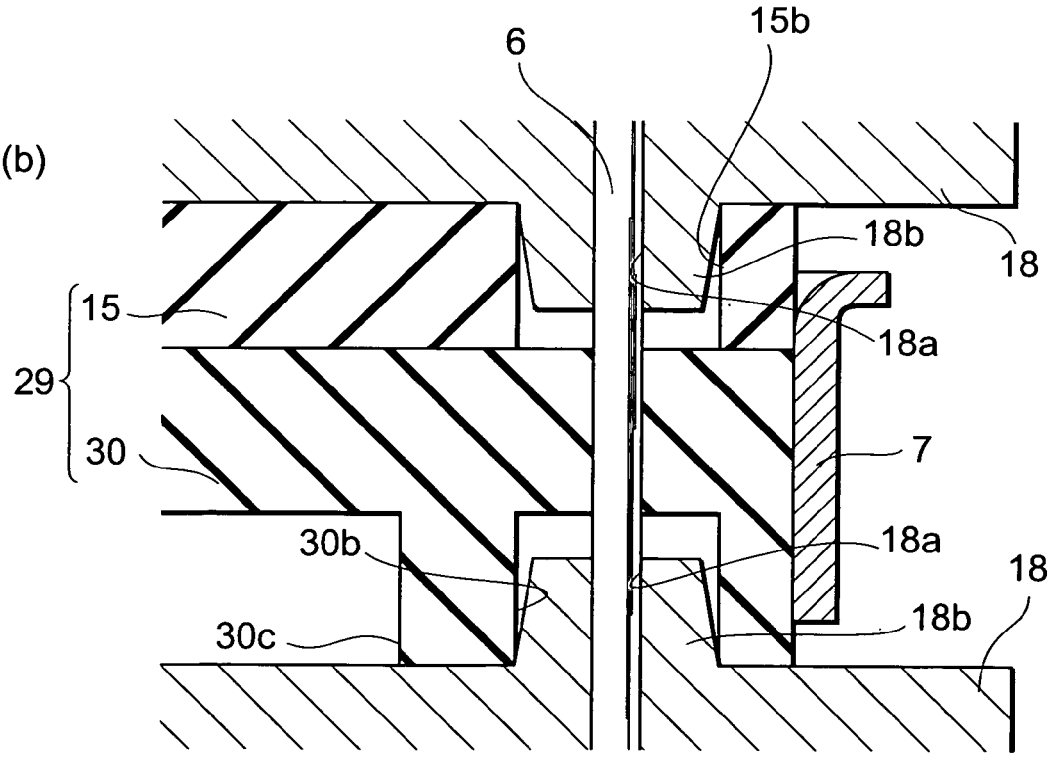

The same method as that for the stem 5 of the first embodiment can be employed to manufacture such a stem 29 as well. Specifically as shown in FIG. 32, firstly, one positioning jig 18 (the jig at the lower side of the figure) is set, with protrusions 18*b* facing upward, on a working surface (not shown) and the stem pins 6 are respectively inserted and fixed in insertion holes 18*a* of this positioning jig 18, and then the base member 30 is set on positioning jig 18 by making protrusions 18*b* of positioning jig 18 enter the large-diameter openings 30*b* while passing the respective stem pins 6, fixed to positioning jig 18, through the openings 30*a*. Furthermore, while roughly matching the axial center positions of the respective openings 15*a* and the respective the large-diameter openings 15*b* to the respective openings 30*a* and the large-diameter openings 30*b* of the base member 30, the stem pins 6 are passed through the respective openings 15*a* and the respective large-diameter openings 15*b* to overlap the upper holding member 15 onto the base member 30, and thereafter, the ring-like side tube 7 is fitted onto the base member 30 in a manner such that substantially the upper half of the upper holding member 15 protrudes out from the upper end face of the ring-like side tube 7. Lastly, the other positioning jig 18 (the jig at the upper side of the figure) is set on the upper holding member 15 by making protrusions 18*b* enter into the large-diameter openings 15*b* of the upper holding member 15 while inserting the respective stem pins 6, protruding outward from the upper holding member 15, into insertion holes 18*a*. The setting of the stem 29 is thereby completed. As with the first embodiment, the ring-like side tube 7 and the respective stem pins 6 that are set are subject to a surface oxidizing process in advance in order to heighten the property of fusion with the base member 30.

Figure 33:
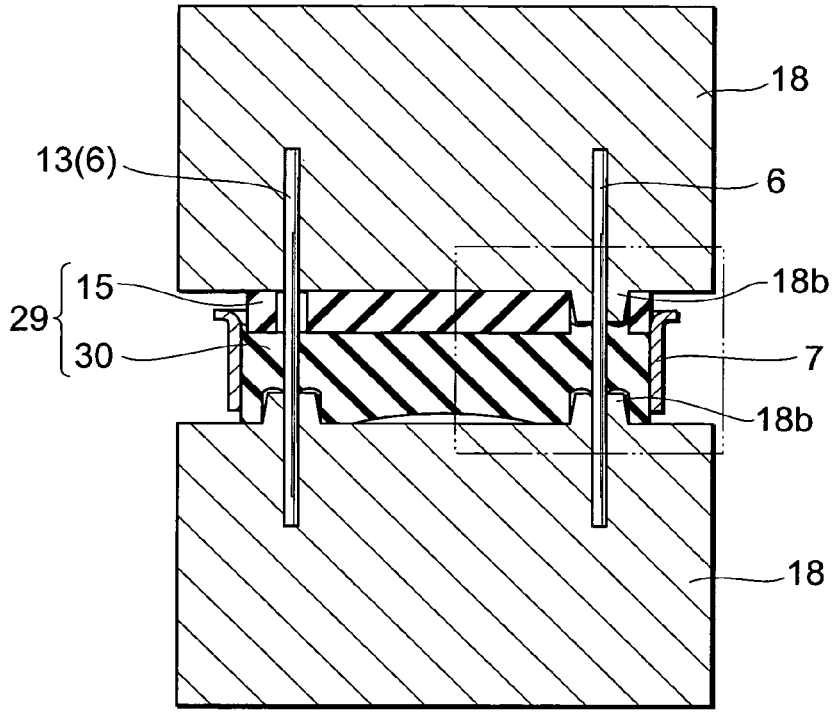
FIG. 33 shows the example of manufacturing the stem of the second embodiment, with (a) being a sectional side view and (b) being an enlarged view of the principal portions of the stem in a state after sintering.
Figure 33:
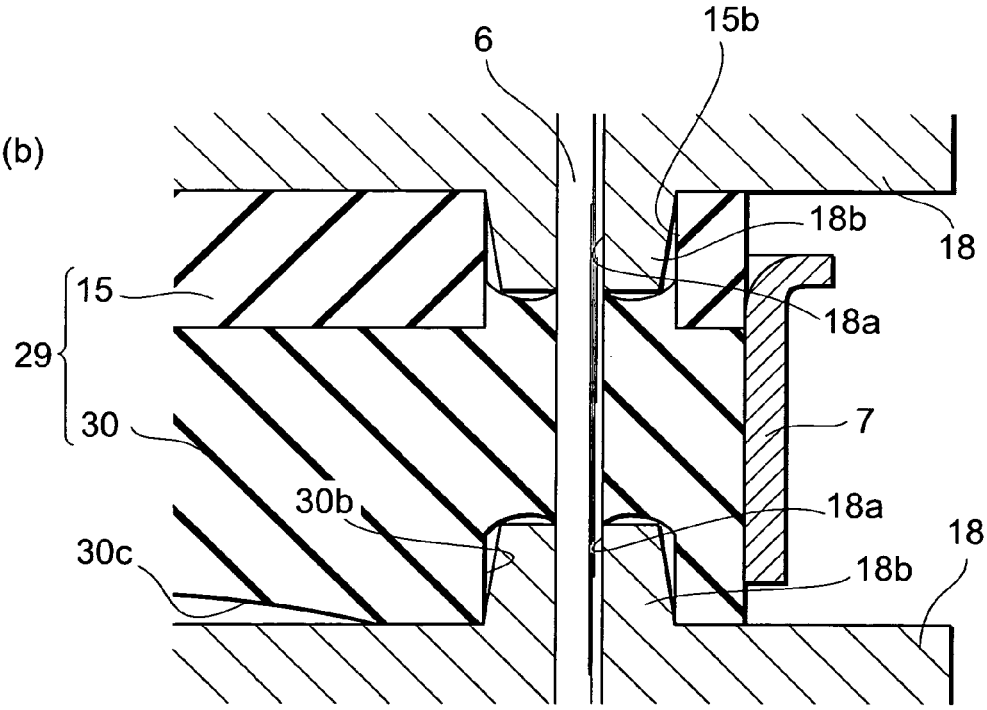

The stem 29, which is set thus, is then loaded inside an electric oven and subject to a sintering process under the same conditions as those mentioned above. In this sintering process, the base member 30 and the upper holding member 15, the base member 30 and the respective stem pins 6, and the base member 30 and the ring-like side tube 7 become fused by the melting of the base member 30 as shown in FIG. 33(*a*) and FIG. 33(*b*). Here, positioning of the base member 30 in the height direction within the large-diameter openings 30*b* and 15*b* is achieved by means of the end faces of protrusions 18*b* of positioning jigs 18, and the excess volume of the molten base member 30 is made to escape into the base member seep recess 30*c* as shown in FIG. 33(*b*). When the sintering process ends, the stem 29 is taken out from the electric oven and upper and lower positioning jigs 18 are removed, thereby completing the manufacture of the stem 29.

Next, the dynodes 10, focusing electrode 11, and the anode 12, which are layered on the inner (upper) surface of the stem 29 of the stem assembly thus obtained, are fixed by welding the dynode connecting tabs 10*a*, the anode connecting tabs 12*a*, and protruding tabs 11*a*, provided on focusing electrode 11, respectively to the corresponding stem pins 6. Then in a vacuum state, upon bringing the side tube 2, to which the light receiving plate 3 is fixed, into contact with the side surface of the portion of the stem 29 that protrudes from the open end face of the ring-like side tube 7, the side tube 2 is capped onto this protruding portion of the stem 29, and the flange portion 2*a* of the side tube 2 and the flange portion 7*a* of the ring-like side tube 7 are fixed by welding and thereby assembled together. The head-on type photomultiplier 28, shown in FIG. 29 is thereby obtained.

Even with this photomultiplier 28, the ring-like side tube 7 is not interposed between the side tube 2 and the stem 29 in the radial direction, and the side tube 2 is joined to the ring-like side tube 7 in the state of being directly capped onto the portion of the stem 29 that protrudes out from the open end face of the ring-like side tube 7. Enlargement of the diameter of the photomultiplier 28 in the radial direction due to the overlapping of the side tube 2 and the ring-like side tube 7 can thus be avoided, and a high density, a high degree of integration, etc., can be realized in mounting. Furthermore, as in the first embodiment, in joining the side tube 2 and the ring-like side tube 7, the side tube 2 and the ring-like side tube 7 can be positioned readily by setting the side tube 2 along the side surface of the stem 29 portion that protrudes out from the upper open end face of the ring-like side tube 7, and then capping the side tube 2 onto this protruding portion of the stem 29. As a result, the manufacturing process of the photomultiplier 28 is simplified and the manufacturing cost can be reduced.

Also as with the photomultiplier 1 of the first embodiment, with the photomultiplier 28, since in the stem 29, the upper holding member 15, which is the member at the upper (inner) side of base member 30, has an insulating property, and the peripheral portion near the anode pin 13 is arranged as a chamfered shape 15*c* (see FIG. 5), the creeping distance in the vicinity of the anode pin 13 is elongated, and dielectric breakdown and leakage current due to creeping discharge are prevented adequately and the mixing of noise into electrical signal taken out from the anode pin 13 is prevented. In regard to the chamfered shape 15*c*, the chamfered shape may be formed along the entire circumference of the peripheral portion of the upper holding member 15 or may be formed as a stepped, disk-like shape or any of the various modifications shown in FIG. 11 to FIG. 23 may be applied in the present embodiment as well.

Also, since the full circumferences of the portions of the upper (inner) surface of the stem 29, through which the stem pins 6, including the anode pin 13, pass, are formed as recesses 29*a* having the base member 30 as the bottom surfaces, the creeping distance regarding the vicinity of the anode pin 13 is elongated further and the mixing of noise into the electrical signal taken out from the anode pin 13 is prevented more effectively. Since the creeping distance is likewise elongated for each of the other stem pins 6 besides the anode pin 13, the voltage endurance of the photomultiplier 28 is improved. Since by the forming of recesses 29*a*, the creeping distances along insulators between the stem pins 6 are also elongated at the same time and the triple junctions are concealed inside recesses 29*a*, the voltage endurance of the photomultiplier 28 is improved further.

As with the first embodiment, since the concentricities of the respective stem pins 6 with respect to the respective openings 15*a* of the upper holding member 15 are secured by positioning jigs 18, the triple junctions can be concealed inside recesses 29*a* reliably and the voltage endurance of the photomultiplier 28 is secured further.

Also with the photomultiplier 28, since the stem 29 is arranged as a two-layer structure formed of the base member 29 and the upper holding member 15, joined to the upper side (inner side) of the base member 29, the positional precision, flatness, and levelness of the upper surface of the stem 29 are improved. Consequently with the photomultiplier 28, the positional precision of the interval between the photoelectric surface 4 and the electron multiplier unit 9, which is installed on the upper surface (inner surface) of the stem 29, and the seating property of the electron multiplier unit 9 are improved, thus enabling photoelectric conversion efficiency and other characteristics to be obtained satisfactorily.

Also, since the base member seep recess 30*c* (see FIG. 32) is formed in the base member 30, the excess volume of the molten base member 30 can be made to escape satisfactorily into the base member seep recess 30*c*. Thus in the process of melting the base member 30, the base member 30 will hardly overflow onto the surface of the stem 29 via the openings 15*a* of the upper holding member 15 and the lower halves of the openings 30*a* of the base member 30 and the positional precision, flatness, and levelness of both surfaces of the stem 29 are thus secured.

Also even with the photomultiplier 28, since the full circumferences of the stem pin 6 passing portions of the upper (inner) surface and the lower (outer) surface of the stem 29 are arranged, as described above, as recesses 29*a* having the base member 30 as the bottom surfaces, cracks are prevented from being formed at both sides of the portions at which the stem pins 6 are joined to the base member 30, and airtightness and good appearance of the sealed container 8 are thus secured.

As a modification example of this embodiment, a structure, wherein a metal exhaust tube 19 is disposed at a central portion of the stem 29 in the same manner as the photomultiplier 20 shown in FIG. 24, may be employed. Also, an arrangement may be employed wherein the side tube 27, which is longer in length than the side tube 2, is fitted to the ring-like side tube 7, provided with a flange portion at its lower end, and the flange portions of the side tubes are fixed together by welding as in the photomultiplier 26 shown in FIG. 12.

Also, although with the above-described embodiment, the base member seep recess 30*c* is provided as the base member seep portion at a lower portion of the base member 30, it is sufficient that such a base member seep portion be provided in at least one of the base member 30 and the upper holding member 15, and for example, a base member seep opening of the same form as that described for the first embodiment may be provided in just the upper holding member 15 or a base member seep opening may be provided in the upper holding member 15 and the base member seep recess 30*c* may be provided in the base member 30.

In arranging a radiation detector equipped with the photomultiplier 28 shown in FIG. 29, by arranging in the same manner as the radiation detectors 21 and 25 shown in FIG. 25 to FIG. 26 and FIG. 27 to FIG. 28, a radiation detector, exhibiting the same actions and effects described above and is especially suitable for surface mounting, can be provided.

Figure 34:
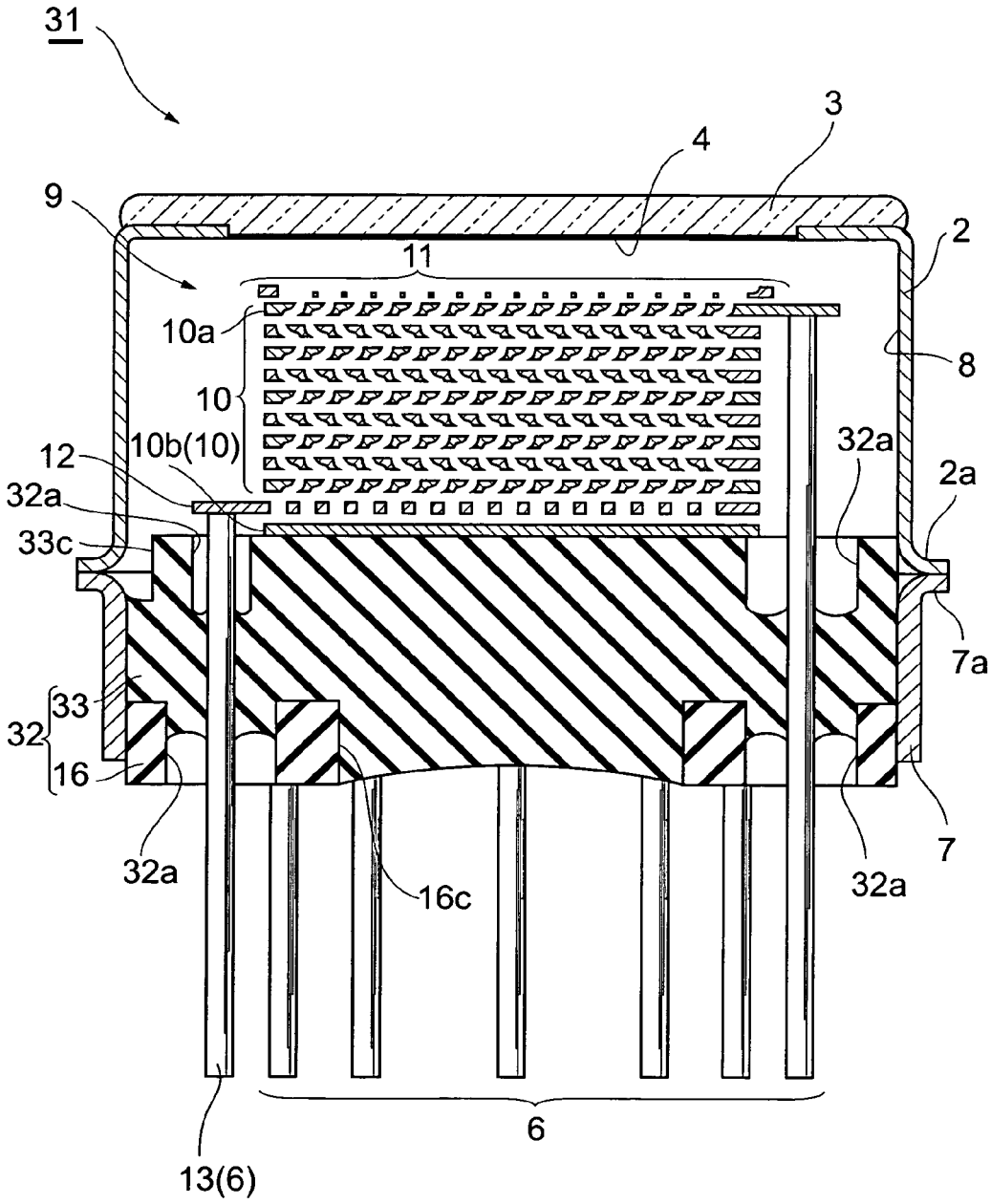
FIG. 34 is a sectional side view of a photomultiplier of a modification example of the second embodiment.

As yet another modification example of the present embodiment, a stem with a two-layer structure may be arranged by joining a holding member to the lower surface (outer surface) of a base member. As shown in FIG. 34, with a photomultiplier 31 of this other modification example, a stem 32 is arranged as a two-layer structure of a disk-like base member 33, of the same quality as the base member 14, and the lower holding member 16, joined to the lower side (inner side) of the base member 33.

Figure 35:
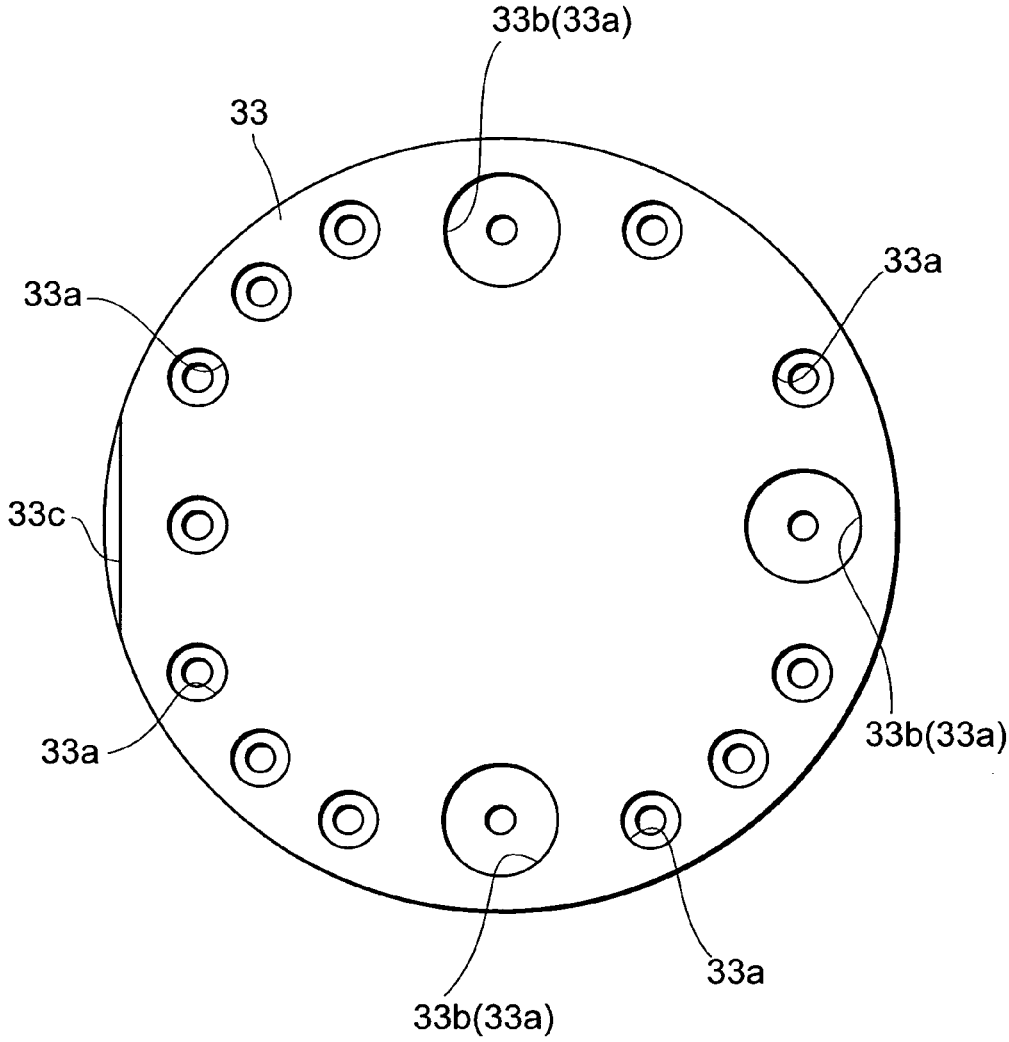
FIG. 35 is a plan view of a base member making up a stem of the modification example of the second embodiment.
Figure 36:
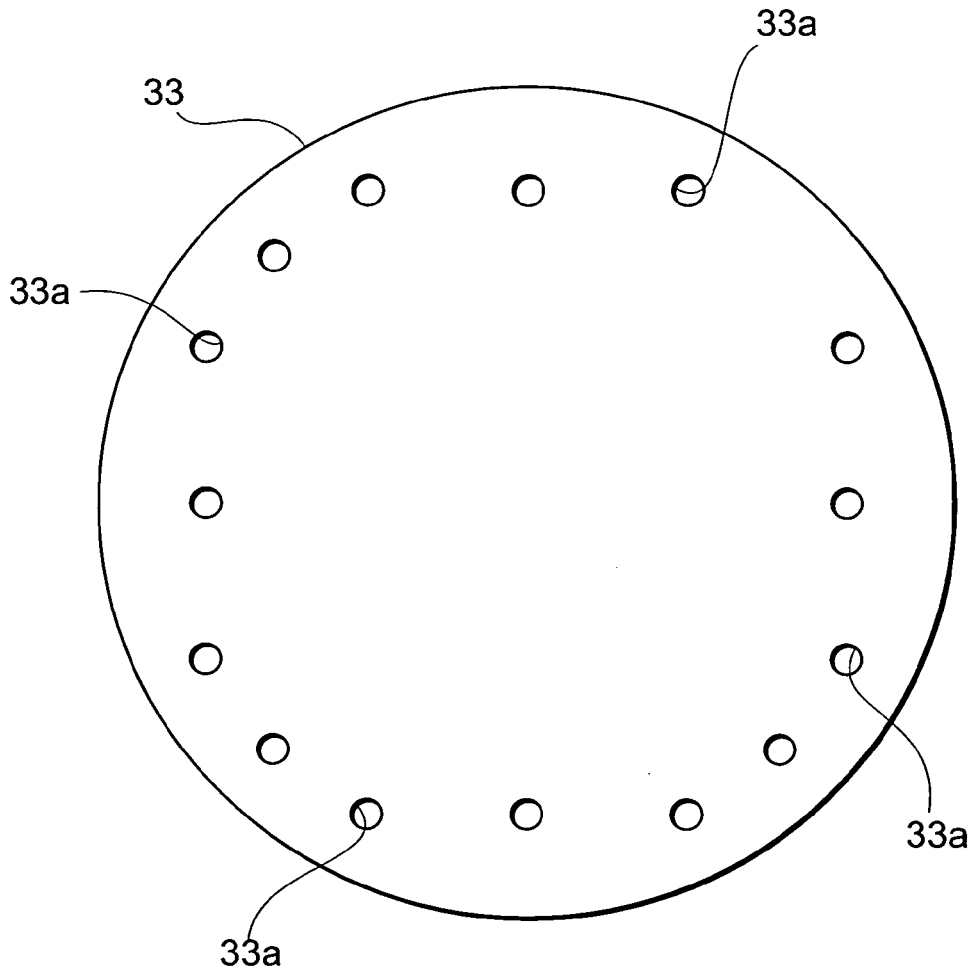
FIG. 36 is a bottom view of the base member making up the stem of the modification example of the second embodiment.

That is, the stem 32 of the photomultiplier 31 is not provided with the upper holding member 15, and the base member 33 has, along outer peripheral portions of the base member 33, a plurality (15) of openings 33*a*, with each of which the diameter of the lower half is made substantially equal to the outer diameter of each stem pin 6 as shown in FIG. 36 and the diameter of the upper half is made larger than the outer diameter of each stem pin 6 as shown in FIG. 35. Of the openings 33*a* of the base member 33, those of three predetermined locations, other than that of the opening 33*a* through which the anode pin 13 passes, are arranged as large-diameter openings 33*b*, with each of which the outer diameter of the upper half is made larger than the outer diameter of the upper half of each of the other openings 33*a* in order to enable the entry of the positioning jig 18. Furthermore, a peripheral portion of the base member 33 at the upper side near the opening 33*a*, through with the anode pin 13 passes, is arranged as a chamfered shape 33*c*. That is, the peripheral portion, near the anode pin 13, of the upper surface facing the interior of the sealed container 8 is formed as a chamfered shape 33*c*.

As shown in FIG. 34, the base member 33 and the lower holding member 16 are overlapped in a state in which the axial center positions of the respective openings 33*a* and 16*a* and large-diameter openings 33*b* and 16*b* are matched and are joined by fusing by the melting of the base member 33 in the state in which the stem pins 6 are inserted through the respective openings 33*a* and 16*a* and the respective large-diameter openings 33*b* and 16*b*. More specifically, the lower holding member 16 is joined in close contact with the lower surface of the base member 33, the respective stem pins 6 are inserted through the upper halves of the respective openings 33*a* of the base member 33 and the respective openings 16*a* of the lower holding member 16 so that recesses 32*a*, having the base member 33 as the bottom surfaces, are formed along the full circumferences of the portions of both the lower (inner) surface and lower (outer) surface of the stem 32 through which the respective stem pins 6 pass, and the respective stem pins 6 are joined in close contact with the base member 33 at the bottom surfaces of the recesses 32*a*.

Also, the stem 32 is joined to the ring-like side tube 7 upon being protruded out to the side tube 2 side from the upper open end face of the ring-like side tube 7, and in the state of being directly capped onto the portion of the stem 32 that protrudes out from the open end face of the ring-like side tube 7, the side tube 2 is joined to the ring-like side tube 7 by fixing by welding of the respective flange portions 2*a* and 7*a*.

Figure 37:
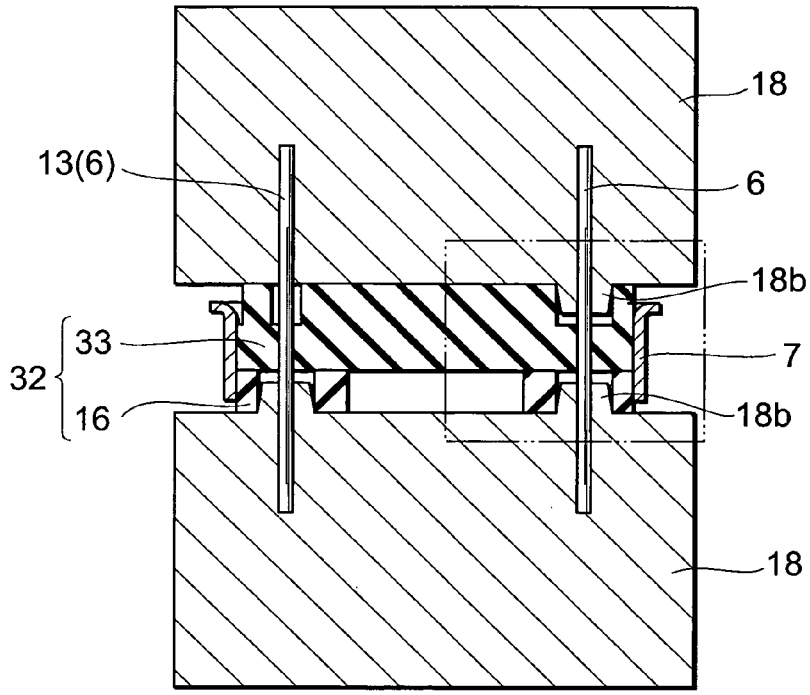
FIG. 37 shows an example of manufacturing the stem of the modification example of the second embodiment, with (a) being a sectional side view and (b) being an enlarged view of the principal portions of the stem in a state prior to sintering.
Figure 37:
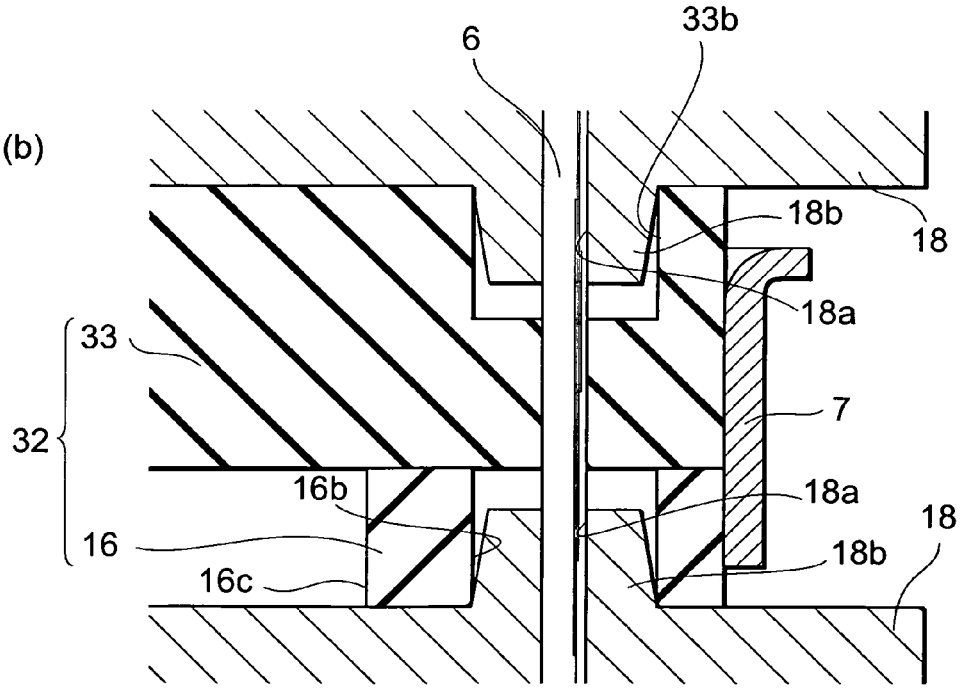

The same method as that for the stem 5 of the first embodiment can be employed to manufacture such a stem 32 as well. Specifically as shown in FIG. 37, firstly, one positioning jig 18 (the jig at the lower side of the figure) is set, with protrusions 18*b* facing upward, on a working surface (not shown) and the stem pins 6 are respectively inserted and fixed in insertion holes 18*a* of this positioning jig 18, and then the lower holding member 16 is set on positioning jig 18 by making protrusions 18*b* of positioning jig 18 enter the large-diameter openings 16*b* while passing the respective stem pins 6, fixed to positioning jig 18, through the openings 16*a*. Furthermore, while roughly matching the axial center positions of the respective openings 33*a* and the respective large-diameter openings 33*b* to the respective openings 16*a* and the large-diameter openings 16*b* of the lower holding member 16, the stem pins 6 are passed through the respective openings 33*a* and the respective large-diameter openings 33*b* to overlap the base member 33 onto the lower holding member 16, and thereafter, the ring-like side tube 7 is fitted onto the base member 33. Lastly, the other positioning jig 18 (the jig at the upper side of the figure) is set on the base member 33 by making protrusions 18*b* enter into the large-diameter openings 33*b* of the base member 33 while inserting the respective stem pins 6, protruding outward from the base member 33, into insertion holes 18*a*. The setting of the stem 32 is thereby completed. As with the first embodiment, the ring-like side tube 7 and the respective stem pins 6 that are set are subject to a surface oxidizing process in advance in order to heighten the property of fusion with the base member 33.

Figure 38:
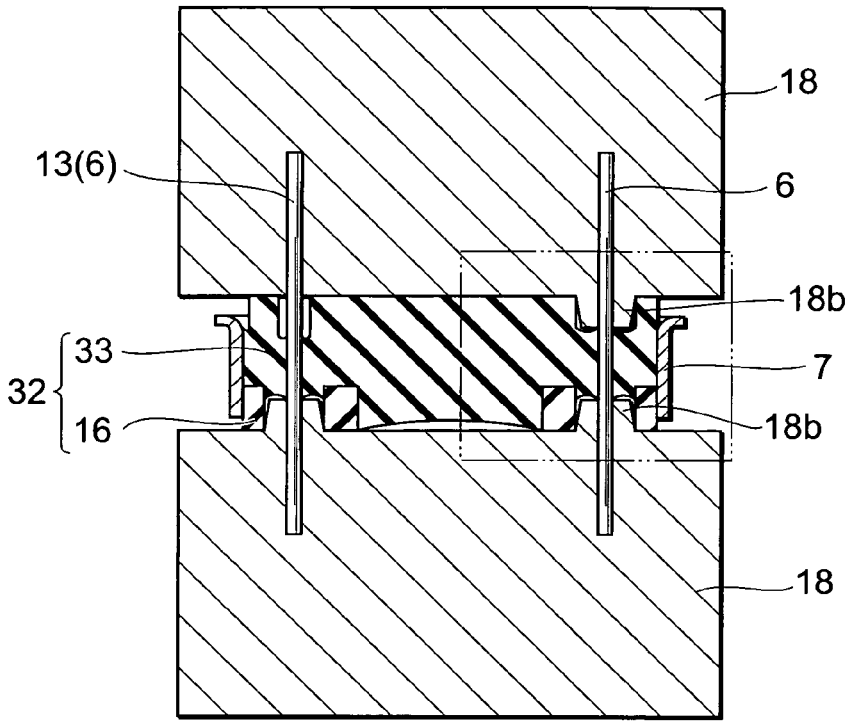
FIG. 38 shows the example of manufacturing the stem of the modification example of the second embodiment, with (a) being a sectional side view and (b) being an enlarged view of the principal portions of the stem in a state after sintering.
Figure 38:
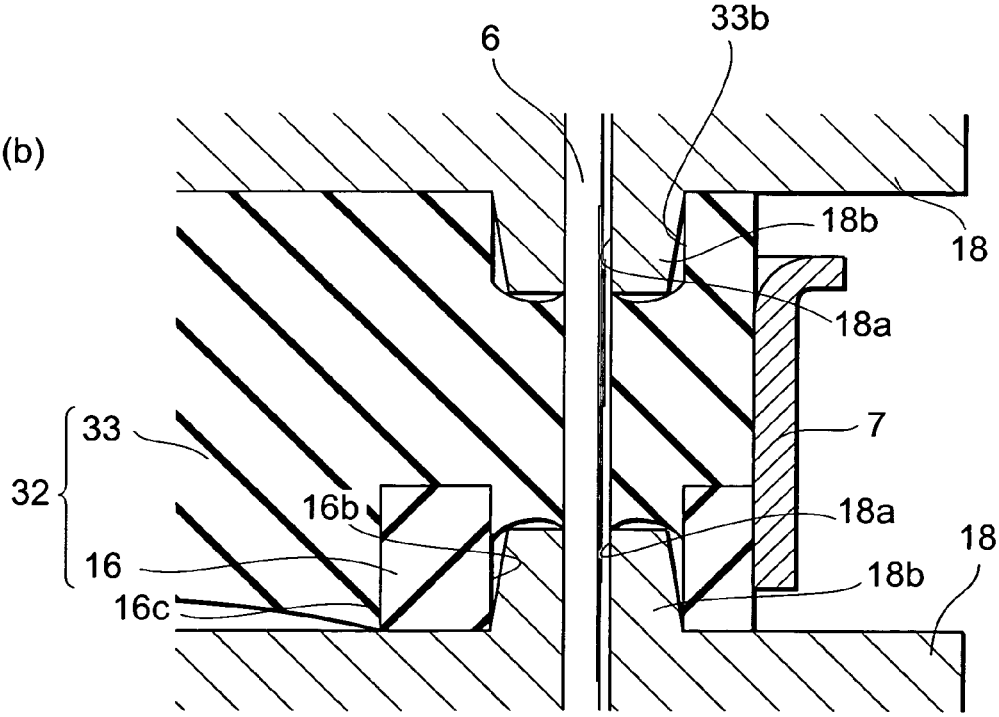

The stem 32, which is set thus, is then loaded inside an electric oven and subject to a sintering process under the same conditions as those mentioned above. In this sintering process, the base member 33 and the lower holding member 16, the base member 33 and the respective stem pins 6, and the base member 33 and the ring-like side tube 7 become fused by the melting of the base member 33 as shown in FIG. 38(*a*) and FIG. 38(*b*). Here, the positioning of the base member 33 in the height direction within the large-diameter openings 33*b* and 16*b* is achieved by means of the end faces of protrusions 18*b* of positioning jigs 18, and the excess volume of the molten base member 33 is made to escape into the base member seep opening 16*c* as shown in FIG. 38(*b*). When the sintering process ends, the stem 32 is taken out from the electric oven and upper and lower positioning jigs 18 are removed, thereby completing the manufacture of the stem 32.

Next, the dynodes 10, focusing electrode 11, and the anode 12, which are layered on the inner (upper) surface of the stem 32 of the stem assembly thus obtained, are fixed by welding the dynode connecting tabs 10*a*, the anode connecting tabs 12*a*, and protruding tabs 11*a*, provided on focusing electrode 11, respectively to the corresponding stem pins 6. Then in a vacuum state, upon bringing the side tube 2, to which the light receiving plate 3 is fixed, into contact with the side surface of the portion of the stem 32 that protrudes out from the open end face of the ring-like side tube 7, the side tube 2 is capped onto this protruding portion of the stem 32, and the flange portion 2*a* of the side tube 2 and the flange portion 7*a* of the ring-like side tube 7 are fixed by welding and thereby assembled together. The head-on type photomultiplier 31, shown in FIG. 34 is thereby obtained.

Even with this photomultiplier 31, the ring-like side tube 7 is not interposed between the side tube 2 and the stem 32 in the radial direction, and the side tube 2 is joined to the ring-like side tube 7 in the state of being directly capped onto the portion of the stem 32 that protrudes out from the open end face of the ring-like side tube 7. Enlargement of the diameter of the photomultiplier 31 in the radial direction due to the overlapping of the side tube 2 and the ring-like side tube 7 can thus be avoided, and a high density, a high degree of integration, etc., can be realized in mounting. Furthermore, as in the first embodiment, in joining the side tube 2 and the ring-like side tube 7, the side tube 2 and the ring-like side tube 7 can be positioned readily by setting the side tube 2 along the side surface of the stem 32 portion that protrudes out from the upper open end face of the ring-like side tube 7, and then capping the side tube 2 onto this protruding portion of the stem 32. As a result, the manufacturing process of the photomultiplier 31 is simplified and the manufacturing cost can be reduced.

Also even with the photomultiplier 31, since in the stem 32, base member 33 has an insulating property in itself and the peripheral portion of the upper surface near the anode pin 13 is arranged as a chamfered shape 33*c* (see FIG. 35) of the same form as that of the photomultiplier 1 of the first embodiment, the creeping distance in the vicinity of the anode pin 13 is elongated, and dielectric breakdown and leakage current due to creeping discharge are prevented adequately and the mixing of noise into electrical signal taken out from the anode pin 13 is prevented. In regard to the chamfered shape 33*c*, the chamfered shape may be formed along the entire circumference of the peripheral portion of the upper surface side of base member 33 or any of the various modifications shown in FIG. 11 to FIG. 23 may be applied.

Also, since the full circumferences of the portions of the upper (inner) surface of the stem 32, through which the stem pins 6, including the anode pin 13, pass, are formed as recesses 32*a* having base member 33 as the bottom surfaces, the creeping distance regarding the vicinity of the anode pin 13 is elongated further and the mixing of noise into the electrical signal taken out from the anode pin 13 is prevented more effectively. Since the creeping distance is likewise elongated by the amount corresponding to the height of recess 32*a* for each of the other stem pins 6 besides the anode pin 13, the occurrence of creeping discharge is restrained and the voltage endurance of the photomultiplier 31 is improved. Since by the forming of recesses 32*a*, the creeping distances along insulators between the stem pins 6 are also elongated at the same time, the voltage endurance of the photomultiplier 31 is improved further.

As with the first embodiment, since the concentricities of the respective stem pins 6 with respect to the respective openings 16*a* of the lower holding member 16 are secured by positioning jigs 18, the triple junctions can be concealed inside recesses 32*a* reliably and the voltage endurance of the photomultiplier 31 is secured further.

Also with the photomultiplier 31, since the stem 32 is arranged as a two-layer structure formed of the base member 33 and the lower holding member 16, joined to the lower side (outer side) of the base member 33, the positional precision, flatness, and levelness of the lower surface of the stem 32 are improved. Consequently with the photomultiplier 31, the dimensional precision of the total length of the photomultiplier 31 and the mounting property regarding surface mounting of the photomultiplier 31 are improved.

Also as in the first embodiment, since the base member seep opening 16*c* (see FIG. 6) is formed in the lower holding member 16, the base member 33 will hardly overflow onto the surface of the stem 32 via the openings 16*a* of the lower holding member 16 and the upper halves of the openings 33*a* of the base member 33 in the process of melting the base member 33, and the positional precision, flatness, and levelness of both surfaces of the stem 32 are thus secured.

Also even with the photomultiplier 31, since the full circumferences of the stem pin 6 passing portions of the upper (inner) surface and the lower (outer) surface of the stem 32 are arranged, as described above, as recesses 32*a* having base member 33 as the bottom surfaces, cracks are prevented from being formed at both sides of the portions at which the stem pins 6 are joined to base member 33, and airtightness and good appearance of the sealed container 8 are thus secured.

As with the photomultiplier 20 shown in FIG. 24, a structure, wherein a metal exhaust tube 19 is disposed at a central portion of the stem 32, may be employed in the photomultiplier 31 as well.

Also, although with the present embodiment, the base member seep opening 16*c* is provided as the base member seep portion in just the lower holding member 16, it is sufficient that such a base member seep portion be provided in at least one of the base member 33 and the lower holding member 16, and for example, a base member seep recess of the same form as that described above may be provided in just the base member 33 or the base member seep opening 16*c* may be provided in the lower holding member 16 and a base member seep recess may be provided in the base member 33.

In arranging a radiation detector equipped with the photomultiplier 31, by arranging in the same manner as the radiation detectors 21 and 25 shown in FIG. 25 to FIG. 26 and FIG. 27 to FIG. 28, a radiation detector, exhibiting the same actions and effects described above and is especially suitable for surface mounting, can be provided.

[Third Embodiment]

Figure 39:
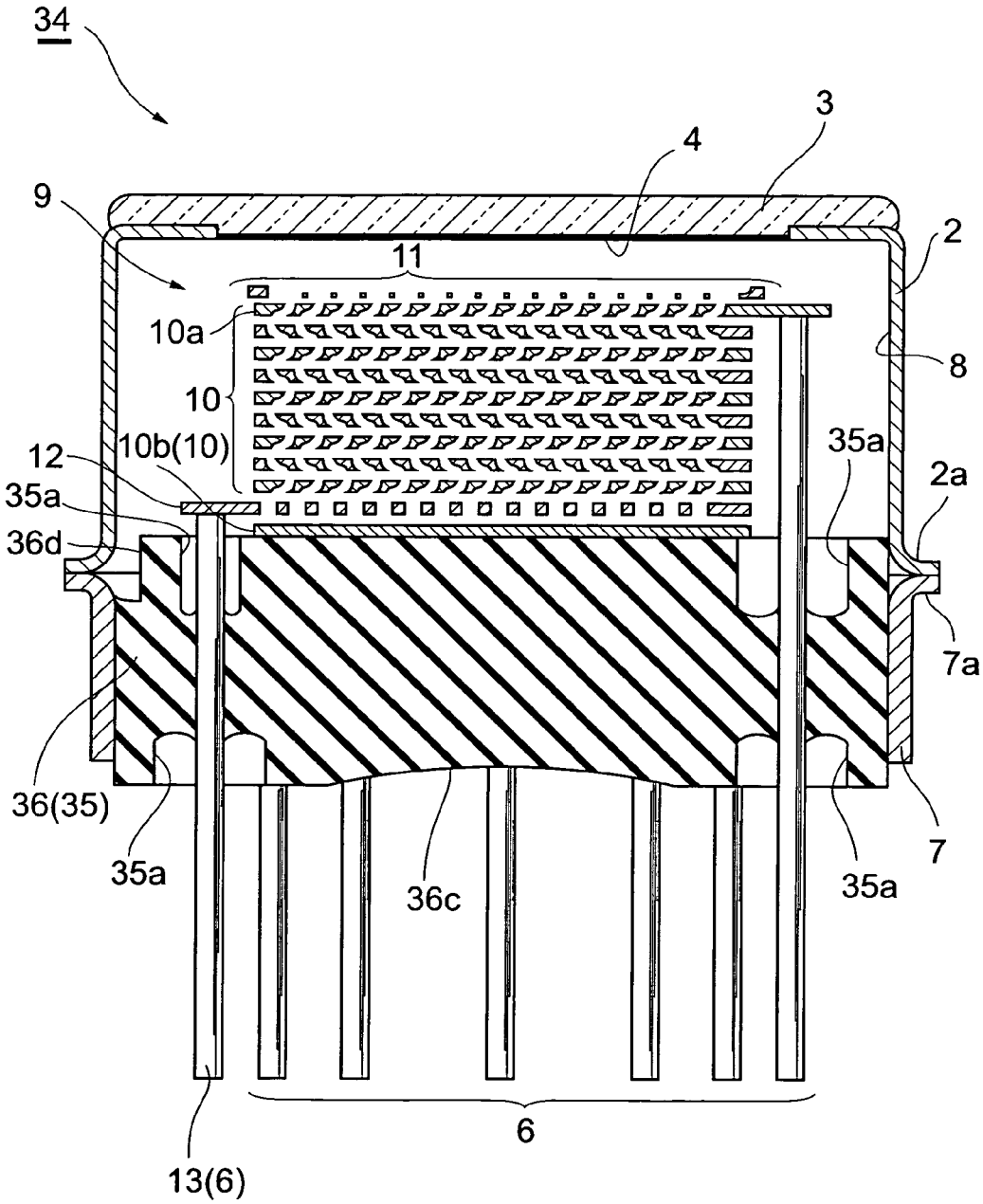
FIG. 39 is a sectional side view of a photomultiplier of a third embodiment of this invention.

As shown in FIG. 39, a photomultiplier 34 of a third embodiment has a stem 35 arranged as a single-layer structure of a disk-like base member 36, of the same quality as the base member 14, and thus differs from photomultiplier 1 of the first embodiment, wherein the stem 5 is arranged as a three-layer structure of the base member 14, the upper holding member 15, and the lower holding member 16.

Figure 40:
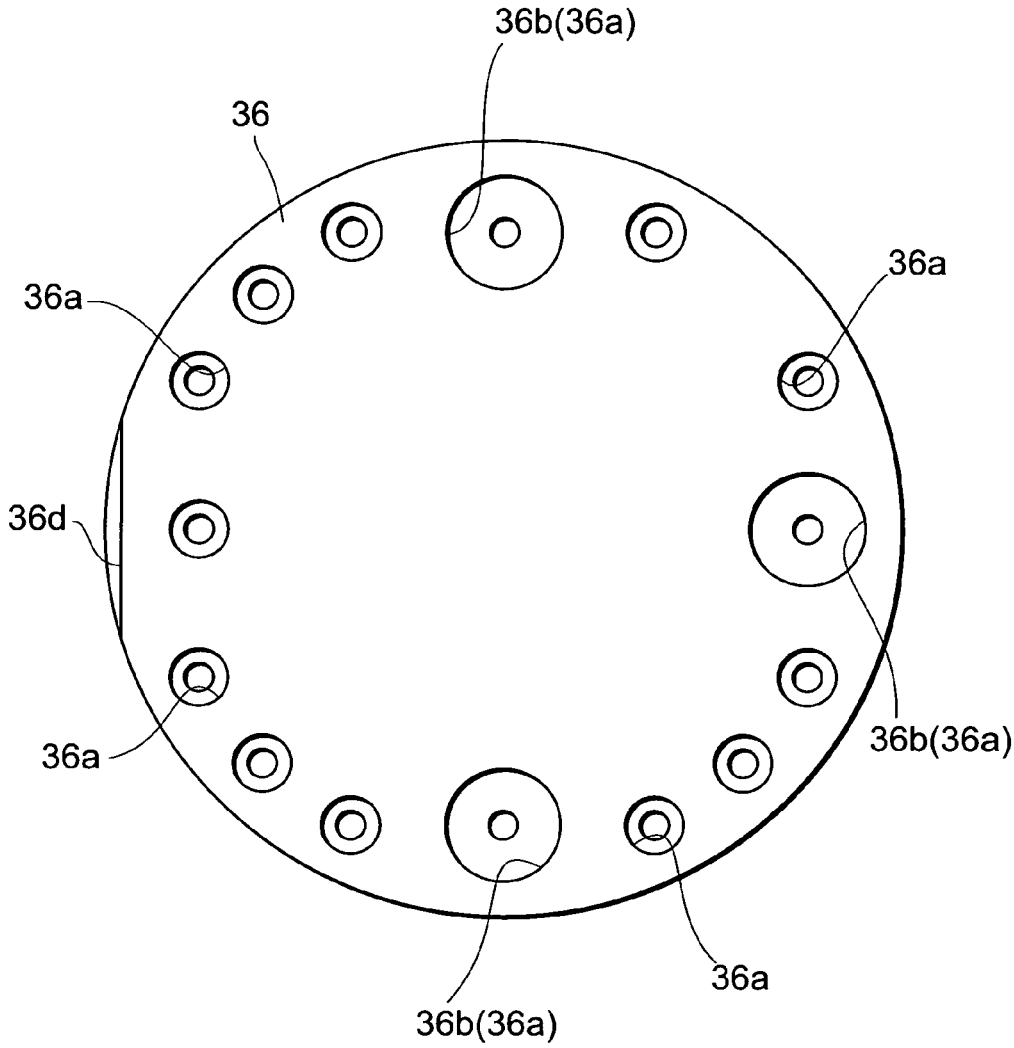
FIG. 40 is a plan view of a base member making up a stem of the third embodiment.
Figure 41:
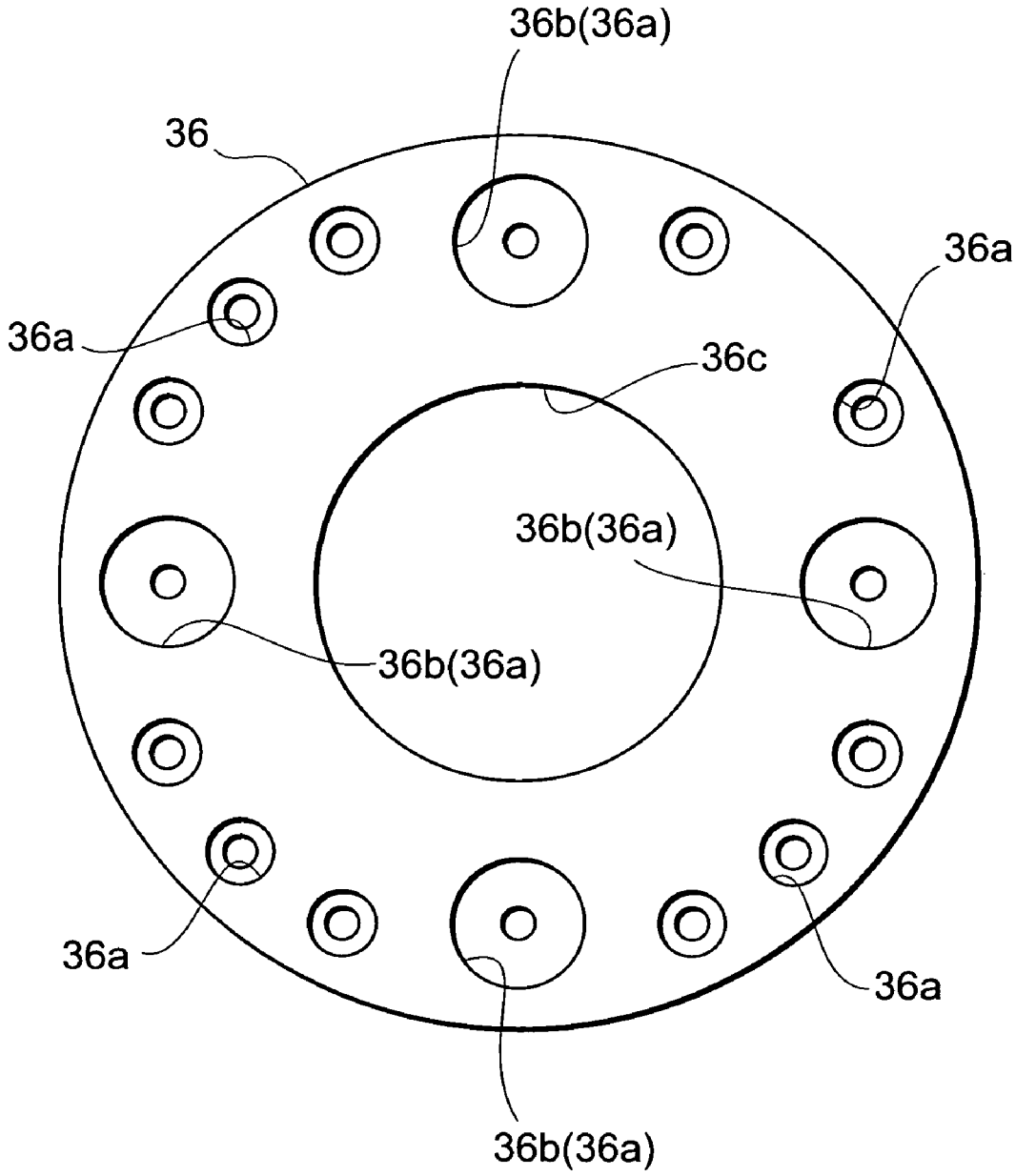
FIG. 41 is a bottom view of the base member making up the stem of the third embodiment.

That is, the stem 35 of the photomultiplier 34 is not provided with the upper holding member 15 and the lower holding member 16, and the base member 36 has, along outer peripheral portions of base member 36, a plurality (15) of openings 36*a*, with each of which the diameter of an intermediate portion is made substantially equal to the outer diameter of each stem pin 6 and the diameters of upper and lower portions are made larger than the outer diameter of each stem pin 6 as shown in FIG. 39 to FIG. 41. Of the openings 36*a* of the base member 36, the upper and lower portions of three predetermined locations, other than that of the opening 36*a* through which the anode pin 13 passes, and the lower portion of the opening 36*a* through which the anode pin 13 passes are arranged as large-diameter openings 36*b*, each of which is larger in outer diameter than the outer diameter of each of the upper and lower portions of the other openings 36*a*, in order to enable the entry of the holding jigs 18 that are of the same arrangement as the positioning jigs. Furthermore, a circular base member seep recess 36*c* (see FIG. 42), serving as a base member seep portion into which the base member 36 seeps upon melting, is formed at a central portion of the lower portion of the base member 36 and a peripheral portion of the base member 36 at the upper side near the opening 36*a*, through with the anode pin 13 passes, is arranged as a chamfered shape 36*d*. That is, the peripheral portion, near the anode pin 13, of the upper surface facing the interior of the sealed container 8 is formed as a chamfered shape 36*d*.

As shown in FIG. 39, the base member 36 is joined to the stem pins 6 by fusing by the melting of the base member 36 in the state in which the stem pins 6 are inserted through the respective openings 36*a*. More specifically, the respective stem pins 6 are inserted through the upper portions and lower portions of the respective openings 36*a* of the base member 36 so that recesses 35*a*, having the base member 36 as the bottom surfaces, are formed along the full circumferences of the portions of both the upper (inner) surface and the lower (outer) surface of the stem 35 through which the respective stem pins 6 pass, and the respective stem pins 6 are joined in close contact with the base member 36 at the bottom surfaces of the recesses 35*a*.

Also, the stem 35 is joined to the ring-like side tube 7 upon being protruded out to the side tube 2 side from the upper open end face of the ring-like side tube 7, and in the state of being directly capped onto the portion of the stem 35 that protrudes from the open end face of the ring-like side tube 7, the side tube 2 is joined to the ring-like side tube 7 by fixing by welding of the respective flange portions 2*a* and 7*a*.

Figure 42:
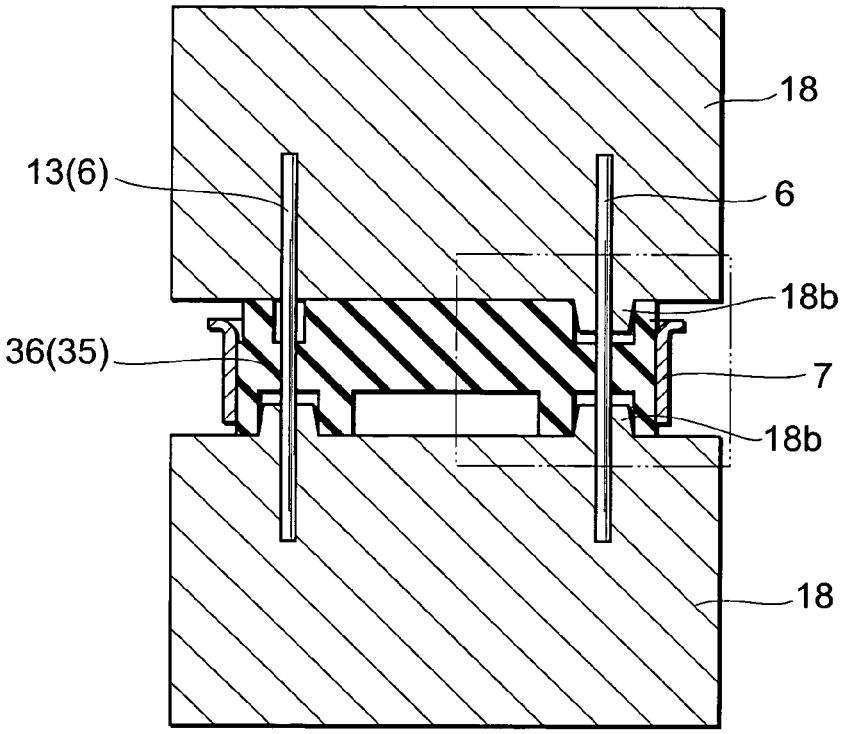
FIG. 42 shows an example of manufacturing the stem of the third embodiment, with (a) being a sectional side view and (b) being an enlarged view of the principal portions of the stem in a state prior to sintering.
Figure 42:
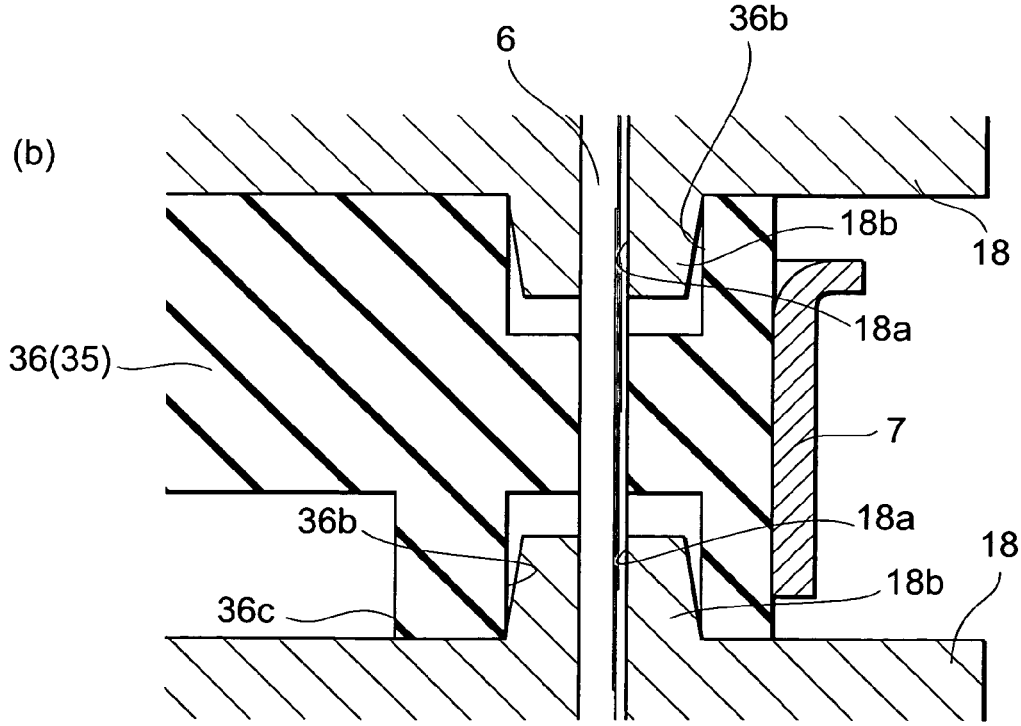
Figure 43:
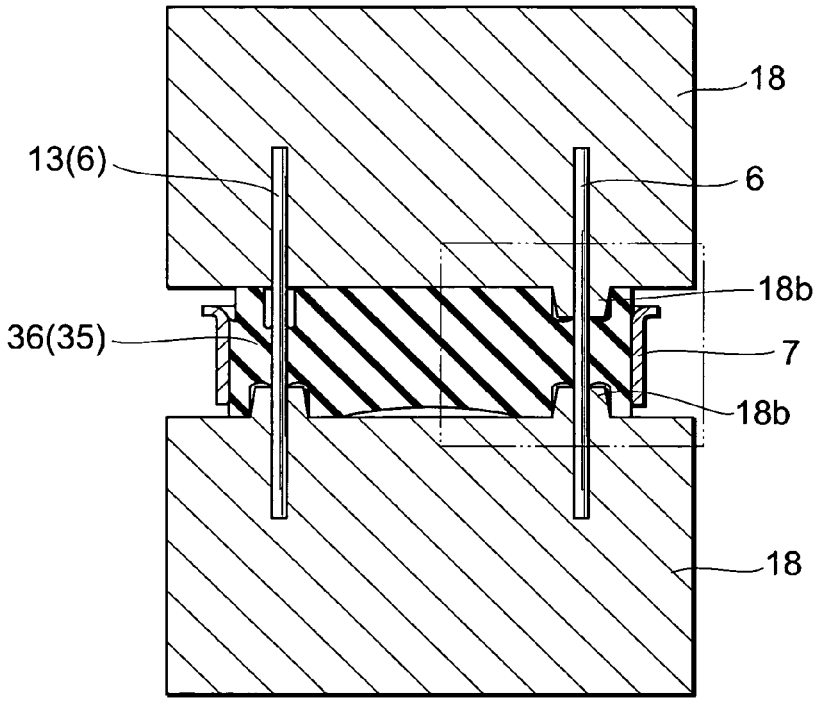
FIG. 43 shows the example of manufacturing the stem of the third embodiment, with (a) being a sectional side view and (b) being an enlarged view of the principal portions of the stem in a state after sintering.
Figure 43:
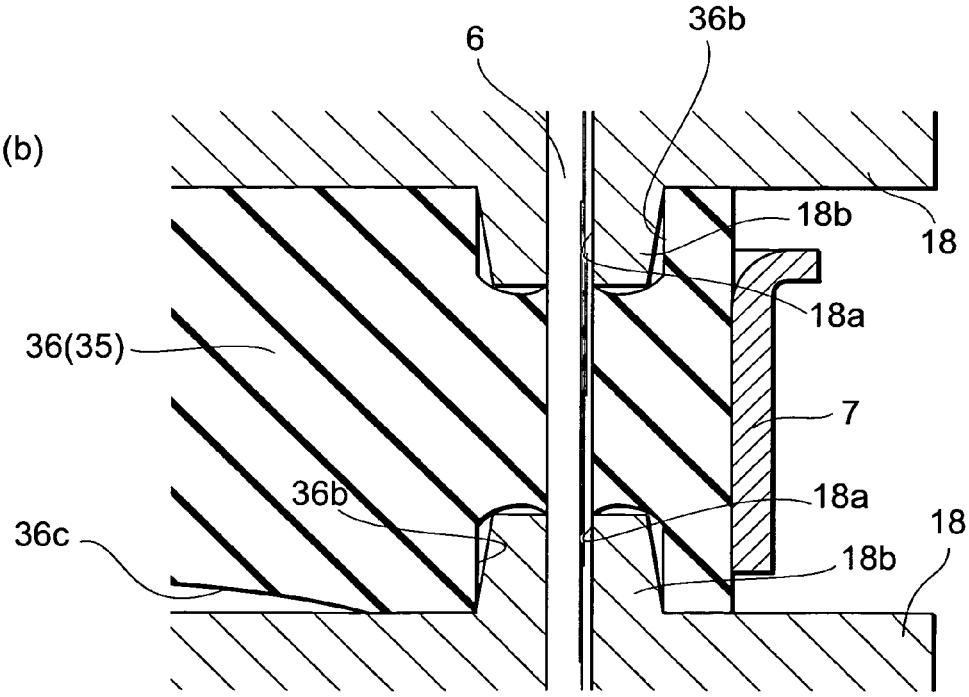

The same method as that for the stem 5 of the first embodiment can be employed to manufacture such a stem 35. Specifically as shown in FIG. 42, firstly, one of the holding jigs 18 (the jig at the lower side of the figure), of the same arrangement as the above-described positioning jigs, is set, with the protrusions 18*b* facing upward, on a working surface (not shown) and the stem pins 6 are respectively inserted and fixed in the insertion holes 18*a* of this holding jig 18, and then the base member 36 is set on the holding jig 18 by making the protrusions 18*b* of the holding jig 18 enter the large-diameter openings 36*b* at the lower side of the base member 36 while passing the respective stem pins 6, fixed to the holding jig 18, through the openings 36*a*. Thereafter, the ring-like side tube 7 is fitted onto the base member 36 so that the upper portion of the base member 36 protrudes from the upper open end of the ring-like side tube 7. Lastly, the other holding jig 18 (the jig at the upper side of the figure) is set on the base member 36 by making the protrusions 18*b* enter into the large-diameter openings 36*b* at the upper side of the base member 36 while inserting the respective stem pins 6, protruding outward from the base member 36, into the insertion holes 18*a*. The setting of the stem 35 is thereby completed. As with the first embodiment, the ring-like side tube 7 and the respective stem pins 6 that are set are subject to a surface oxidizing process in advance in order to heighten the property of fusion with the base member 36.

The stem 35, which is set thus, is then loaded inside an electric oven and subject to a sintering process under the same conditions as those mentioned above. In this sintering process, the base member 36 and the respective stem pins 6 and the base member 36 and the ring-like side tube 7 become fused by the melting of the base member 36 as shown in FIG. 31(*a*) and FIG. 31(*b*). Here, the positioning of the base member 36 in the height direction within the large-diameter openings 36*b* is achieved by means of the end faces of the protrusions 18*b* of the holding jigs 18, and the excess volume of the molten base member 36 is made to escape into the base member seep recess 36*c* as shown in FIG. 31(*b*). When the sintering process ends, the stem 35 is taken out from the electric oven and upper and the lower holding jigs 18 are removed, thereby completing the manufacture of the stem 35.

Next, the dynodes 10, focusing electrode 11, and the anode 12, which are layered on the inner (upper) surface of the stem 35 of the stem assembly thus obtained, are fixed by welding the dynode connecting tabs 10*a*, the anode connecting tabs 12*a*, and protruding tabs 11*a*, provided on focusing electrode 11, respectively to the corresponding stem pins 6. Then in a vacuum state, upon bringing the side tube 2, to which the light receiving plate 3 is fixed, into contact with the side surface of the portion of the stem 35 that protrudes from the open end face of the ring-like side tube 7, the side tube 2 is capped onto this protruding portion of the stem 35, and the flange portion 2*a* of the side tube 2 and the flange portion 7*a* of the ring-like side tube 7 are fixed by welding and thereby assembled together. The head-on type photomultiplier 34, shown in FIG. 39 is thereby obtained.

Even with this photomultiplier 34, the ring-like side tube 7 is not interposed between the side tube 2 and the stem 35 in the radial direction, and the side tube 2 is joined to the ring-like side tube 7 in the state of being directly capped onto the portion of the stem 35 that protrudes out from the open end face of the ring-like side tube 7. Enlargement of the diameter of the photomultiplier 34 in the radial direction due to the overlapping of the side tube 2 and the ring-like side tube 7 can thus be avoided, and a high density, a high degree of integration, etc., can be realized in mounting. Furthermore, as in the first embodiment, in joining the side tube 2 and the ring-like side tube 7, the side tube 2 and the ring-like side tube 7 can be positioned readily by setting the side tube 2 along the side surface of the stem 35 portion that protrudes out from the upper open end face of the ring-like side tube 7, and then capping the side tube 2 onto this protruding portion of the stem 35. As a result, the manufacturing process of the photomultiplier 34 is simplified and the manufacturing cost can be reduced.

Also even with the photomultiplier 34, since in the stem 35, base member 36 has an insulating property in itself, and the peripheral portion of the upper surface near the anode pin 13 is arranged as the chamfered shape 36*d* (see FIG. 40) in the same manner as in the photomultiplier 1 of the first embodiment, the creeping distance in the vicinity of the anode pin 13 is elongated, and dielectric breakdown and leakage current due to creeping discharge are prevented adequately and the mixing of noise into electrical signal taken out from the anode pin 13 is prevented. In regard to the chamfered shape 36*d*, the chamfered shape may be formed along the entire circumference of the peripheral portion of the upper surface side of base member 36 or any of the various modifications shown in FIG. 11 to FIG. 23 may be applied.

Also, since the full circumferences of the portions of the upper (inner) surface of the stem 35, through which the stem pins 6, including the anode pin 13, pass, are formed as recesses 35*a* having base member 36 as the bottom surfaces, the creeping distance regarding the vicinity of the anode pin 13 is elongated further and the mixing of noise into the electrical signal taken out from the anode pin 13 is prevented more effectively. Since the creeping distance is likewise elongated for each of the other stem pins 6 besides the anode pin 13, the voltage endurance of the photomultiplier 34 is improved. Since by the forming of recesses 35*a*, the creeping distances along insulators between the stem pins 6 are also elongated at the same time and furthermore the triple junctions are concealed inside recesses 35*a*, the voltage endurance of the photomultiplier 34 is improved further.

Also, since a base member seep recess 36*c* (see FIG. 42) is formed in base member 36, the excess volume of the molten base member 36 can be made to escape satisfactorily into the base member seep recess 36*c*. Thus in the process of melting base member 36, base member 36 will hardly overflow onto the surface of the stem 35 via the upper and lower portions of the openings 36*a* and the positional precision, flatness, and levelness of both surfaces of the stem 35 are thus secured.

Also even with the photomultiplier 34, since the full circumferences of the stem pin 6 passing portions of the upper (inner) surface and the lower (outer) surface of the stem 35 are arranged, as described above, as recesses 35*a* having base member 36 as the bottom surfaces, cracks are prevented from being formed at both sides of the portions at which base member 36 is joined to the stem pins 6, and airtightness and good appearance of the sealed container 8 are thus secured.

As with the photomultiplier 20 shown in FIG. 24, a structure, wherein a metal exhaust tube 19 is disposed at a central portion of the stem 35, may be employed in the photomultiplier 34 as well.

Also, though with the above-described embodiment, the base member seep recess 36*c* is provided as the base member seep portion at a lower portion of base member 36, such a base member seep portion may be provided at an upper portion of base member 36.

In arranging a radiation detector equipped with the photomultiplier 34, by arranging in the same manner as the radiation detectors 21 and 25 shown in FIG. 25 to FIG. 26 and FIG. 27 to FIG. 28, a radiation detector exhibiting the same actions and effects described above and is especially suitable for surface mounting can be provided.

Figure 44:
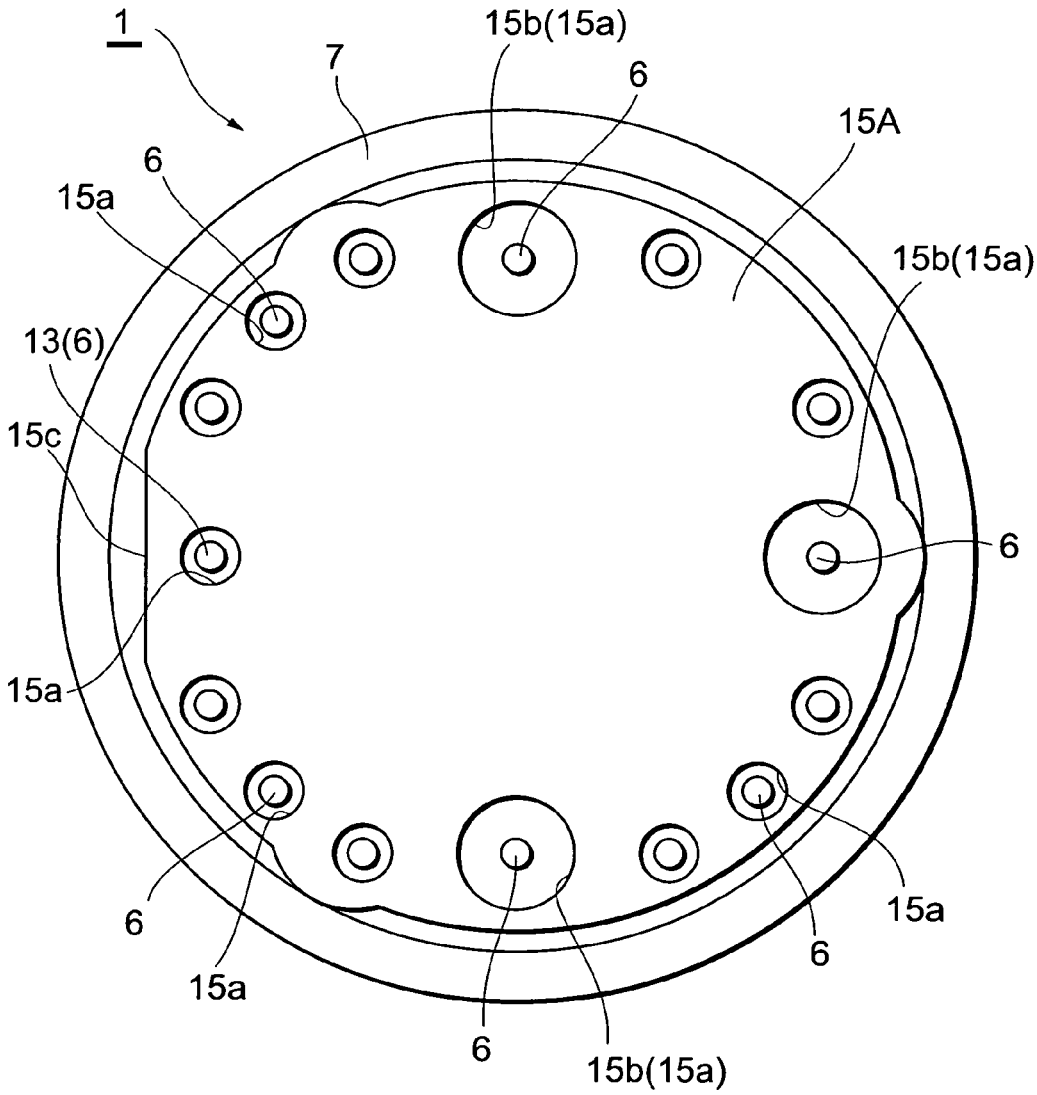
FIG. 44 is a diagram of a stem and a ring-like side tube of yet another modification example.
Figure 45:
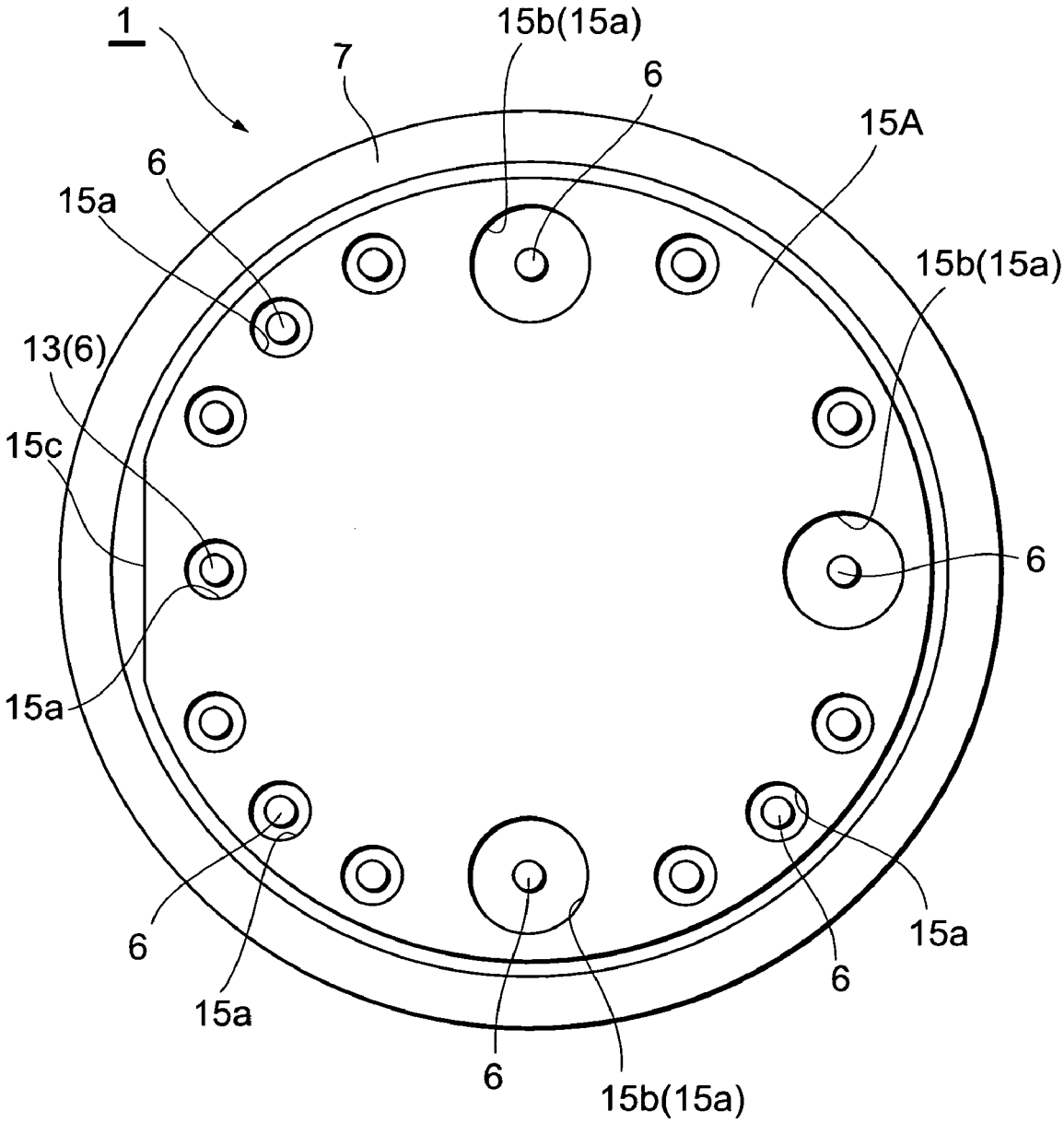
FIG. 45 is a diagram of a stem and a ring-like side tube of yet another modification example.

Though with the respective embodiments described above, the side tube 2 is joined to the ring-like side tube 7 in a state of contacting the entire circumference of the portion of the stem protruding out from the ring-like side tube 7, with the exception of the chamfered shape, a slight gap may be provided between the side tube 2 and the stem instead. That is, an the upper holding member 15A, provided with strut portions, for example, at three locations on the circumferential surface and designed so that the apex portions of the respective strut portions contact the inner wall of the side tube 2 as shown in FIG. 44, may be employed in the stem 5, or an the upper holding member 15B, which is made smaller in diameter than the inner diameter of the side tube 2 by approximately the width of the flange portion 7*a* of the ring-like side tube 7, may be employed. The creeping distances between the stem pins 6, including the anode pin 13, and the side tube 2 can be secured in these cases. The same modifications may be applied regardless of the number of layers of the stem and the above modifications may be applied to the base member.

As described above, with this invention's photomultiplier and radiation detector, the enlargement of the side tube diameter can be restrained. High density, high degree of integration, etc., can thereby be realized in mounting.

What is claimed is:

1. A photomultiplier comprising:

a conductive first side tube;

a conductive second side tube;

a photoelectric surface disposed inside the sealed container formed of the first side tube and the second side tube and put in a vacuum state, and converting incident light made incident through a light receiving plate into electrons, which forms an end portion at one side of the sealed container;

an electron multiplier unit disposed inside the sealed container and multiplying electrons emitted from the photoelectric surface;

an anode disposed inside the sealed container and used for taking out the electrons multiplied by the electron multiplier unit as an output signal;

a stem forming an end portion at the other side of the sealed container; and a plurality of stem pins insertedly mounted in the stem and leading to the exterior from inside the sealed container and electrically connected to the anode and the electron multiplier unit, wherein the first side tube surrounds the anode and the electron multiplier unit from the side, and the second side tube is positioned at the stem side of the first side tube and is joined to one end portion of the first side tube and the side surface of the stem, and the stem is joined to the second side tube so as to protrude out towards the first side tube from the second side tube, and the first side tube is joined to the second side tube in a state of being directly capped onto the portion of the stem that protrudes out from the second side tube.

2. The photomultiplier according to claim 1, wherein the stem has an insulating base member through and to which the stem pins, including an anode pin electrically connected to the anode, are passed and joined, and a peripheral portion of the base member that is near the anode pin and faces the interior of the sealed container is arranged as a chamfered shape.

3. The photomultiplier according to claim 1, wherein the stem includes:

an insulating base member through and to which the stem pins, including an anode pin electrically connected to the anode, are passed and joined; and an insulating holding member which is joined to one of an inner surface and an outer surface of the base member and through which the stems pins joined to the base member are passed.

4. The photomultiplier according to claim 1, wherein the stem includes:

an insulating base member through and to which the stem pins, including an anode pin electrically connected to the anode, are passed and joined; and an insulating holding member which is joined to an inner surface of the base member and through which the stem pins joined to the base member are passed, wherein a peripheral portion of the holding member that faces the interior of the sealed container and is near the anode pin is arranged as a chamfered shape.

5. The photomultiplier according to claim 1, wherein the stem includes:

an insulating base member through and to which the stem pins, including an anode pin electrically connected to the anode, are passed and joined; and holding members, which are joined respectively to an inner surface and an outer surface of the base member and through which the stem pins joined to the base member are passed, wherein the stem is a structure of three or more layers, and the holding member, which is positioned at the inner side of the base member and through which the anode pin is passed, has an insulating property and a peripheral portion thereof that faces the interior of the sealed container and is near the anode pin is arranged as a chamfered shape.

6. A radiation detector having a scintillator, converting radiation into light and emitting the light, installed at the outer side of the light receiving plate of the photomultiplier according to claim 1.

* * * * *